US006265117B1

(12) United States Patent
Taguchi

(10) Patent No.: US 6,265,117 B1
(45) **Date of Patent: *Jul. 24, 2001**

(54) COLOR IMAGING ELEMENT AND METHOD OF FORMING COLOR DIFFUSION TRANSFER IMAGE

(75) Inventor: Keiichi Taguchi, Kanagawa (JP)

(73) Assignee: Fuji Photo Film Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/399,172

(22) Filed: Sep. 20, 1999

(30) Foreign Application Priority Data

Sep. 21, 1998 (JP) ..... 10-266695

(51) Int. Cl.[7] ..... G03C 8/12; G03C 8/26; G03C 8/36; G03C 8/56; G03C 7/392

(52) U.S. Cl. ..... 430/17; 430/203; 430/213; 430/216; 430/218; 430/241; 430/380; 430/551; 430/237

(58) Field of Search ..... 430/216, 203, 430/380, 551, 218, 213, 237, 17, 241

(56) References Cited

U.S. PATENT DOCUMENTS

| | | | | |
|---|---|---|---|---|
| 4,465,757 | * | 8/1984 | Leppard et al. | 430/216 |
| 5,049,473 | * | 9/1991 | Furuya et al. | 430/216 |
| 5,780,210 | * | 7/1998 | Takeuchi et al. | 430/380 |
| 5,871,880 | * | 2/1999 | Makuta et al. | 430/218 |
| 5,976,756 | * | 11/1999 | Nakamura et al. | 430/218 |
| 6,010,819 | * | 1/2000 | Arakatsu et al. | 430/216 |
| 6,013,421 | * | 1/2000 | Nakamura et al. | 430/203 |

FOREIGN PATENT DOCUMENTS

| | | |
|---|---|---|
| 9-152705 | 6/1997 | (JP) . |
| 11-125889 | 5/1999 | (JP) . |

* cited by examiner

*Primary Examiner*—Richard L. Schilling
(74) *Attorney, Agent, or Firm*—Sughrue, Mion, Zinn, Macpeak & Seas, PLLC

(57) ABSTRACT

A color imaging element comprising a dye formed upon a reaction of an oxidation product of a compound represented by formula (I) shown below together with at least one water-soluble compound represented by formula (II) shown below on a support:

(I)

wherein Z represents a carbamoyl group, an acyl group, an alkoxycarbonyl group, an aryloxycarbonyl group, a sulfonyl group or a sulfamoyl group; and Q represents an atomic group necessary for forming an unsaturated ring together with the carbon atom;

(II)

wherein X represents a hydrogen atom, a hydroxy group, an aliphatic group, an acyl group, an aliphatic oxy group, an aliphatic oxycarbonyl group or an aryloxycarbonyl group; $Y_1$ and $Y_2$, which may be the same or different, each represents a hydrogen atom or a substituent, or $Y_1$ and $Y_2$ may be combined with each other to form a 5-membered or 6-membered ring; $Z_1$ represents a simple bond, a methylene group which may be substituted or an ethylene group which may be substituted; $Z_2$ represents a methylene group which may be substituted; and $R_1$, $R_2$, $R_3$ and $R_4$, which may be the same or different, each represents an aliphatic group, or $R_1$ and $R_2$ and $R_3$ and $R_4$ each may be combined with each other to form a 5-membered or 6-membered ring. A method of forming a color diffusion transfer image is also disclosed.

11 Claims, No Drawings

COLOR IMAGING ELEMENT AND METHOD OF FORMING COLOR DIFFUSION TRANSFER IMAGE

FIELD OF THE INVENTION

The present invention relates to a color imaging element excellent in color image density and image fastness and a method of forming a color diffusion transfer image.

BACKGROUND OF THE INVENTION

It is known that a silver halide photographic light-sensitive material is subjected to heat development to form an image as described, for example, in *Shashin Kogaku no Kiso <Higin-en Shashin>* (The Fundamentals of Photographic Engineering <Non-silver Salt Photography>), pages 242 to 255, Corona Publishing Co., Ltd. (1982) and U.S. Pat. No. 4,500,626.

It is also known that a heat developable light-sensitive material using silver halide has excellent photographic properties such as sensitivity and gradation in comparison with electrophotography or diazo photography. Various methods for obtaining a color image using a silver halide light-sensitive material have been proposed. Among them, a color development processing method wherein a dye image is formed upon a coupling reaction of an oxidation product of a color developing agent with a coupler is known. With respect to the color developing agent and coupler used in the color development processing method, a combination of a p-phenylenediamine reducing agent with a phenolic or active methylene coupler as described in U.S. Pat. No. 3,531,256, a p-aminophenol reducing agent as described in U.S. Pat. No. 3,761,270, and a combination of a sulfonamidophenol reducing agent with a four-equivalent coupler as described in U.S. Pat. No. 4,021,240 are proposed.

However, the color development processing method has problems in that printout of undeveloped silver halide remaining after processing and coloration of the undeveloped area for a lapse of time occur and in that color turbidity due to the presence of both reduced silver and color image in the exposed area is observed. In order to solve these problems, a dye transfer method wherein a diffusible dye is formed by heat development and the dye is transferred into an image receiving layer is proposed.

Of such diffusion transfer heat developable light-sensitive materials, there are a case wherein the light-sensitive material comprises an image receiving layer which is acceptable a dye on the support thereof and a case wherein the image receiving layer is provided on a support different from the support of the light-sensitive material.

In case of using heat developable color light-sensitive materials, it is particularly preferred to conduct the diffusion transfer of diffusible dye into a dye receiving layer provided on a support of an image receiving material simultaneously with or after the formation of diffusible dye in order to obtain dye images having high color purity.

Further, a method has been proposed in which a diffusible dye is released or formed imagewise by heat development and the diffusible dye is transferred into a dye fixing element. According to the method, either a negative dye image or a positive dye image can be obtained by changing the kind of dye-providing compound used or the kind of silver halide used. More details thereof are described, for example, in U.S. Pat. Nos. 4,500,626, 4,483,914, 4,503,137 and 4,559,290, JP-A-58-149046 (the term "JP-A" as used herein means an "unexamined published Japanese patent application"), JP-A-60-133449, JP-A-59-218443, JP-A-61-238056, EP-A-220,746, JIII Journal of Technical Disclosure No. 87-6199, and EP-A-210,660. However, the method is disadvantageous in that sensitivity of the light-sensitive element decreases since the dye-providing compound which contains a previously colored dye is employed. Therefore, it is preferred to conduct a method in which a dye is first formed by a reaction of a colorless coupler with a color developing agent and the dye formed is diffused.

The methods of forming an image by the coupling process as described above are also proposed. For instance, heat developable light-sensitive materials containing a color developing agent precursor which releases a p-phenylenediamine and a coupler as described, for example, in JP-B-63-36487 (the term "JP-B" as used herein means an "examined Japanese patent publication"), JP-A-5-224381 and JP-A-6-83005, a combination of a ureidoaniline reducing agent with an active methylene coupler as described in JP-A-59-111148, and a light-sensitive material using a coupler which has a coupling-off group containing a polymer chain and releases a diffusible dye upon color development as described in JP-A-58-149047 are proposed.

However, when the color developing agents or color developing agent precursors as described in the above described patents are employed, a problem in that the dyes formed have poor light-fastness during storage occurs in addition to the insufficient color image density after transfer. Accordingly, development of a technique which meets both the image fastness and color image density after transfer has been desired.

SUMMARY OF THE INVENTION

It is an object of the present invention, therefore, to provide a color imaging element which is excellent in color image density and image fastness.

Another object of the present invention is to provide a method of forming a color diffusion transfer image excellent in color image density and image fastness.

Other objects of the present invention will become apparent from the following description.

It has been found that the objects of the present invention are accomplished by a color imaging element comprising a dye formed upon a reaction of an oxidation product of a compound represented by formula (I) shown below together with at least one water-soluble compound represented by formula (II) shown below on a support:

(I)

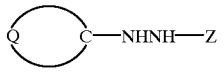

wherein Z represents a carbamoyl group, an acyl group, an alkoxycarbonyl group, an aryloxycarbonyl group, a sulfonyl group or a sulfamoyl group; and Q represents an atomic group necessary for forming an unsaturated ring together with the carbon atom;

(II)

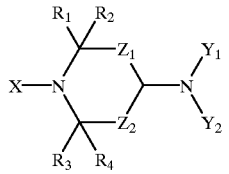

wherein X represents a hydrogen atom, a hydroxy group, an aliphatic group, an acyl group, an aliphatic oxy group, an aliphatic oxycarbonyl group or an aryloxycarbonyl group; $Y_1$ and $Y_2$, which may be the same or different, each represents a hydrogen atom or a substituent, or $Y_1$ and $Y_2$ may be combined with each other to form a 5-membered or 6-membered ring; $Z_1$ represents a simple bond, a methylene group which may be substituted or an ethylene group which may be substituted; $Z_2$ represents a methylene group which may be substituted; and $R_1$, $R_2$, $R_3$ and $R_4$, which may be the same or different, each represents an aliphatic group, or $R_1$ and $R_2$ and $R_3$ and $R_4$ each may be combined with each other to form a 5-membered or 6-membered ring.

The present invention also includes the following embodiments:

- a method of forming a color diffusion transfer image which comprises using a light-sensitive material comprising a support having thereon light-sensitive silver halide, a binder, a compound represented by formula (I) and a compound which forms or releases a diffusible dye upon a reaction with an oxidation product of the compound represented by formula (I), and a dye fixing material comprising a support having thereon at least one dye fixing layer to which the diffusible dye formed or released by development of the light-sensitive material after imagewise exposure is transferred and fixed, wherein the dye fixing layer and/or an adjacent layer thereto contains at least one water-soluble compound represented by formula (II), and
- a method of forming a color diffusion transfer image which comprises using a light-sensitive material comprising a support having thereon light-sensitive silver halide, a binder, a compound represented by formula (I) and a compound which forms or releases a diffusible dye upon a reaction with an oxidation product of the compound represented by formula (I), and a dye fixing material comprising a support having thereon at least one dye fixing layer to which the diffusible dye formed or released by development of the light-sensitive material after imagewise exposure is transferred and fixed, wherein a water-soluble compound represented by formula (II) is supplied before, during or after the formation or release of the diffusible dye.

DETAILED DESCRIPTION OF THE INVENTION

Now, the compound represented by formula (I) which can be used in the present invention will be described in more detail below.

In formula (I), Z represents a carbamoyl group, an acyl group, an alkoxycarbonyl group, an aryloxycarbonyl group, a sulfonyl group or a sulfamoyl group. Among them, a carbamoyl group is preferred, and a carbamoyl group having a hydrogen atom on the nitrogen atom thereof is particularly preferred.

The carbamoyl group is preferably a carbamoyl group having from 1 to 50 carbon atoms, more preferably from 6 to 40 carbon atoms. Specific examples thereof include a carbamoyl group, a methylcarbamoyl group, an ethylcarbamoyl group, an n-propylcarbamoyl group, a sec-butylcarbamoyl group, an n-octylcarbamoyl group, a cyclohexylcarbamoyl group, a tert-butylcarbamoyl group, a dodecylcarbamoyl group, a 3-dodecyloxypropylcarbamoyl group, an octadecylcarbamoyl group, a 3-(2,4-di-tert-pentylphenoxy)propylcarbamoyl group, a 2-hexyldecylcarbamoyl group, a phenylcarbamoyl group, a 4-dodecyloxyphenylcarbamoyl group, a 2-chloro-5-dodecyloxycarbonylphenylcarbamoyl group, a naphthylcarbamoyl group, a 3-pyridylcarbamoyl group, a 3,5-bis-octyloxycarbonylphenylcarbamoyl group, a 3,5-bis-tetradecyloxyphenylcarbamoyl group, a benzyloxycarbamoyl group and a 2,5-dioxo-1-pyrrolidinylcarbamoyl group.

The acyl group is preferably an acyl group having from 1 to 50 carbon atoms, more preferably from 6 to 40 carbon atoms. Specific examples thereof include a formyl group, an acetyl group, a 2-methylpropanoyl group, a cyclohexylcarbonyl group, an n-octanoyl group, a 2-hexyldecanoyl group, a dodecanoyl group, a chloroacetyl group, a trifluoroacetyl group, a benzoyl group, a 4-dodecyloxybenzoyl group, a 2-hydroxymethylbenzoyl group and a 3-(N-hydroxyl-N-methylaminocarbonyl)propanoyl group.

The alkoxycarbonyl group is preferably an alkoxycarbonyl group having from 2 to 50 carbon atoms, more preferably from 6 to 40 carbon atoms, and the aryloxycarbonyl group is preferably an aryloxycarbonyl group having from 7 to 50 carbon atoms, more preferably from 7 to 40 carbon, atoms. Specific examples thereof include a methoxycarbonyl group, an ethoxycarbonyl group, an isobutyloxycarbonyl group, a cyclohexyloxycarbonyl group, a dodecyloxycarbonyl group, a benzyloxycarbonyl group, a phenoxycarbonyl group, a 4-octyloxyphenoxycarbonyl group, a 2-hydroxymethylphenoxycarbonyl group and a 4-dodecyloxyphenoxycarbonyl group.

The sulfonyl group is preferably a sulfonyl group having from 1 to 50 carbon atoms, more preferably from 6 to 40 carbon atoms. Specific examples thereof include a methylsulfonyl group, a butylsulfonyl group, an octylsulfonyl group, a 2-hexyldecylsulfonyl group, a 3-dodecyloxypropylsulfonyl group, a 2-n-octyloxy-5-tert-octylphenylsulfonyl group and 4-dodecyloxyphenylsulfonyl group.

The sulfamoyl group is preferably a sulfamoyl group having from 1 to 50 carbon atoms, more preferably from 6 to 40 carbon atoms. Specific examples thereof include a sulfamoyl group, an ethylsulfamoyl group, a 2-ethylhexylsulfamoyl group, a decylsulfamoyl group, a hexadecylsulfamoyl group, a 3-(2-ethylhexyloxy)propylsulfamoyl group, a (2-chloro-5-dodecyloxycarbonylphenyl)sulfamoyl group and a 2-tetradecyloxyphenylsulfamoyl group.

In formula (I), Q represents an atomic group necessary for forming an unsaturated ring together with the carbon atom. The unsaturated ring formed is preferably a 3-, 4-, 5-, 6-, 7- or 8-membered ring, more preferably a 5-membered or 6-membered ring. Specific preferred examples thereof include a benzene ring, a pyridine ring, a pyrazine ring, a pyrimidine ring, a pyridazine ring, a 1,2,4-triazine ring, a 1,3,5-triazine ring, a pyrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxazole ring, an isothiazole ring, an isoxazole ring and a thiophene ring. Further, condensed rings formed by condensation of these rings are preferably employed.

The ring may have one or more substituents. Examples of the substituent include a straight chain, branched chain or cyclic alkyl group having from 1 to 50 carbon atoms (e.g., trifluoromethyl, methyl, ethyl propyl, heptafluoropropyl, isopropyl, butyl, tert-butyl, tert-pentyl, cyclopentyl, cyclohexyl, octyl, 2-ethylhexyl, or dodecyl), a straight chain, branched chain or cyclic alkenyl group having from 2 to 50 carbon atoms (e.g., vinyl, 1-methylvinyl, or cyclohexen-1-yl), an alkynyl group having a total carbon number of from 2 to 50 (e.g., ethynyl, or 1-propynyl), an aryl group having from 6 to 50 carbon atoms (e.g., phenyl, naphthyl, or anthryl), an acyloxy group having from 1 to 50 carbon atoms (e.g., acetoxy, tetradecanoyloxy, or benzoyloxy), an alkoxycarbonyloxy group having from 2 to 50 carbon atoms (e.g., methoxycarbonyloxy, or 2-methoxyethoxycaronyloxy), an aryloxycarbonyloxy group having from 7 to 50 carbon atoms (e.g., phenoxycarobonyloxy), a carbamoyloxy group having from 1 to 50 carbon atoms (e.g., N,N-dimethylcarbamoyloxy), a carbonamido group having form 1 to 50 carbon atoms (e.g., formamido, N-methylacetamido, acetamido, N-methylformamido, or benzamido), a sulfonamido group having from 1 to 50 carbon atoms (e.g., methanesulfonamido, dodecanesulfonamido, benzenesulfonamido, or p-toluenesulfonamido), a carbamoyl group having from 1 to 50 carbon atoms (e.g., N-methylcarbamoyl, N,N-diethylcarbamoyl, or N-mesylcarbamoyl), a sulfamoyl group having from 0 to 50 carbon atoms (e.g., N-butylsulfamoyl, N,N-diethylsulfamoyl, or N-methyl-N-(4-methoxyphenyl) sulfamoyl), an alkoxy group having from 1 to 50 carbon atoms (e.g., methoxy, propoxy, isopropoxy, octyloxy, tert-octyloxy, dodecyloxy, or 2-(2,4-di-tert-pentylphenoxy) ethoxy), an aryloxy group having from 6 to 50 carbon atoms (e.g., phenoxy, 4-methoxyphenoxy, or naphthoxy), an aryloxycarbonyl group having from 7 to 50 carbon atoms (e.g., phenoxycarbonyl, or naphthoxycarbonyl), an alkoxycarbonyl group having from 2 to 50 carbon atoms (e.g., methoxycarbonyl, or tert-butoxycarbonyl), an N-acylsulfamoyl group having from 1 to 50 carbon atoms (e.g., N-tetradecanoylsulfamoyl, or N-benzoylsulfamoyl), an N-sulfamoylcarbamoyl group having from 1 to 50 carbon atoms (e.g., N-methanesulfonylcarbamoyl), an alkylsulfonyl group having from 1 to 50 carbon atoms (e.g., methanesulfonyl, octylsulfonyl, 2-methoxyethylsulfonyl, or 2-hexyldecylsulfonyl), an arylsulfonyl group having from 6 to 50 carbon atoms (e.g., benzenesulfonyl, p-toluenesulfonyl, or 4-phenylsulfonylphenylsulfonyl), an alkoxycarbonylamino group having from 2 to 50 carbon atoms (e.g., ethoxycarbonylamino), an aryloxycarbonylamino group having from 7 to 50 carbon atoms (e.g., phenoxycarbonylamino, or naphthoxycarobnylamino) , an amino group having from 0 to 50 carbon atoms (e.g., amino, methylamino, diethylamino, diisopropylamino, anilino, or morpholino), an ammonio group having from 3 to 50 carbon atoms (e.g., trimethylammonio, or dimethylbenzylammonio), a cyano group, a nitro group, a carboxy group, a hydroxy group, a sulfo group, a mercapto group, an alkylsulfinyl group having from 1 to 50 carbon atoms (e.g., methanesulfinyl, or octanesulfinyl), an arylsulfinyl group having from 6 to 50 carbon atoms (e.g., benzenesulfinyl, 4-chlorophenylsulfinyl, or p-toluenesulfinyl), an alkylthio group having from 1 to 50 carbon atoms (e.g., methylthio, octylthio, or cyclohexylthio), an arylthio group having from 6 to 50 carbon atoms (e.g., phenylthio, or naphthylthio), a ureido group having from 1 to 50 carbon atoms (e.g., 3-methylureido, 3,3-dimethylureido, or 1,3-diphenylureido), a heterocyclic group having from 2 to 50 carbon atoms (a 3-, 4-, 5-, 6-, 7-, 8-, 9-, 10-, 11- or 12-membered monocyclic or condensed ring containing as a hetero atom at least one of, for example, nitrogen, oxygen and sulfur, e.g., 2-furyl, 2-pyranyl, 2-pyridyl, 2-thienyl, 2-imidazolyl, morpholino, 2-quinolyl, 2-benzimidazolyl, 2-benzothiazolyl, or 2-benzoxazolyl), an acyl group having from 1 to 50 carbon atoms (e.g., acetyl, benzoyl, or trifluoroacetyl), a sulfamoylamino group having from 0 to 50 carbon atoms (e.g., N-butylsulfamoylamino, or N-phenylsulfamoylamino), a silyl group having from 3 to 50 carbon atoms (e.g., trimethylsilyl, dimethyl-tert-butylsilyl, or triphenylsilyl) and a halogen atom (e.g., fluorine, chlorine, or bromine). These substituents each may further have a substituent and examples of the substituent include the substituents described above.

The substituent preferably has 50 or less carbon atoms, more preferably 42 or less carbon atoms, and still more preferably 30 or less carbon atoms. In order that a dye formed by a reaction of the color developing agent according to the present invention with a coupler may have sufficient diffusibility, the total number of carbon atoms included in the unsaturated ring formed by Q and the carbon atom and substituent(s) thereon is preferably from 1 to 30, more preferably from 1 to 24, and still more preferably from 1 to 18.

In a case wherein the unsaturated ring formed by Q and the carbon atom is completed only with carbon atoms, such as a benzene ring, a naphthalene ring or an anthracene ring, the sum of the Hammett's substituent constant $\sigma$ values relating to all substituents on the ring is preferably 0.8 or more, more preferably 1.2 or more, and still more preferably 1.5 or more. The Hammett's substituent constant a value relating to the substituent is calculated using the $\sigma_0$ value, when the substituents are present at 1,2- or 1,4-positions to the carbon atom, and using the $\sigma_m$ value, when the substituents are present at 1,3- or 1,5-positions to the carbon atom.

The Hammett's substituent constants $\sigma_p$ and $\sigma_m$ are described in detail, for example, in Naoki Inamoto, *Hammett Soku <Kozo to Han'nosei>* (Hammett's Rule <Structure and Reactivity>), Maruzen; *Shin Jikken Kagaku Koza* 14 *Yuki Kagobutsu no Gosei to Han'no V* (New Experimental Chemistry Lecture 14, Synthesis and Reaction of Organic Compound V), page 2605, Nippon Kagaku Kai (compiler), Maruzen; Tadao Nakaya, *Riron Yuki Kagaku Kaisetsu* (Theoretical Organic Chemistry Exposition), page 217, Tokyo Kagaku Dojin; and Chemical Review, Vol. 91, pages 165 to 195 (1991).

Specific examples of the color developing agent represented by formula (I) are set forth below, but the present invention should not be construed as being limited thereto.

R-(1)
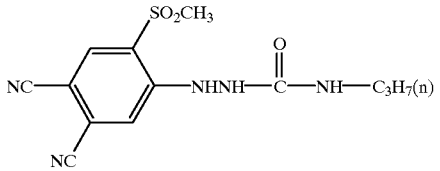
R-(2)
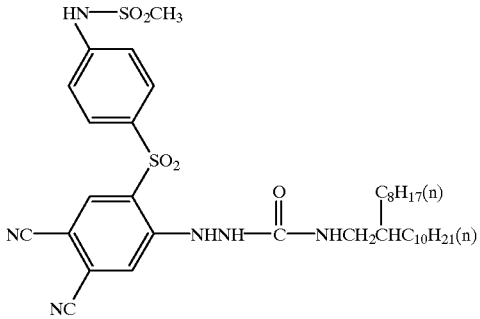
R-(3)
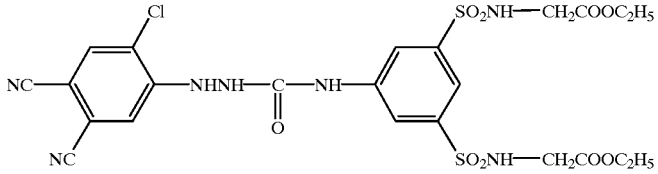
R-(4)
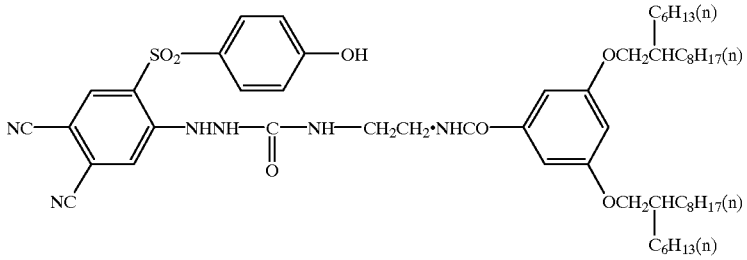
R-(5)
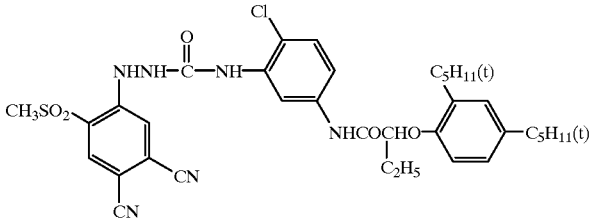
R-(6)
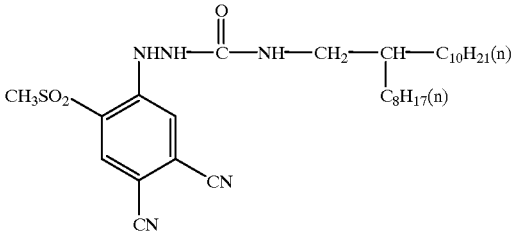
R-(7)
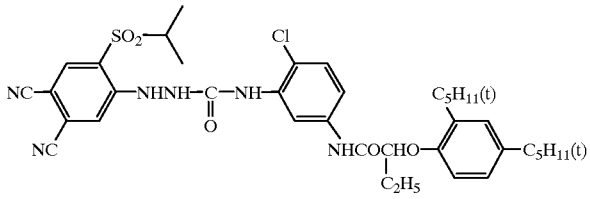
R-(8)
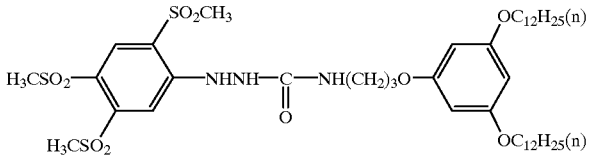
R-(9)
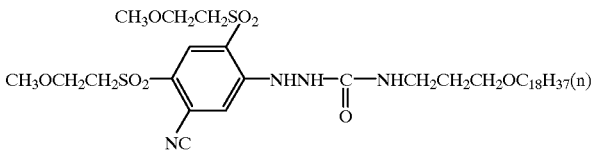
R-(10)
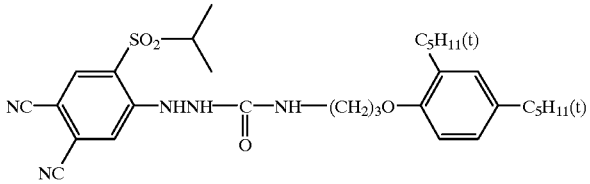

-continued
R-(11)
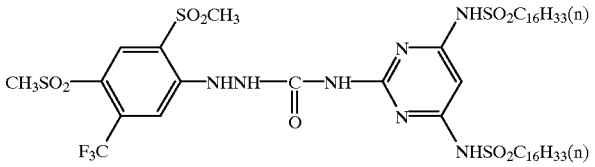
R-(12)
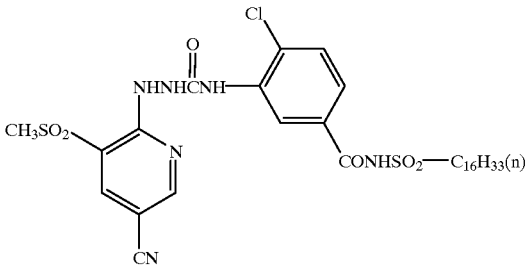
R-(13)
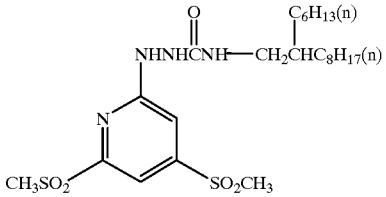
R-(14)
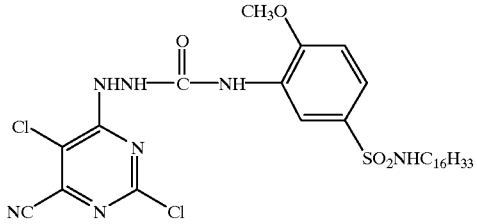
R-(15)
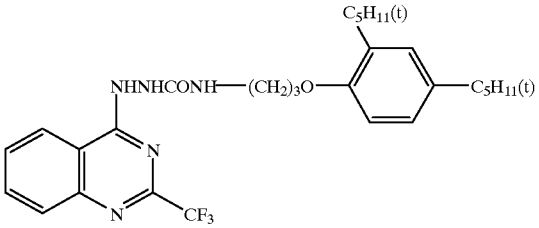
R-(16)
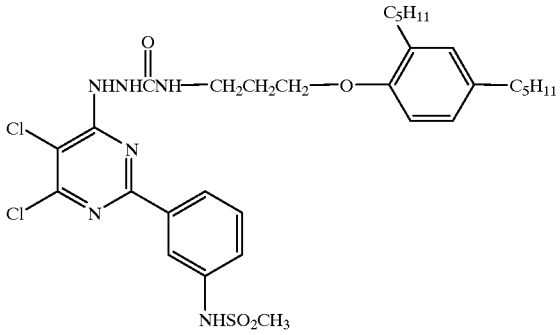
R-(17)
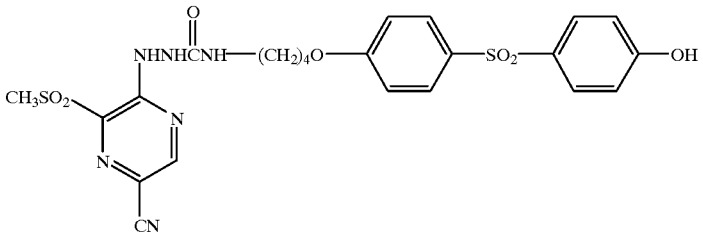
R-(18)
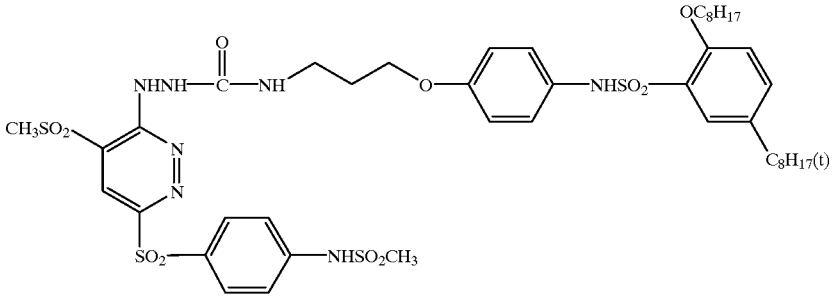

-continued
R-(19)
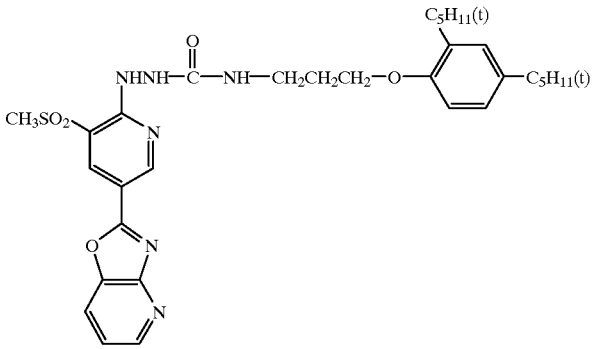
R-(20)
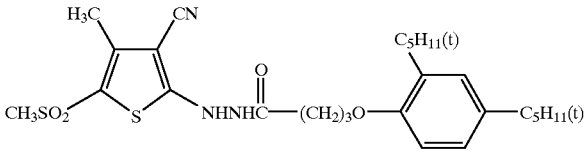
R-(21)
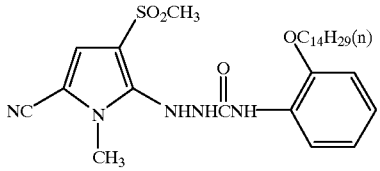
R-(22)
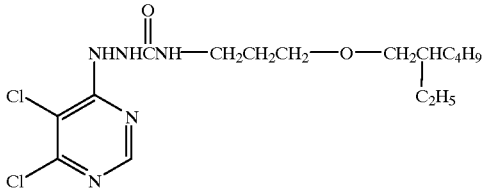
R-(23)
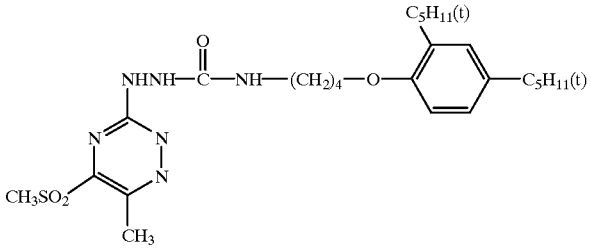
R-(24)
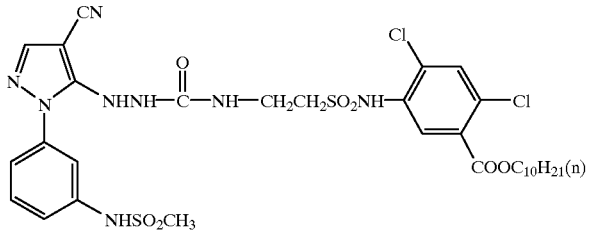
R-(25)
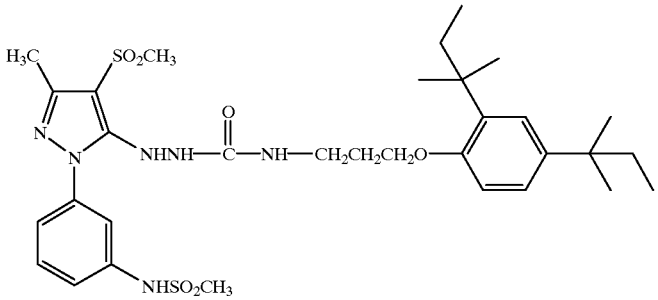
R-(26)
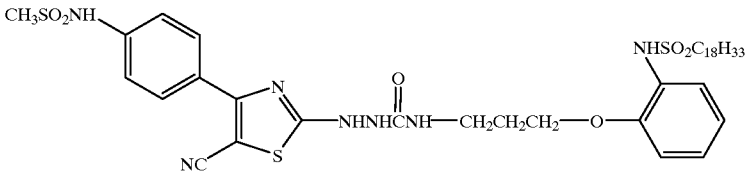
R-(27)
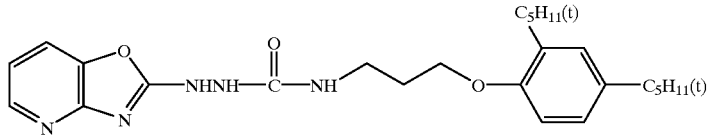

-continued

R-(28)

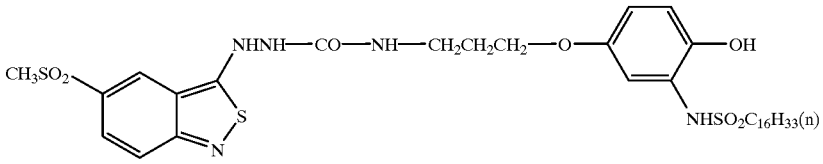

R-(29)

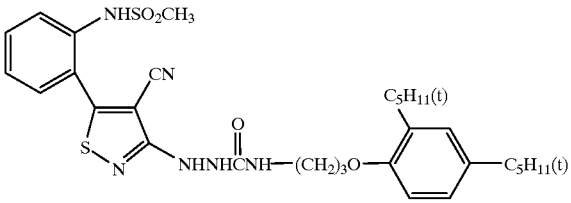

R-(30)

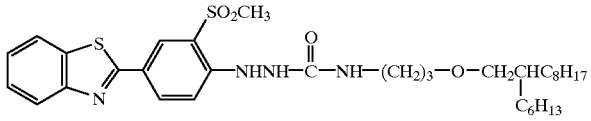

R-(31)

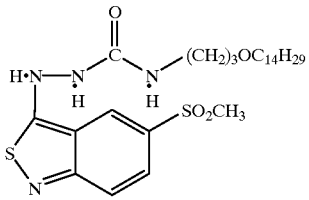

R-(32)

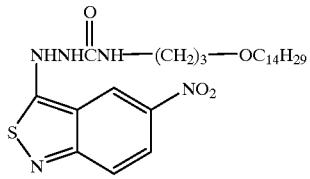

R-(33)

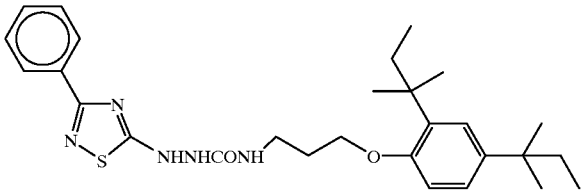

R-(34)

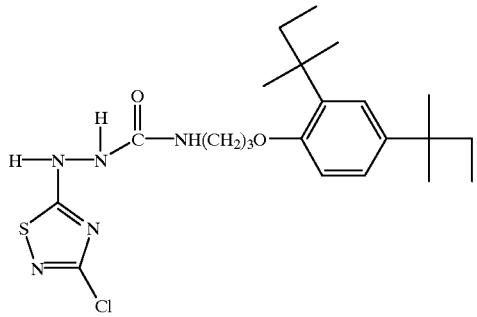

A synthesis method of the compound represented by formula (I) according to the present invention is described below. Representative synthesis examples of the compounds used in the present invention are described below. Other compounds can be synthesized in a manner similar to these synthesis examples.

SYNTHESIS EXAMPLE 1

Synthesis of Compound R-(1) Compound R-(1) was synthesized according to the following synthesis route:

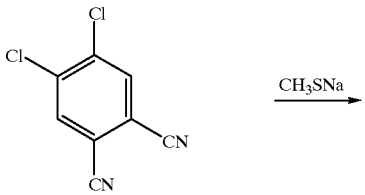

(A-1)

-continued

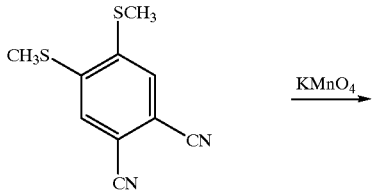

(A-2)

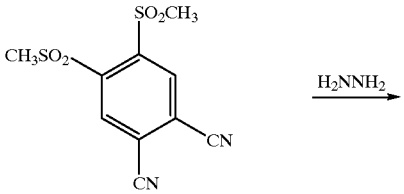

(A-3)

-continued

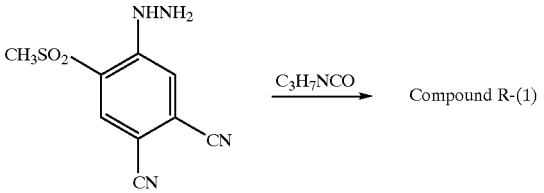

(A-4)

Synthesis of Compound (A-2)

In 1.1 liter of N,N-dimethylformamide (DMF) was dissolved 53.1 g of 1,2-dichloro-4,5-dicyanobenzene (Compound (A-1)) (CAS Registry No. 139152-08-2). To the solution was added dropwise 268 g of a 15% aqueous solution of sodium salt of methylmercaptan at room temperature over a period of one hour, followed by stirring at 60° C. for one hour. The reaction solution was cooled to room temperature, poured into water and stirred for 30 minutes. The white solid thus deposited was collected by filtration, washed with water and dried. Yield: 46.5 g (78.1%).

Synthesis of Compound (A-3)

Into 400 ml of acetic acid was suspended 41.1 g of Compound (A-2), and a solution containing 89.3 g of potassium permanganate dissolved in 400 ml of water was added dropwise thereto under cooling with water over a period of one hour. After allowing to stand overnight at room temperature, 2 liters of water and 2 liters of ethyl acetate were added to the reaction mixture, and the mixture was filtered with Celite. The filtrate was separated, and the organic layer was washed in order with water, an aqueous solution of sodium hydrosulfite, an aqueous solution of sodium bicarbonate and an aqueous solution of sodium chloride and dried with anhydrous magnesium sulfate. After filtration, the solvent was distilled off, and to the residue was added a solvent mixture of ethyl acetate and hexane to crystallize. Compound (A-3) was obtained as a white solid. Yield: 29.4 g (55.0%).

Synthesis of Compound (A-4)

In 200 ml of dimethylsulfoxide (DMSO) was dissolved 29.4 g of Compound (A-3), and 8.7 g of hydrazine hydrate was added dropwise thereto under cooling with water over a period of 15 minutes, followed by stirring under cooling with water for 10 minutes. To the reaction solution was added water, and the yellow solid thus deposited was collected by filtration, washed with water and dried. Yield: 17.4 g (70.9%).

Synthesis of Compound R-(1)

In 50 ml of tetrahydrofuran was dissolved 11.8 g of Compound (A-4), 4.7 g of propyl isocyanate was added dropwise at room temperature over a period of 30 minutes, followed by stirring for one hour. The reaction mixture was poured into water and extracted with ethyl acetate. The organic layer was washed with an aqueous hydrochloric acid solution and then an aqueous sodium chloride solution, and dried with anhydrous magnesium sulfate. After filtration, the solvent was distilled off, and the residue was crystallized from a solvent mixture of ethyl acetate and hexane (1:10) to obtain Compound R-(1) as a white solid. Yield: 14.5 g (90.2%).

SYNTHESIS EXAMPLE 2

Synthesis of Compound R-(5)

Compound R-(5) was synthesized according to the following synthesis route:

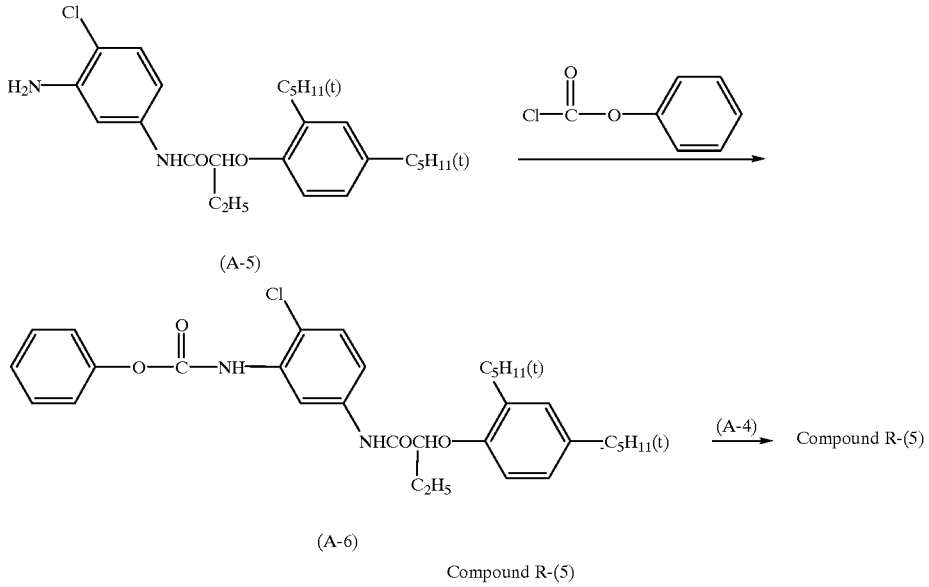

Synthesis of Compound (A-6)

In 500 ml of ethyl acetate was dissolved 44.5 g of Compound (A-5) (CAS Registry No. 51461-11-1), and 500 ml of water containing 25 g of sodium bicarbonate dissolved therein was added thereto. To the solution was added dropwise 16.4 g of phenyl chlorocarbonate at room temperature over a period of 30 minutes, followed by stirring for one hour. The reaction mixture was separated, and the organic layer was washed with an aqueous solution of sodium chloride and dried with anhydrous magnesium sulfate. After filtration, the solvent was distilled off to obtain Compound (A-6) as a pale yellow oil. Yield: 54.0 g (95.6%).

Synthesis of Compound R-(5)

In 100 ml of acetonitrile were dissolved 5.0 g of Compound (A-4), 13.0 g of Compound (A-9) and 0.50 g of N,N-dimethylaminopyridine (DMAP) and the solution was stirred at 60° C. for 3 hours. The reaction mixture was poured into water and extracted with ethyl acetate. The organic layer was washed in order with an aqueous solution of sodium bicarbonate, an aqueous solution of hydrochloric acid and an aqueous solution of sodium chloride and dried with anhydrous magnesium sulfate. After filtration, the solvent was distilled off, and the residue was purified with silica gel column chromatography (eluate: ethyl acetate/hexane=1/2) and crystallized from hexane to obtain 7.5 g of Compound R-(5) as a white solid.

SYNTHESIS EXAMPLE 3

Synthesis of Compound R-(15)

Compound R-(15) was synthesized according to the following synthesis route:

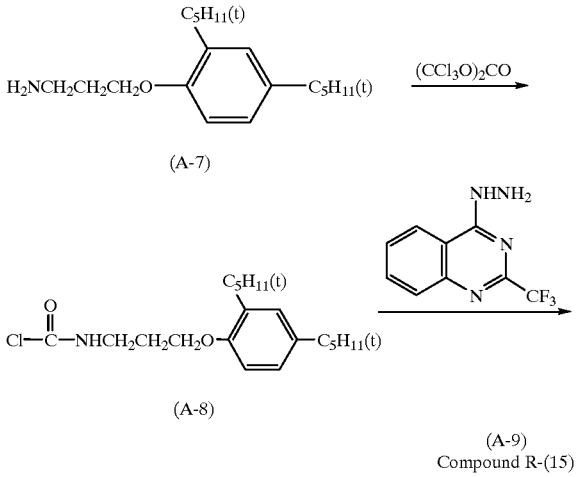

Synthesis of Compound R-(15)

In 100 ml of tetrahydrofuran (THF) was dissolved 4.6 g of triphosgene, and to the solution was added dropwise 13.6 g of Compound (A-7) (CAS Registry No. 61053-26-7) at room temperature over a period of 10 minutes and further was added dropwise 18.7 ml of triethylamine at room temperature over a period of 10 minutes. The reaction was continued for 30 minutes to prepare a solution of Compound (A-8). To the solution was divisionally added 9.0 g of Compound (A-9) at room temperature over a period of 10 minutes. After stirring for one hour, the reaction mixture was poured into water and extracted with ethyl acetate. The organic layer was washed in order with an aqueous solution of sodium bicarbonate, an aqueous solution of hydrochloric acid and an aqueous solution of sodium chloride and dried with anhydrous magnesium sulfate. After filtration, the solvent was distilled off, and the residue was purified with silica gel column chromatography and crystallized from a solvent mixture of ethyl acetate and hexane (1:10) to obtain Compound R-(15) as a white solid.

Compound (A-9) used above was synthesized according to the method described in EP-A-545,491.

The color developing agent according to the present invention is employed together with a compound (coupler) which forms a dye upon an oxidation coupling reaction. In the present invention, so-called two-equivalent couplers substituted at their coupling positions which are generally used silver halide photography utilizing a paraphenylenediamine developing agent as a developing agent are preferably employed. Specific examples of the coupler are described in detail, for example, in T. H. James, *The Theory of the Photographic Process*, Fourth Edition, pages 291 to 334 and 354 to 361, Macmillan (1977), JP-A-58-12353, JP-A-58-149046, JP-A-58-149047, JP-A-59-11114, JP-A-59-124399, JP-A-59-174835, JP-A-59-231539, JP-A-59-231540, JP-A-60-2951, JP-A-60-14242, JP-A-60-23474 and JP-A-60-66249.

Examples of the couplers which are preferably used in the present invention include compounds having a structure represented by formula (1), (2), (3), (4), (5), (6), (7), (8), (9), (10), (11) or (12) described below. In general, these compounds are collectively called active methylene, pyrazolone, pyrazolazole, phenol, naphthol or pyrrolotriazole, and are known in the field of art.

(1)

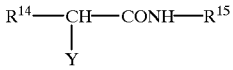

(2)

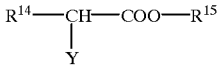

(3)

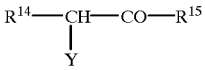

(4)

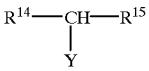

(5)

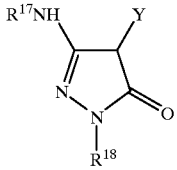

(6)

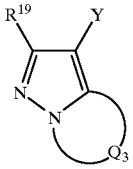

(7)

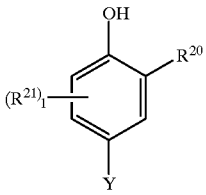

-continued (8)

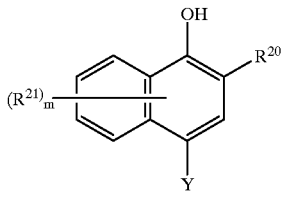

(9)

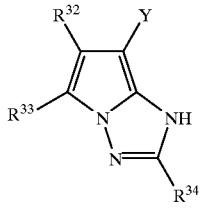

(10)

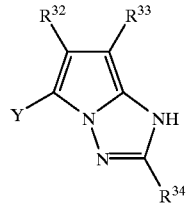

(11)

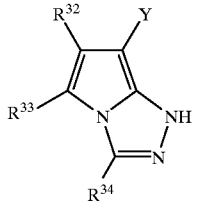

(12)

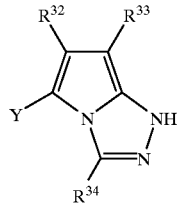

Couplers having a structure of formula (1), (2), (3) or (4) are called active methylene couplers and described, for example, in U.S. Pat. Nos. 3,933,501, 4,022,620 and 4,248,961, JP-B-58-10739, British Patents 1,425,020 and 1,476,760, U.S. Pat. Nos. 3,973,968, 4,314,023 and 4,511,649, and EP-A-249,473. In the formulae, $R^{14}$ represents an acyl group, an aryl group, a heterocyclic group, an alkoxycarbonyl group, an aryloxycarbonyl group, a carbamoyl group, a sulfamoyl group, an alkylsulfonyl group or an arylsulfonyl group, each of which may have a substituent, or a cyano group or a nitro group.

In formulae (1) to (3), $R^{15}$ represents an alkyl group, an aryl group or a heterocyclic group, each of which may have a substituent. In formula (4), $R^{16}$ represents an aryl group or a heterocyclic group, each of which may have a substituent. Examples of the substituent of $R^{14}$, $R^{15}$ or $R^{16}$ include those described for the ring formed from Q and the carbon atom in formula (I) above.

In formulae (1) to (4), $R^{14}$ and $R^{15}$ or $R^{14}$ and $R^{16}$ may be combined with each other to form a ring.

Couplers having a structure of formula (5) are called 5-pyrazolone couplers. In the formula, $R^{17}$ represents an alkyl group, an aryl group, an acyl group or a carbamoyl group and $R^{18}$ represents a phenyl group or a phenyl group substituted with one or more halogen atoms, alkyl groups, cyano groups, alkoxy groups, alkoxycarbonyl groups or acylamino groups.

Among the 5-pyrazolone couplers represented by formula (5), preferred are those where $R^{17}$ is an aryl group or an acyl group and $R^{18}$ is a phenyl group substituted with one or more halogen atoms.

More specifically described with respect to the preferred groups, $R^{17}$ is an aryl group such as a phenyl group, a 2-chlorophenyl group, a 2-methoxyphenyl group, a 2-chloro-5-tetradecanamidophenyl group, a 2-chloro-5-(3-octadecenyl-l-succinimido)phenyl group, a 2-chloro-5-octadecylsulfonamidophenyl group and a 2-chloro-5-[2-(4-hydroxy-3-tert-butylphenoxy)tetradecanamido]phenyl, or an acyl group such as an acetyl group, a 2-(2,4-di-tert-pentylphenoxy)butanoyl group, a benzoyl group and a 3-(2,4-di-tert-amylphenoxyacetamido)benzoyl group. These groups each may further have a subsistent and examples thereof include an organic substituent linked through a carbon atom, an oxygen atom, a nitrogen atom or a sulfur atom, and a halogen atom.

$R^{18}$ is preferably a substituted phenyl group such as a 2,4,6-trichlorophenyl group, a 2,5-dichlorophenyl group and a 2-chlorophenyl group.

Couplers having a structure of formula (6) are called pyrazoloazole couplers. In the formula, $R^{19}$ represents a hydrogen atom or a substituent, $Q^3$ represents a non-metallic atomic group necessary for forming a 5-membered azole ring containing from 2 to 4 nitrogen atoms. The azole ring may have a substituent (including a condensed ring).

Among the pyrazoloazole couplers represented by formula (6), preferred in view of spectral absorption characteristics of dye formed therefrom are imidazo[1,2-b]pyrazoles as described in U.S. Pat. No. 4,500,630, pyrazolo[1,5-b]-1,2,4-triazoles as described in U.S. Pat. No. 4,500,654 and pyrazolo[5,1-c]-1,2,4-triazoles as described in U.S. Pat. No. 3,725,067.

The substituent represented by $R^{19}$ and the substituent of the azole ring represented by $Q^3$ are described in detail, for example, in U.S. Pat. No. 4,540,654, from column 2, line 41 to column 8, line 27. Preferred are a pyrazoloazole coupler having a branched alkyl group directly bonded to the 2-, 3- or 6-position of the pyrazolotriazole group described in JP-A-61-65245, a pyrazoloazole coupler containing a sulfonamido group in the molecule thereof described in JP-A-61-65245, a pyrazoloazole coupler having an alkoxyphenylsulfonamido ballast group described in JP-A-61-147254, a pyrazolotriazole coupler having an alkoxy group or an aryloxy group at the 6-position thereof described in JP-A-62-209457 and JP-A-63-307453, and a pyrazolotriazole coupler having a carbonamido group in the molecule thereof described in JP-A-2-201443.

Couplers having a structure of formula (7) or (8) are called a phenol coupler or a naphthol coupler, respectively. In the formula, $R^{20}$ represents a hydrogen atom or a group selected from $—CONR^{22}R^{23}$, $—SO_2NR^{22}R^{23}$, $—NHCOR^{22}$, $—NHCONR^2R^{23}$ and $—NHSO_2NR^{22}R^{23}$ (wherein $R^{22}$ and $R^{23}$ each represents a hydrogen atom or a substituent). In formulae (7) and (8), $R^{21}$ represents a substituent, l represents an integer of from 0 to 2, and m represents an integer of from 0 to 4. When l or m is 2 or greater, the $R^{21}$ groups may be the same or different.

Examples of the substituent represented by $R^{21}$, $R^{22}$ or $R^{23}$ include those described for the ring formed from Q and the carbon atom in formula (I) above.

Preferred examples of the phenol coupler represented by formula (7) include 2-acylamino-5-alkylphenol couplers described in U.S. Pat. Nos. 2,369,929, 2,801,171, 2,772,162, 2,895,826 and 3,772,002, 2,5-diacylaminophenol couplers described in U.S. Pat. Nos. 2,772,162, 3,758,308, 4,126,396, 4,334,011 and 4,327,173, West German Patent Application (OLS) No. 3,329,729 and JP-A-59-166956, and 2-phenylureido-5-acylaminophenol couplers described in U.S. Pat. Nos. 3,446,622, 4,333,999, 4,451,559 and 4,427,767.

Preferred examples of the naphthol coupler represented by formula (8) include 2-carbamoyl-1-naphthol couplers described in U.S. Pat. Nos. 2,474,293, 4,052,212, 4,146,396, 4,282,233 and 4,296,200, and 2-carbamoyl-5-amido-1-naphthol couplers described in U.S. Patent 4,690,889.

Couplers having a structure of formula (9), (10), (11) or (12) are called pyrrolotriazole couplers. In the formulae, $R^{32}$, $R^{33}$, and $R^{34}$ each represents a hydrogen atom or a substituent. Examples of the substituent represented by $R^{32}$, $R^{33}$ or $R^{34}$ include those described for the ring formed from Q and the carbon atom in formula (I) above. Preferred examples of the pyrrolotriazole couplers represented by formulae (9) to (12) include couplers where at least one of $R^{32}$ and $R^{33}$ is an electron withdrawing group as described in EP-A-488,248, EP-A-491,197, EP-A-545,300 and U.S. Pat. No. 5,384,236.

In formulae (1) to (12), Y represents a group imparting diffusion resistant property to the coupler and capable of being released upon a coupling reaction with an oxidation product of the developing agent. Examples of Y include a heterocyclic group (a saturated or unsaturated 5-, 6- or 7-membered monocyclic or condensed ring containing as a hetero atom at least one of nitrogen, oxygen and sulfur, e.g., succinimido, maleinimido, phthalimido, diglycolimido, pyrrole, pyrazole, imidazole, 1,2,4-triazole, tetrazole, indole, benzopyrazole, benzimidazole, benzotriazole, imidazolin-2,4-dione, oxazolidin-2,4-dione, thiazolidin-2,4-dione, imidazolidin-2-one, oxazolin-2-one, thiazolin-2-one, benzimidazolin-2-one, benzoxazolin-2-one, benzothiazolin-2-one, 2-pyrrolin-5-one, 2-imidazolin-5-one, indolin-2,3-dione, 2,6-dioxypurine, parabanic acid, 1,2,4-triazolidin-3,5-dione, 2-pyridone, 4-pyridone, 2-pyrimidone, 6-pyridazone, 2-pyrazone, 2-amino-1,3,4-thiazolidine, or 2-imino-1,3,4-thiazolidin-4-one), an aryloxy group (e.g., phenoxy, or 1-naphthoxy), a heterocyclic oxy group (e.g., pyridyloxy, or pyrazoloxy), an acyloxy group (e.g., acetoxy, or benzoyloxy), an alkoxy group (e.g., dodecyloxy), a carbamoyloxy group (e.g., N,N-diethylcarbamoyloxy, or morpholinocarbonyloxy), an aryloxycarbonyloxy group (e.g., phenoxycarbonyloxy), an alkoxycarbonyloxy group (e.g., methoxycarbonyloxy, or ethoxycarbonyloxy), an arylthio group (e.g., phenylthio, or naphthylthio), a heterocyclic thio group (e.g., tetrazolylthio, 1,3,4-thiadiazolylthio, 1,3,4-oxadiazolylthio, or benzimidazolylthio), an alkylthio group (e.g., methylthio, octylthio, or hexadecylthio), an alkylsulfonyloxy group (e.g., methanesulfonyloxy), an arylsulfonyloxy group (e.g., benzenesulfonyloxy, or toluenesulfonyloxy), a carbonamido group (e.g., acetamido, or trifluoroacetamido), a sulfonamido group (e.g., methanesulfonamido, or benzenesulfonamido), an alkylsulfonyl group (e.g., methanesulfonyl), an arylsulfonyl group (e.g., benzenesulfonyl), an alkylsulfinyl group (e.g., methanesulfinyl), an arylsulfinyl group (e.g., benzenesulfinyl), an arylazo group (e.g., phenylazo, or naphthylazo) and a carbamoylamino group (e.g., N-methylcarbamoylamino).

Y may be substituted with a substituent and examples of the substituent of Y include those described for the ring formed from Q and the carbon atom in formula (I) above.

The total number of carbon atoms included in Y is preferably from 6 to 50, more preferably from 8 to 40, and still more preferably from 10 to 30.

Y is preferably an aryloxy group, a heterocyclic oxy group, an acyloxy group, an aryloxycarbonyloxy group, an alkoxycarbonyloxy group or a carbamoyloxy group.

In addition, couplers having a structure such as a condensed ring phenol, an imidazole, a pyrrole, a 3-hydroxypyridine, an active methylene other than those described above, an active methine, a 5,5-condensed heterocyclic ring or a 5,6-condensed heterocyclic ring may be used.

The condensed ring phenol couplers used include couplers described in U.S. Pat. Nos. 4,327,173, 4,564,586 and 4,904,575.

The imidazole couplers used include couplers described in U.S. Pat. Nos. 4,818,672 and 5,051,347.

The 3-hydroxypyridine couplers used include couplers described in JP-A-1-315736.

The active methylene and active methine couplers used include couplers described in U.S. Pat. Nos. 5,104,783 and 5,162,196.

The 5,5-condensed heterocyclic ring couplers used include pyrrolopyrazole couplers described in U.S. Pat. No. 5,164,289 and the pyrroloimidazole couplers described in JP-A-4-174429.

The 5,6-condensed heterocyclic ring couplers used include pyrazolopyrimidine couplers described in U.S. Pat. No. 4,950,585, pyrrolotriazine couplers described in JP-A-4-204730, and couplers described in European Patent 556,700.

In addition to the above-described couplers, couplers described in West German Patents 3,819,051A and 3,823,049, U.S. Pat. Nos. 4,840,883, 5,024,930, 5,051,347 and 4,481,268, EP-A-304,856, EP-A-329,036, EP-A-354,549, EP-A-374,781, EP-A-379,110, EP-A-386,930, JP-A-63-141055, JP-A-64-32260, JP-A-64-32261, JP-A-2-297547, JP-A-2-44340, JP-A-2-110555, JP-A- 3-7938, JP-A-3-160440, JP-A-3-172839, JP-A-4-172447, JP-A-4-179949, JP-A-4-182645, JP-A-4-184437, JP-A-4-188138, JP-A-4-188139, JP-A-4-194847, JP-A-4-204532, JP-A-4-204731 and JP-A-4-204732 can be used in the present invention.

In the coupler used in the present invention, the total number of carbon atoms included in the part other than Y is preferably from 1 to 30, more preferably from 1 to 24, and still more preferably from 1 to 18.

Specific examples of the couplers which can be used in the present invention are set forth below, however, the present invention should not be construed as being limited thereto.

C-(1)
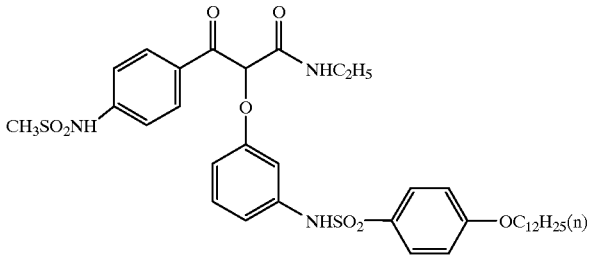
C-(2)
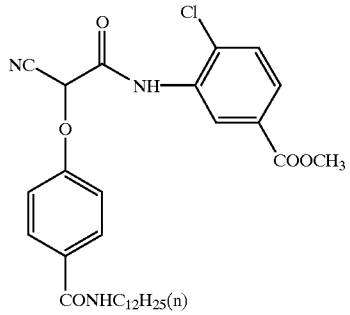
C-(3)
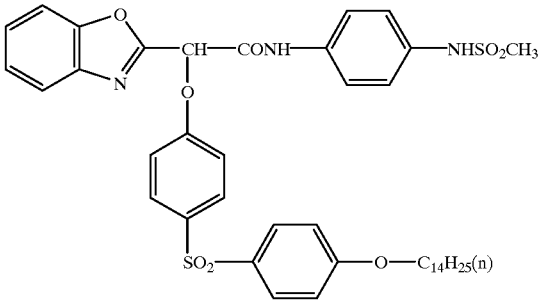
C-(4)
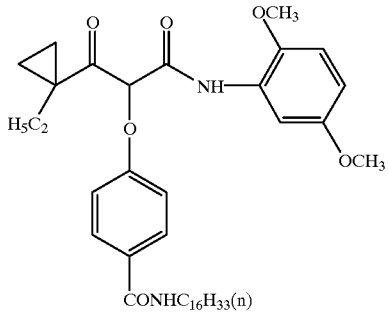
C-(5)
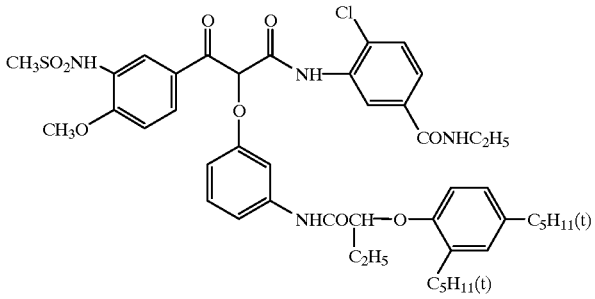
C-(6)
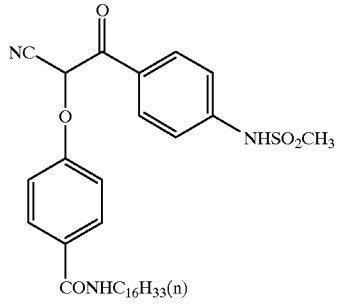
C-(7)
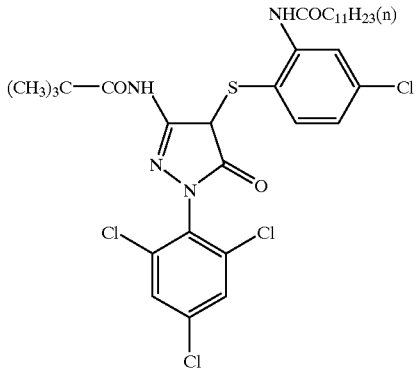
C-(8)
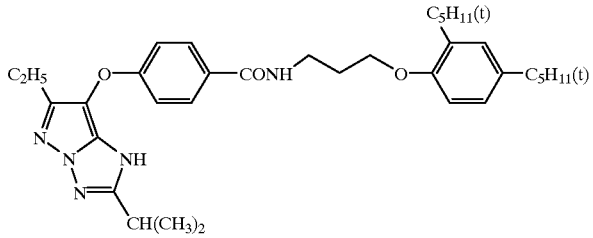

-continued
C-(9)
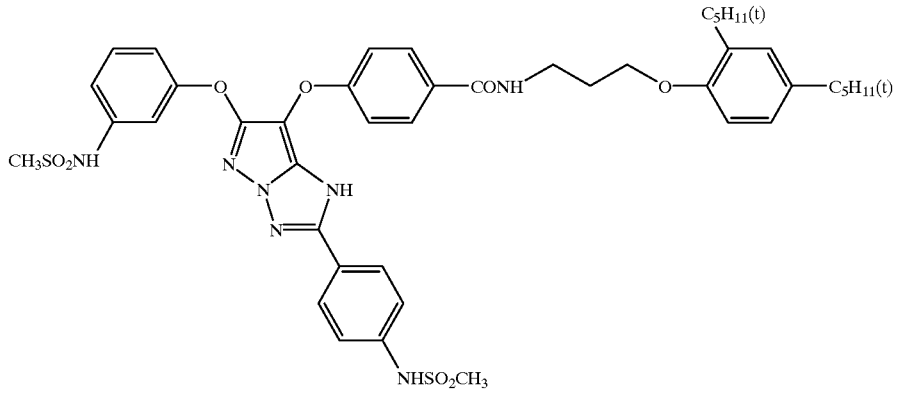
C-(10)
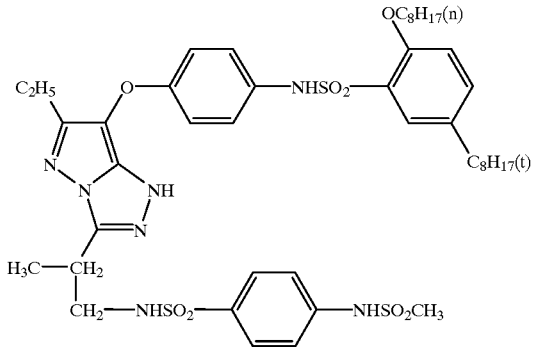
C-(11)
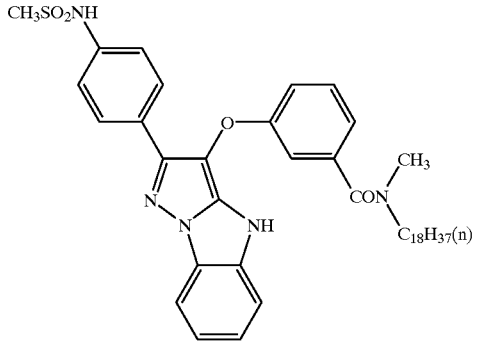
C-(12)
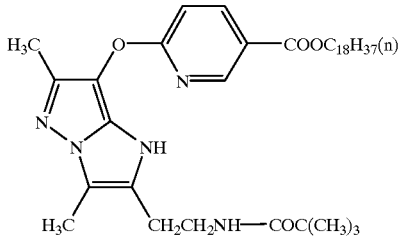
C-(13)
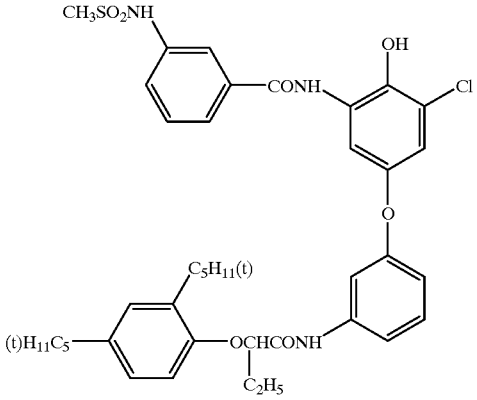
C-(14)
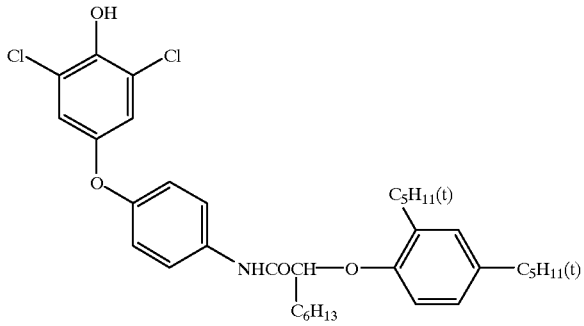
C-(15)
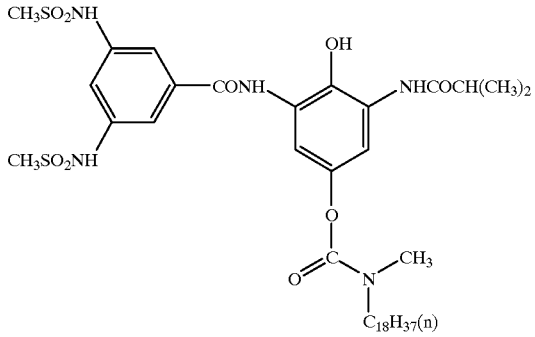

-continued
C-(16)
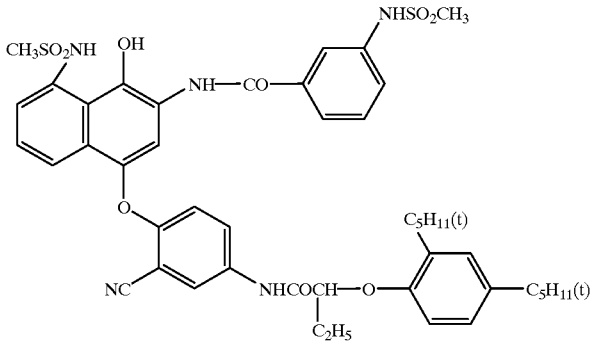
C-(17)
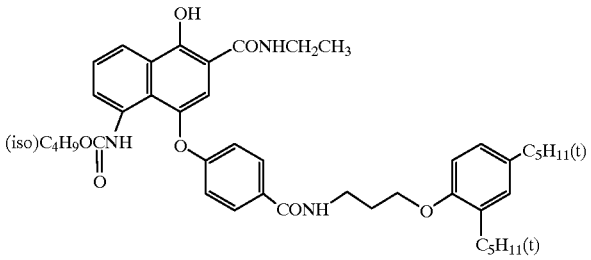
C-(18)
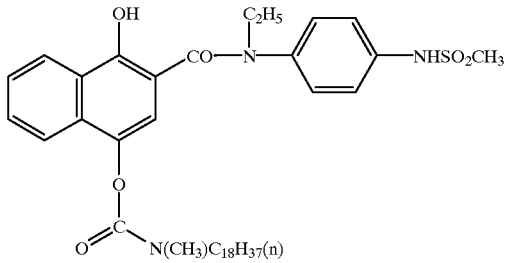
C-(19)
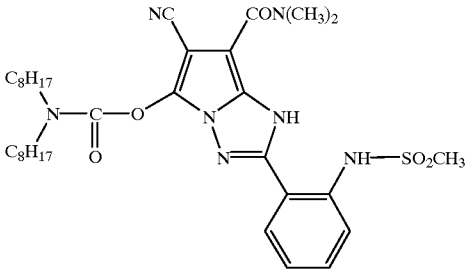
C-(20)
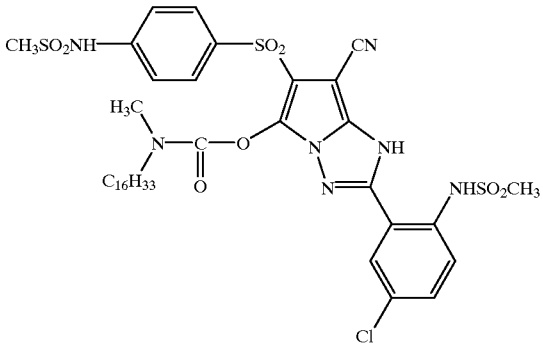
C-(21)
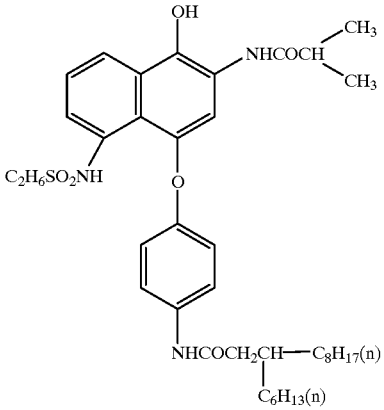
C-(22)
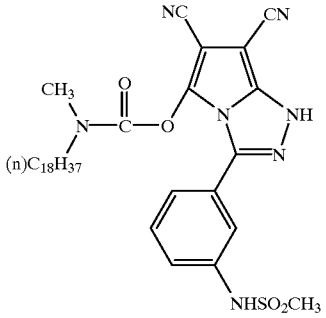
C-(23)
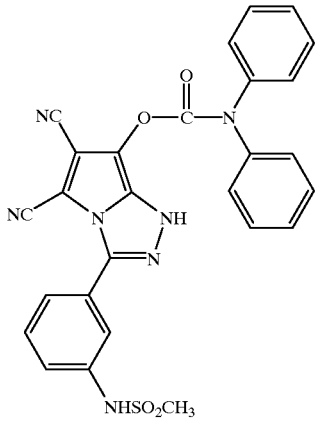

-continued

C-(24)

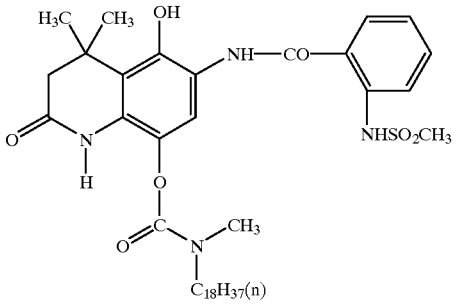

C-(25)

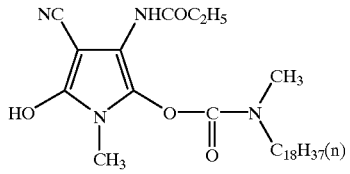

C-(26)

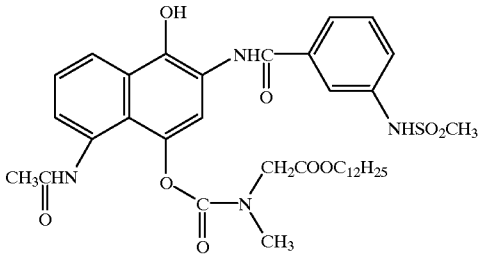

C-(27)

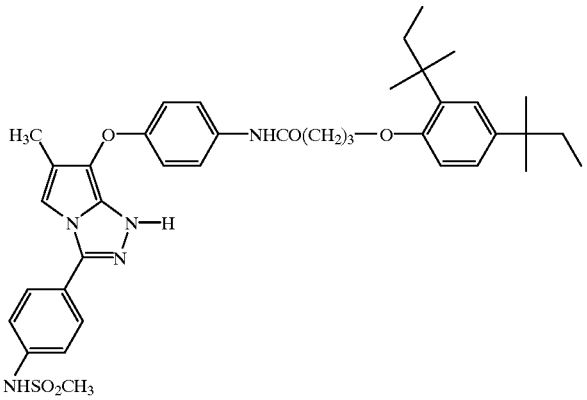

C-(28)

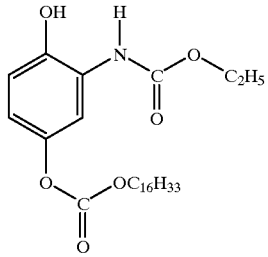

C-(29)

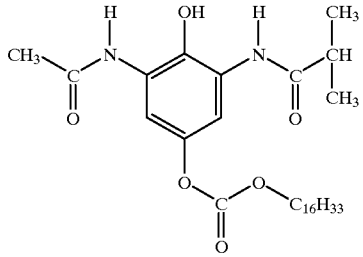

C-(30)

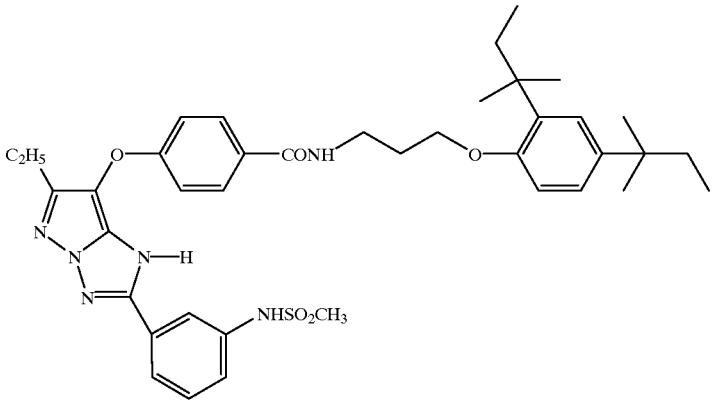

The couplers may be employed as a combination of two or more thereof.

The amount of the coupler used in the present invention may change depending on a molar absorption coefficient (ε) of a dye formed therefrom. In order to obtain an image density of 1.0 or more in terms of a reflection density, however, a coating amount of the coupler is suitably from about 0.001 to about 100 mmol/$m^2$, preferably from about 0.01 to about 10 mmol/$m^2$, and more preferably from about 0.05 to about 5.0 mmol/$m^2$, in case of using the coupler which forms a dye having a molar absorption coefficient (ε) of from about 5,000 to about 500,000.

The amount of the color developing agent used in the present invention is suitably from 0.01 to 100 times, preferably from 1 to 10 times, and more preferably from 0.2 to 5 times, of the coupler used in terms of a molar ratio.

Now, the water-soluble compound represented by formula (II) which can be used in the image forming method of the present invention will be described in more detail below. The compound is effective for preventing from color fading of the dye in a dye fixing material.

In formula (II), specific examples of the aliphatic group represented by X include an alkyl group having not more than 20 carbon atoms, preferably not more than 10 carbon atoms, which may be substituted (e.g., methyl, ethyl, or 2-methanesulfonamidoethyl) and an alkenyl group having not more than 20 carbon atoms, preferably not more than 10 carbon atoms, which may be substituted (e.g., allyl, or vinyl). Specific examples of the acyl group include an acyl group having not more than 20 carbon atoms, preferably not more than 10 carbon atoms, which may be substituted (e.g., acetyl, or phenoxyacetyl). Specific examples of the aliphatic oxy group include an alkoxy group having not more than 20 carbon atoms, preferably not more than 10 carbon atoms, which may be substituted (e.g., methoxy, isobutoxy, 2-ethylhexyloxy, or dodecyloxy) and an alkenoxy group having not more than 20 carbon atoms, preferably not more than 10 carbon atoms, which may be substituted (e.g., vinyloxy, or allyloxy). Specific examples of the aliphatic oxycarbonyl group include an alkoxycarbonyl group having not more than 20 carbon atoms, preferably not more than 10 carbon atoms, which may be substituted (e.g., methoxycarbonyl, phenoxyethoxycarbonyl, or dodecyloxycarbonyl) and an alkenoxycarbonyl group having not more than 20 carbon atoms, preferably not more than 10 carbon atoms, which may be substituted (e.g., allyloxycarbonyl). Specific examples of the aryloxycarbonyl group include an aryloxycarbonyl group having not more than 20 carbon atoms, preferably not more than 10 carbon atoms, which may be substituted (e.g., phenoxycarbonyl, 4-methoxyphenoxycarbonyl, or 3-chlorophenoxycarbonyl).

The substituent represented by $Y_1$ or $Y_2$ includes a group capable of being substituted on the nitrogen atom, for example, an aliphatic group, an aryl group, a heterocyclic group, an acyl group, an aliphatic oxycarbonyl group, an aryloxycarbonyl group, a heterocyclic oxycarbonyl group, a carbamoyl group, a sulfamoylcarbamoyl group, a an aliphatic sulfonyl group, an arylsulfonyl group, a heterocyclic sulfonyl group, a sulfamoyl group, a phosphoryl group and a phosphonyl group. Specific examples of the 5-membered or 6-membered ring formed by $Y_1$ and $Y_2$ together with the nitrogen atom include a morpholine ring and a pyrrolidine ring. $Z_1$ represents a simple bond, a methylene group which may be substituted with a substituent (for example, an alkyl group) or an ethylene group which may be substituted with a substituent (for example, an alkyl group). $Z_2$ represents a methylene group which may be substituted with a substituent (for example, an alkyl group).

$R_1$, $R_2$, $R_3$ and $R_4$, which may be the same or different, each represents an aliphatic group (for example, an alkyl group having not more than 10 carbon atoms, preferably not more than 4 carbon atoms, which may be substituted, such as methyl, ethyl, or propyl). Alternatively, $R_1$ and $R_2$ and $R_3$ and $R_4$ each may be combined with each other to form a 5-membered or 6-membered ring (for example a cyclohexane ring).

When the group in formula (II) contains an aliphatic moiety, the aliphatic moiety may be straight chain, branched chain or cyclic, saturated or unsaturated, or unsubstituted or substituted, and includes an alkyl moiety, an alkenyl moiety, a cycloalkyl moiety and a cycloalkenyl moiety. When the group in formula (II) contains an aryl moiety, the aryl moiety may be a monocyclic or condensed ring, or unsubstituted or substituted. When the group in formula (II) contains a heterocyclic moiety, the heterocyclic moiety contains at least one hetero atom (for example, a nitrogen atom, a sulfur atom, or an oxygen atom) in the ring thereof and may be saturated or unsaturated, a monocyclic or condensed ring, or unsubstituted or substituted.

The substituent in formula (II) includes any substituting group, for example, an aliphatic group, an aryl group, a heterocyclic group, an acyl group, an acyloxy group, an acylamino group, an aliphatic oxy group, an aryloxy group, a heterocyclic oxy group, an aliphatic oxycarbonyl group, an aryloxycarbonyl group, a heterocyclic oxycarbonyl group, a carbamoyl group, an aliphatic sulfonyl group, an arylsolfonyl group, a heterocyclic sulfonyl group, an aliphatic sulfonyloxy group, an arylsolfonyloxy group, a heterocyclic sulfonyloxy group, a sulfamoyl group, aliphatic sulfonamido group, an arylsolfonamido group, a heterocyclic sulfonamido group, an aliphatic amino group, an arylamino group, a heterocyclic amino group, an aliphatic oxycarbonylamino group, an aryloxycarbonylamino group, a heterocyclic oxycarbonylamino group, an aliphatic sulfinyl group, an arylsulfinyl group, an aliphatic thio group, an arylthio group, a hydroxy group, a cyano group, a sulfo group, a carboxy group, an aliphatic oxyamino group, aryloxyamino group, a carbamoylamino group, a sulfamoylamino group, a halogen atom, a sulfamoylcarbamoyl group, a carbamoylsulfamoyl group, a di-aliphatic oxyphosphinyl group, and a diaryloxyphosphinyl group.

In view of the effects of the present invention, X is preferably a hydrogen atom, a hydroxy group, an aliphatic group or an aliphatic oxy group, more preferably a hydrogen atom or an aliphatic group, and still more preferably a hydrogen atom. In view of the effects of the present invention, one of $Y_1$ and $Y_2$ is preferably a hydrogen atom. More preferably, $Y_1$ is a hydrogen atom and $Y_2$ is an acyl group, an aliphatic oxycarbonyl group, an aryloxycarbonyl group, a carbamoyl group, a sulfamoylcarbamoyl group, an aliphatic sulfonyl group, an arylsulfonyl group, a sulfamoyl group, a phosphoryl group or a phophonyl group, and still more preferably Y1 is a hydrogen atom and Y2 is an acyl group, an aliphatic oxycarbonyl group, a carbamoyl group, an aliphatic sulfonyl group, a sulfamoyl group, a phosphoryl group or a phosphonyl group. In view of the effects of the present invention, it is preferred that $Z_1$ and $Z_2$ each represents a simple bond or a methylene group and the ring formed together with $Z_1$ and $Z_2$ is a 5-membered or 6-membered ring. More preferably, $Z_1$ and $Z_2$ each represents an unsubstituted methylene group and the ring formed together with $Z_1$ and $Z_2$ is a 6-membered ring. In view of the effects of the present invention, it is particularly preferred that each of $R_1$, $R_2$, $R_3$ and $R_4$ is a methyl group.

The compound represented by formula (II) must be water-soluble. With respect to a criterion of the term "water-soluble" used herein, the compound which is soluble in an aqueous 50 wt % methanol solution in an amount of at least about 20 wt % is preferred, the compound which is soluble in an aqueous 50 wt % methanol solution in an amount of at least 50 wt % is more preferred, and the compound which is soluble in an aqueous 20 wt % methanol solution in an amount of at least about 50 wt % is still more preferred. In view of the effects of the present invention, when $Y_1$ and $Y_2$ includes an aliphatic moiety, it is preferred that a number of carbon atoms included in one hydrocarbon portion of the aliphatic moiety is not more than 4, and if the total number of carbon atoms included in the aliphatic moiety is more than 4, the aliphatic moiety comprises a linking group containing a hetero atom so as to divide the aliphatic moiety into hydrocarbon portions each having not more than 4 carbon atoms. In view of the effects of the present invention, it is more preferred that the total number of carbon atoms included in the aliphatic moiety in the group represented by $Y_1$ and $Y_2$ is not more than 4.

Of the compounds represented by formula (II), those represented by formula (II-1) or (II-2) shown below are preferred in view of the effects of the present invention.

(II-1)

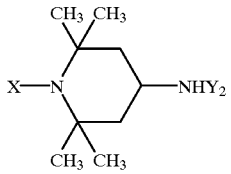

(II-2)

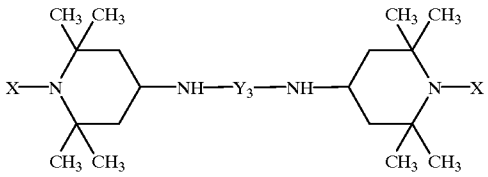

wherein X and $Y_2$ each has the same meaning as defined in formula (II); and $Y_3$ represents a simple bond or a divalent group.

The divalent group represented by $Y_3$ includes a sulfonyl group, a carbonyl group, a phosphoryl group, a phosphonyl group, a divalent acyl group which may have a substituent and preferably has the total number of carbon atoms of not more than 10, more preferably not more than 4 (for example, oxalyl, malonyl, succinyl, glutaryl, adipoyl, diglycolyl, or —$CO(CH_2CH_2O)_{1-3}CH_2CH_2CO$—) and a divalent sulfonyl group which may have a substituent and preferably has the total number of carbon atoms of not more than 10, more preferably not more than 4 (for example, 1,2-ethanedisulfonyl).

In the compound represented by formula (II-1) or (II-2), when $Y_2$ or $Y_3$ includes an aliphatic moiety, it is preferred that a number of carbon atoms included in one hydrocarbon portion of the aliphatic moiety is not more than 4, and if the total number of carbon atoms included in the aliphatic moiety is more than 4, the aliphatic moiety comprises a linking group containing a hetero atom so as to divide the aliphatic moiety into hydrocarbon portions each having not more than 4 carbon atoms. In view of the effects of the present invention, it is more preferred that the total number of carbon atoms included in the aliphatic moiety in the group represented by $Y_2$ or $Y_3$ is not more than 4.

In formula (II-1) or (II-2), a case wherein X is a hydrogen atom and $Y_2$ is an acyl group, an alkylsulfonyl group, a phosphoryl group or a phophonyl group, or a case wherein X is a hydrogen atom and $Y_3$ is a divalent acyl group, a divalent phosphoryl group or a divalent phosphonyl group is preferred, and a case wherein X is a hydrogen atom and $Y_2$ is an alkylsulfonyl group, or a case wherein X is a hydrogen atom and $Y_3$ is a divalent acyl group is more preferred in view of the effects of the present invention. in view of the effects of the present invention, compounds represented by formula (II-2) are particularly preferred. In such cases, when $Y_2$ or $Y_3$ includes an aliphatic moiety, it is preferred that a number of carbon atoms included in one hydrocarbon portion of the aliphatic moiety is not more than 4, and if the total number of carbon atoms included in the aliphatic moiety is more than 4, the aliphatic moiety comprises a linking group containing a hetero atom so as to divide the aliphatic moiety into hydrocarbon portions each having not more than 4 carbon atoms. It is more preferred that the total number of carbon atoms included in the aliphatic moiety represented by $Y_2$ or $Y_3$ is not more than 4.

Specific examples of the compound represented by formula (II) are set forth below, but the present invention should not be construed as being limited thereto.

Formula II-1

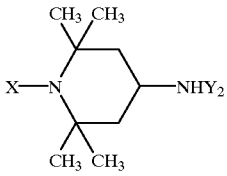

TABLE 1

| No. | X | $Y_2$ |
|---|---|---|
| a-1 | H | H |
| a-2 | H | 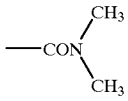 |
| a-3 | H | —$CONHC_3H_7$(n) |
| a-4 | H | —$CONHC_2H_5$ |
| a-5 | H | 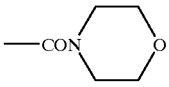 |
| a-6 | H | 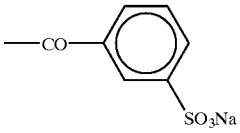 |
| a-7 | H | —$COCH_2OH$ |
| a-8 | H | —$COCH_2OCOCH_2$ |
| a-9 | H | —$COCH_2$ |
| a-10 | H | —$SO_2CH_2$ |
| a-11 | H | —$COCH_2OCH_2$ |
| a-12 | H | —$COOCH_2$ |
| a-13 | H | —$COC_2H_5$ |
| a-14 | H | —$SO_2NHC_2H_5$ |
| a-15 | H | 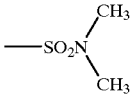 |
| a-16 | —OH | —$COCH_3$ |
| a-17 | —$OC_8H_{17}$(n) | —$SO_2CH_3$ |
| a-18 | —$OCH_3$ | —$SO_2CH_3$ |
| a-19 | —$COCH_3$ | —$COCH_3$ |
| a-20 | —$COOCH_3$ | —$COOCH_3$ |
| a-21 | 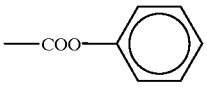 | 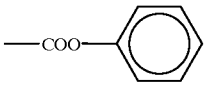 |
| a-22 | —$CH_3$ | —$COOC_2H_6$ |
| a-23 | —$C_2H_5$ | —$COCH_2OH$ |

TABLE 1-continued

| No. | X | $Y_2$ |
|---|---|---|
| a-24 | —$CH_3$ | —P(=O)—($OC_2H_5$)$_2$ |
| a-25 | —OH | —$NHSO_2CH_3$ |
| a-26 | H | —$SO_2C_2H_5$ |
| a-27 | H | —$SO_2C_4H_9$(n) |
| a-28 | H | —$SO_2$—$C_6H_5$ |
| a-29 | H | —$SO_2$—$C_6H_4$—$NHSO_2CH_3$ |
| a-30 | H | —$CONHC_3H_7$(i) |

TABLE 2

| No. | X | $Y_2$ |
|---|---|---|
| a-31 | H | —$CONHC_4H_9$(n) |
| a-32 | H | —CONH—$C_6H_5$ |
| a-33 | H | —CONH—$C_6H_{11}$ |
| a-34 | H | —P(=O)—($OC_2H_5$)$_2$ |
| a-35 | H | —P(=O)—($OCH_3$)$_2$ |
| a-36 | H | —$SO_2CH_2OH$ |
| a-37 | H | —$SO_3CH_2Cl$ |
| a-38 | H | —$C_4H_9$—$SO_3Na$ |
| a-39 | —$CH_3$ | —CON—$C_5H_9$O |
| a-40 | —$C_4H_9$(n) | —CON—$C_5H_9$O |
| a-41 | —H | —$CH_3$ |
| a-42 | H | —$C_6H_4$—$NHCOCH_3$ |

TABLE 2-continued

| No. | X | $Y_2$ |
|---|---|---|
| a-43 | H | —$CONHSO_2N(CH_3)_2$ |
| a-44 | H | —$C_5H_4N$ |
| a-45 | H | —P(=O)($CH_3$)($OCH_3$) |
| a-46 | H | —$SO_2$—$C_6H_4$—OH |
| a-47 | H | —$SO_2CH_2OCH_3$ |
| a-48 | H | —$COCH_2CH_2OH$ |
| a-49 | H | —CON($C_2H_4OH$)H |
| a-50 | H | —CON($C_2H_4OH$)$_2$ |

Formula II-2

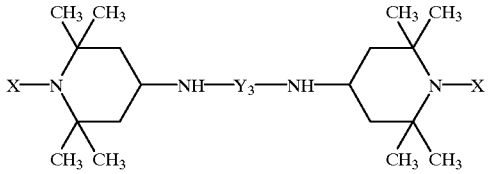

TABLE 3

| No. | X | $Y_3$ |
|---|---|---|
| a-51 | H | —C(=O)—C(=O)— |
| a-52 | H | —C(=O)$CH_2CH_2$C(=O)— |
| a-53 | H | —C(=O)$CH_2OCH_2$C(=O)— |
| a-54 | H | —C(=O)$CH_2CH_2CH_2$C(=O)— |

TABLE 3-continued
| No. | X | $Y_3$ |
|---|---|---|
| a-55 | H | —CCH$_2$CH$_2$CH$_2$CH$_2$C— (O, O) |
| a-56 | H | —C—(CH$_2$)$_8$—C— (O, O) |
| a-57 | H | —CCH═CHC— (Trans) (O, O) |
| a-58 | H | —CCH═CHC— (Cis) (O, O) |
| a-59 | H | —CNH—(CH$_2$)—NHC— (O, O) |
| a-60 | H | 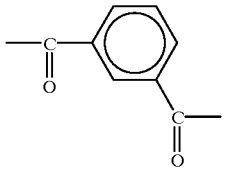 |
TABLE 3-continued
| No. | X | $Y_3$ |
|---|---|---|
| a-61 | H | 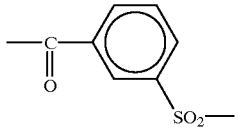 |
| a-62 | H | 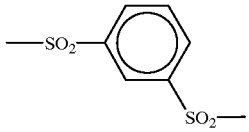 |
| a-63 | H | 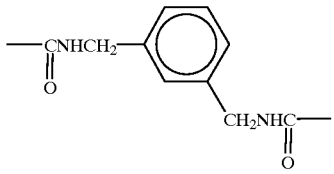 |
| No. | X | $Y_3$ |
|---|---|---|
| a-64 | H | 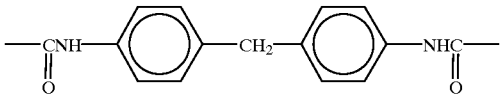 |
| a-65 | H | 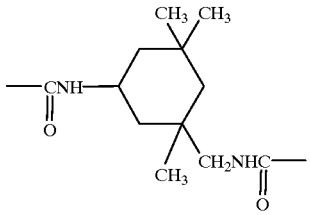 |
| a-66 | H | 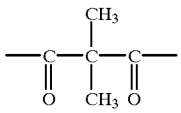 |
| a-67 | H | —SO$_2$CH$_2$CH$_2$—SO$_2$— |
| a-68 | H | 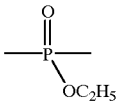 |
| a-69 | H | 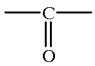 |

-continued
| No. | X | $Y_3$ |
|---|---|---|
| a-70 | H | 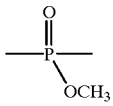 |
| a-71 | H | 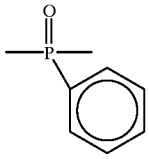 |
| a-72 | H | 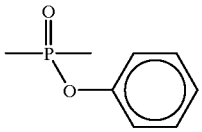 |
| a-73 | H | 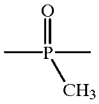 |
| a-74 | $CH_3$ | 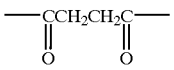 |
| a-75 | $CH_3$ | 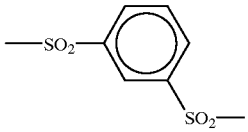 |
| No. | X | $Y_2$ |
|---|---|---|
| a-76 | $CH_3$ | $—SO_2CH_2CH_2SO_2—$ |
| a-77 | $CH_3$ | 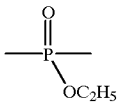 |
| a-78 | $CH_3$ | 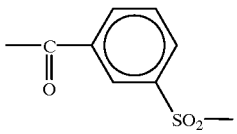 |
| a-79 | H | 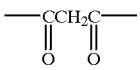 |
| a-80 | $CH_3$ | $—SO_2—$ |
| a-81 | $—COCH_3$ | 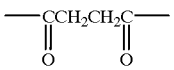 |
(a-82)
-continued
| No. | X | $Y_2$ |
|---|---|---|
| | | 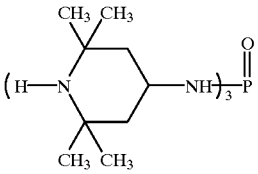 |
(a-83)
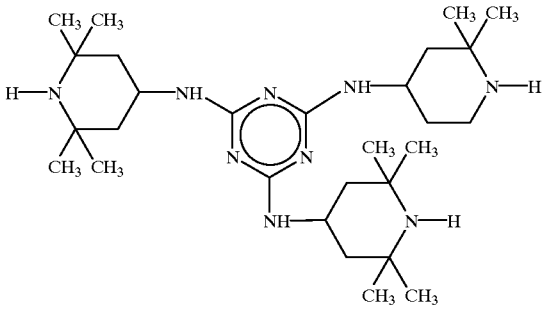
(a-84)

-continued
| No. | X | $Y_2$ |
|---|---|---|
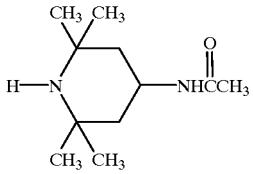
(a-85)
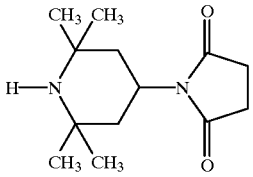
(a-86)
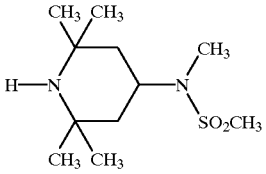
(a-87)
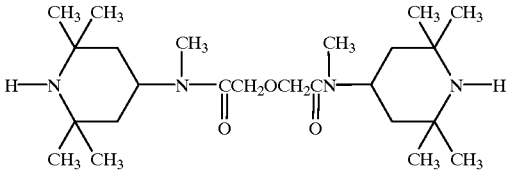
(a-88)
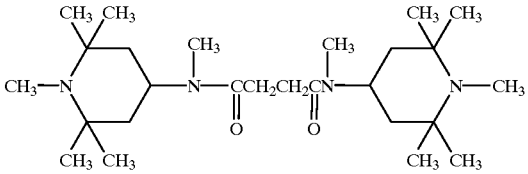
(a-89)
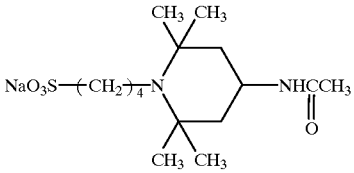
(a-90)
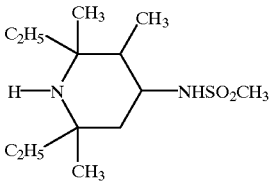
(a-91)
-continued
| No. | X | $Y_2$ |
|---|---|---|
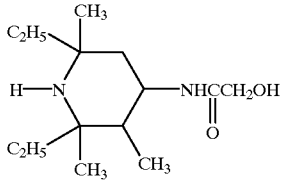
(a-92)
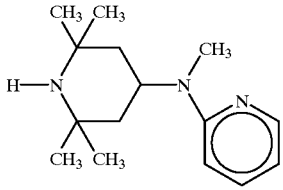
(a-93)
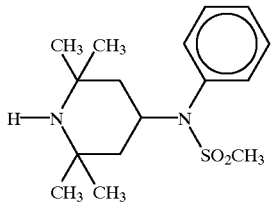
(a-94)
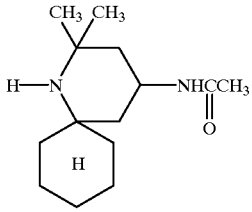
(a-95)
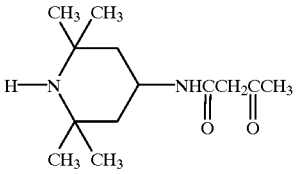
(a-96)
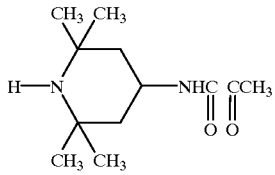
(a-97)

-continued

| No. | X | $Y_2$ |
|---|---|---|
| | 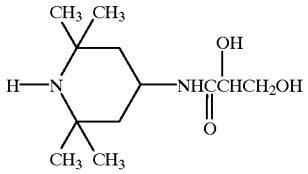 | |

A synthesis method of the compound represented by formula (II) according to the present invention is specifically described below. Other compounds can be synthesized in a manner similar to the synthesis example.

SYNTHESIS EXAMPLE

Synthesis of Compound (a-53)

In 130 ml of dimethylformamide was dissolved 46.8 g (0.300 mol) of 4-amino-2,2,6,6-tetramethylpiperidine, and to the solution, 25 g (0.146 mol) of diglycolyl chloride was added dropwise under stirring at 8° C. over a period of 20 minutes. The temperature was controlled under 20° C. with an ice bath. After the completion of the addition, the mixture was stirred at 20° C. for 30 minutes and then 400 ml of acetonitrile was added thereto. The crystals deposited were collected by filtration and washed by pouring 100 ml of acetonitrile. Yield: 75 g.

The crystals obtained were added to 300 ml of methanol containing 16 g of potassium hydroxide dissolved therein at 25° C. under stirring. Methanol was distilled off under a reduced pressure, and the residue was dissolved in 300 ml of chloroform (crystals of potassium chloride were not soluble therein) and dried with magnesium sulfate. After removing the magnesium sulfate by filtration, the chloroform was distilled off, and the residue was dissolved in 300 ml of acetonitrile by heating and cooled. The crystals deposited were collected by filtration, washed by pouring 100 ml of cold acetonitrile and dried. Yield: 38.8 g (63%). Melting point: 122 to 124° C.

The compound represented by formula (II) may be incorporated into the light-sensitive material and/or dye fixing material before development processing or applied to the dye fixing material (color imaging element) by coating or spraying a solution containing the compound represented by formula (II) during or after development processing.

When the compound represented by formula (II) is incorporated into the light-sensitive material and/or dye fixing material, a method of dissolving the compound in water and adding to a coating solution or a method of dissolving the compound in an organic solvent or a solvent mixture of the organic solvent and water and adding to a coating solution as long as the separation does not occur when added to the coating solution. Also, the compound can be added to a coating solution by dissolving the compound in an acid or a base. Further, the compound can be added to a coating solution by being included in a clathrate compound.

In order to provide the compound before, during or after the formation of a color diffusion transfer image, a method of supplying a solution such as an aqueous solution, a mixed solution of an organic solvent and water, an acid solution, or an alkali solution, of the compound using a bar coater, immersion, spray, or the like can be employed.

The compounds of formula (II) according to the present invention may be employed individually or in a combination of two or more thereof. The total amount of the compound according to the present invention to be added is adjusted so that the amount of the compound present in the dye fixing material after the formation of final image is preferably not less than 0.1 mmol/$m^2$, more preferably in a range of from 2 mmol/$m^2$ to 20 mmol/$m^2$.

The compound of formula (II) can be used in combination with other color fading preventing agents. Also, other methods for preventing color fading, for example, incorporation of an ultraviolet absorber, laminating the surface of color imaging element or the like can be used in combination.

Now, techniques which are preferably employed together with the present invention will be described below.

A heat developable color photographic light-sensitive material used in the present invention fundamentally comprises a light-sensitive silver halide emulsion and a binder on a support, and if desired, an organic metal salt oxidizing agent and a dye providing compound (in some cases, a reducing agent serves therefor as described hereinafter) may be further contained.

These components are added to the same layer in many cases, however, these components may be dividedly added to separate layers. For example, when a colored dye providing compound is incorporated into a lower layer of the silver halide emulsion, reduction in sensitivity can be prevented. The reducing agent is preferably incorporated into the heat developable light-sensitive material. However, it may be supplied from the outside, for example, by a method in which it is allowed to diffuse from a dye fixing material as described below.

In order to obtain colors over a wide range within the chromaticity diagram using three primary colors of yellow, magenta and cyan, at least three silver halide emulsion layers having sensitivity in different spectral regions are used in combination. For example, a layer combination of a blue-sensitive layer, a green-sensitive layer and a red-sensitive layer, a layer combination of a green-sensitive layer, a red-sensitive layer and an infrared-sensitive layer, and a layer combination of a red-sensitive layer, an infrared-sensitive layer (1) and an infrared-sensitive layer (2) as described, for example, in JP-A-59-180550, JP-A-64-13546, JP-A-62-253159 and EP-A-479,167 may be used. The respective light-sensitive layers may be arranged in various arrangement orders known for conventional type color light-sensitive materials. Further, each of these light-sensitive layers may be divided into two or more layers, if desired, as described, for example, in JP-A-1-252954.

The heat developable light-sensitive material may have various light-insensitive layers such as a protective layer, a subbing layer, an interlayer, a yellow filter layer, or an antihalation layer between the silver halide emulsion layers described above, as the uppermost layer or as the lowermost layer. Further, the heat developable light-sensitive material may be provided with various supplementary layers such as a back layer on the opposite side of the support.

Specific examples thereof include a subbing layer as described in U.S. Patent 5,051,335, an interlayer having a solid pigment as described in JP-A-1-167838 and JP-A-61-20943, an interlayer having a reducing agent or a DIR compound as described in JP-A-1-120553, JP-A-5-34884 and JP-A-2-64634, an interlayer having an electron transfer agent as described in U.S. Pat. Nos. 5,017,454 and 5,139,919 and JP-A-2-235044, a protective layer having a reducing agent as described in JP-A-4-249245, and a layer comprising a combination of these layers.

The support is preferably designed to have an antistatic function and a surface resistivity of $10^{12}$ Ω·cm or less.

Now, a silver halide emulsion for use in the heat developable light-sensitive material of the present invention will be described in detail below.

The silver halide emulsion which can be used in the present invention may be any of silver chloride, silver bromide, silver iodobromide, silver chlorobromide, silver chloroiodide and silver chloroiodobromide.

The silver halide emulsion for use in the present invention may be either a surface latent image type emulsion or an internal latent image type emulsion. The internal latent image type emulsion is used as a direct reversal emulsion in combination with a nucleating agent or light fogging. Further, it may be a so-called core/shell emulsion in which the inside of grain different from the surface thereof in the phase, and silver halides different in composition may be joined by epitaxial junction. The silver halide emulsion may be either a monodispersed emulsion or polydispersed emulsion, and a method is preferably used in which monodispersed emulsions are mixed to adjust gradation as described in JP-A-1-167743 and JP-A-4-223463. The grain size is preferably 0.1 $\mu$m to 2 $\mu$m, and more preferably 0.2 $\mu$m to 1.5 $\mu$m.

Crystal habit of the silver halide grains may be any of a regular crystal form such as a cubic, an octahedral or a tetradecahedral form, an irregular crystal form such as a spherical form or a tabular form having a high aspect ratio, a form having a crystal defect such as a twin plane, and a combined form thereof.

Specifically, any of silver halide emulsions can be used which are prepared by methods described, for example, in U.S. Pat. No. 4,500,626, column 50, U.S. Pat. No. 4,628, 021, *Research Disclosure* (hereinafter abbreviated as "RD"), No. 17029 (1978), ibid., No. 17643, pages 22 and 23 (December, 1978), ibid., No. 18716, page 648 (November, 1979), ibid., No. 307105, pages 863–865 (November, 1989), JP-A-62-253159, JP-A-64-13546, JP-A-2-236546, JP-A-3-110555, P. Glafkides, *Chemie et Phisique Photographique* (Paul Montel, 1967), G. F. Duffin, *Photographic Emulsion Chemistry* (Focal Press, 1966) and V. L. Zelikman et al., *Making and Coatina Photoaraphic Emulsion* (Focal Press, 1964).

In the course of preparation of the light-sensitive silver halide emulsion of the present invention, a so-called desalting for removing excess salts is preferably conducted. As means for such a purpose, water washing with noodle may be used which is conducted by gelation of gelatin, and a flocculation method may also be used utilizing poly-valent anionic inorganic salts (for example, sodium sulfate), anionic surface active agents, anionic polymers (for example, polysodium styrenesulfonate) or gelatin derivatives (for example, aliphatic acylated gelatin, aromatic acylated gelatin and aromatic carbamoylated gelatin). The flocculation method is preferably used.

For various purposes, the light-sensitive silver halide emulsion used in the present invention may contain a compound of a heavy metal such as iridium, rhodium, platinum, cadmium, zinc, thallium, lead, iron and osmium. These compounds may be used individually or as a combination of two or more thereof. The amount thereof added is ordinarily from about $10^{-9}$ to about $10^{-3}$ mol per mol of silver halide, although it depends on the purpose of use. They may be uniformly added to grains or localized in the insides or surfaces of grains. Specifically, emulsions described, for example, in JP-A-2-236542, JP-A-1-116637 and JP-A-5-181246 are preferably used.

In the grain formation stage of the light-sensitive silver halide emulsion of the present invention, a rhodanide, ammonia, a 4-substituted thioether compound, an organic thioether derivative described in JP-B-47-11386 or a sulfur-containing compound described in JP-A-53-144319 can be used as a solvent for silver halide.

For other conditions, reference can be made to the descriptions of P. Glafkides, *Chemie et Phisigue Photographique* (Paul Montel, 1967), G. F. Duffin, *Photographic Emulsion Chemistry* (Focal Press, 1966) and V. L. Zelikman et al., *Making and Coating Photographic Emulsion* (Focal Press, 1964) which are described above. Specifically, any of an acid process, a neutral process and an ammonia process may be used. A soluble silver salt and a soluble halogen salt may be reacted with each other by using any of a single jet process, a double jet process and a combination thereof. In order to obtain a monodispersed emulsion, the double jet process is preferably used.

A reverse mixing process in which grains are formed in the presence of excess silver ions can also be used. As one type of double jet process, a process of maintaining the pAg in a liquid phase constant in which a silver halide is formed, namely a so-called controlled double jet process, can also be used.

In order to accelerate growth of grains, the concentration, the amount and the rate of addition of a silver salt and a halogen salt may be increased (JP-A-55-142329, JP-A-55-158124 and U.S. Pat. No. 3,650,757).

A reaction solution may be stirred by any of known stirring methods. The temperature and the pH of the reaction solution during formation of silver halide grains may be appropriately established depending on the purpose. The pH range is preferably from 2.3 to 8.5, and more preferably from 2.5 to 7.5.

The light-sensitive silver halide emulsion is usually chemically sensitized. For chemical sensitization of the light-sensitive silver halide emulsion of the present invention, chalcogen sensitization such as sulfur sensitization, selenium sensitization or tellurium sensitization, noble metal sensitization using gold, platinum, palladium, etc., and reduction sensitization can be used alone or in combination (for example, JP-A-3-110555 and JP-A-5-241267). Such chemical sensitization can also be conducted in the presence of a nitrogen-containing heterocyclic compound (JP-A-62-253159). Further, an antifoggant described below can be added after the completion of the chemical sensitization. Specifically, methods described in JP-A-5-45833 and JP-A-62-40446 can be used.

The pH on the chemical sensitization is preferably from 5.3 to 10.5, and more preferably from 5.5 to 8.5, and the pAg is preferably from 6.0 to 10.5, and more preferably from 6.8 to 9.0.

The coated amount of the light-sensitive silver halide emulsion for use in the present invention is preferably from 1 mg/m$^2$ to 10 g/m$^2$, more preferably from 10 mg/M$^2$ to 10 g/m$^2$, in terms of silver.

In order to provide color sensitivity of green, red or infrared to the light-sensitive silver halide emulsion for use in the present invention, the light-sensitive silver halide emulsion is ordinarily spectrally sensitized with a methine dye or the like. Further, spectral sensitization of a blue region may be applied to a blue-sensitive emulsion, if desired.

The dyes used include cyanine dyes, merocyanine dyes, complex cyanine dyes, complex merocyanine dyes, holopolarcyanine dyes, hemicyanine dyes, styryl dyes and hemioxanol dyes.

Specifically, they include sensitizing dyes described, for example, in U.S. Pat. No. 4,617,257, JP-A-59-180550, JP-A-64-13546, JP-A-5-45828 and JP-A-5-45834.

These sensitizing dyes may be used individually or in combination. The combination of the sensitizing dyes is often used, particularly for supersensitization and wavelength adjustment of spectral sensitivity.

The emulsion may contain a dye having no spectral sensitization effect itself or a compound which does not substantially absorb visible light and exhibits supersensitization, in combination with the sensitizing dye (for example, those described, for example, in U.S. Pat. No. 3,615,641 and JP-A-63-23145).

The sensitizing dye may be added to the emulsion before, during or after chemical ripening or before or after nucleation of silver halide grains as described in U.S. Pat. Nos. 4,183,756 and 4,225,666. The sensitizing dye and supersensitizer may be added as a solution in an organic solvent such as methanol, a dispersion in gelatin or a solution in a surface active agent. The sensitizing dye is ordinarily added in an amount of from about $10^{-8}$ mol to about $10^{-2}$ mol per mol of silver halide.

Additives for use in such processes and known photographic additives which can be used in the heat developable light-sensitive material and the dye fixing material of the present invention are described in *RD*, No. 17643, ibid., No. 18716 and ibid., No. 307105 described above and corresponding portions thereof are summarized in the following table.

| Type of Additives | RD17643 | RD18716 | RD307105 |
|---|---|---|---|
| 1. Chemical Sensitizers | p. 23 | p. 648, right column | p. 866 |
| 2. Sensitivity Increasing Agents | | p 648, right column | |
| 3. Spectral Sensitizers, Supersensitizers | pp. 23–24 | p. 648, right column to p. 649, right column | pp. 866–868 |
| 4. Fluorescent, Brightening Agents | p. 24 | p. 648, right column | p. 868 |
| 5. Antifoggants, Stabilizers | pp. 24–25 | p. 649, right column | pp. 868–870 |
| 6. Light Absorbers, Filter Dyes, UV Absorbers | pp. 25–26 | p. 649, right column to p. 650, left column | p. 873 |
| 7. Dye Image Stabilizers | p. 25 | p. 650, left column | p. 872 |
| 8. Hardeners | p. 26 | p. 651, left column | pp. 874–875 |
| 9. Binders | p. 26 | p. 651, left column | pp. 873–874 |
| 10. Plasticizers, Lubricants | p. 27 | p. 650, right column | p. 876 |
| 11. Coating Aids, Surfactants | pp. 26–27 | p. 650 right column | pp. 875–876 |
| 12. Antistatic Agents | p. 27 | p. 650 right column | pp. 876–877 |
| 13. Matting Agents | | | pp. 878–879 |

As the binder for the layers constituting the heat developable light-sensitive material and the dye fixing material, a hydrophilic binder is preferably used. 5 Examples thereof include the binders described in Research Disclosures described above and JP-A-64-13546, pages 71 to 75. Specifically, a transparent or translucent hydrophilic binder is preferred, and examples thereof include a natural compound such as protein (for example, gelatin and a gelatin derivative) and a polysaccharide (for example, a cellulose derivative, starch, gum arabic, dextran and pullulan), and a synthetic polymer such as polyvinyl alcohol, polyvinylpyrrolidone and polyacrylamide. Further, examples of the binder which can be used also include a highly water-absorptive polymer as described, for example, in U.S. Pat. No. 4,960,681 and JP-A-62-245260, specifically, a homopolymer of vinyl monomer having —COOM or —$SO_3$M (wherein M represents a hydrogen atom or an alkali metal), or a copolymer of the vinyl monomers with each other or with other monomer (for example, sodium methacrylate, ammonium methacrylate and Sumikagel L-5H manufactured by Sumitomo Chemical Co., Ltd.). The binders can be used as a combination of two or more thereof. In particular, a combination of gelatin and the above-mentioned binder is preferred. Gelatin is selected from lime-treated gelatin, acid-treated gelatin, so-called delimed gelatin reduced in a content of calcium and the like, depending on various purposes, and they are also preferably used in combination.

When the system of supplying a trace amount of water to conduct heat development is employed, use of the above-mentioned highly water-absorptive,polymer makes it possible to rapidly absorb water. When the highly water-absorptive polymer is used in the dye fixing layer or the protective layer therefor, retransfer of the dye from the dye fixing material to the others after transfer is prevented.

In the present invention, the amount of binder coated is preferably from 0.2 g/$m^2$ to 20 g/$m^2$, more preferably from 0.2 g/$m^2$ to 10 g/$m^2$, and yet more preferably from 0.5 g/$m^2$ to 7 g/$m^2$.

In the present invention, an organic metal salt can also be used as an oxidizing agent in combination with the light-sensitive silver halide emulsion. Of these organic metal salts, an organic silver salt is particularly preferably used.

An organic compound which can be used for formation of the above-described organic silver salt oxidizing agent includes a benzotriazole compound, a fatty acid and other compounds as described, for example, in U.S. Pat. No. 4,500,626, columns 52 and 53. Silver acetylide described in U.S. Pat. No. 4,775,613 is also useful. The organic silver salts may be used as a combination of two or more thereof.

The organic silver salt described above can be used in combination with the light-sensitive silver halide in an amount of from 0.01 mol to 10 mol, preferably from 0.01 mol to 1 mol, per mol of light-sensitive silver halide. The total coated amount of light-sensitive silver halide emulsion and organic silver salt is ordinarily from 0.05 g/$m^2$ to 10 g/$m^2$, preferably from 0.1 g/$m^2$ to 4 g/$m^2$, in terms of silver.

In the present invention, a reducing agent other than the compound according to the present invention may be used. Reducing agents known in the field of heat developable light-sensitive material can be used. Further, the reducing agent also includes a reductive dye providing compound described below (in this case, it can also be used in combination with other reducing agent). Furthermore, a precursor of reducing agent can also be used which itself has no reductive ability, but exhibits reductive ability by action of a nucleophilic reagent or heat during the course of development.

Examples of the reducing agent for use in the present invention include reducing agents and precursors of reducing agents described, for example, in U.S. Pat. No. 4,500,626, columns 49 and 50, U.S. Pat. Nos. 4,839,272, 4,330,617, 4,590,152, 5,017,454 and 5,139,919, JP-A-60-140335, pages 17 and 18, JP-A-57-40245, JP-A-56-138736, JP-A-59-178458, JP-A-59-53831, JP-A-59-182449, JP-A-59-182450, JP-A-60-119555, JP-A-60-128436, JP-A-60-128439, JP-A-60-198540, JP-A-60-181742, JP-A-61-259253, JP-A-62-201434, JP-A-62-244044, JP-A-62-

131253, JP-A-62-131256, JP-A-63-10151, JP-A-64-13546, pages 40 to 57, JP-A-1-120553, JP-A-2-32338, JP-A-2-35451, JP-A-2-234158, JP-A-3-160443 and EP-A-220,746, pages 78 to 96.

Combinations of various reducing agents as disclosed in U.S. Pat. No. 3,039,869 can also be used.

When a diffusion-resistant reducing agent is used, an electron transfer agent and/or precursor thereof can be used in combination to enhance electron transfer between the diffusion-resistant reducing agent and developable silver halide, if necessary. It is particularly preferred to use those described in U.S. Pat. No. 5,139,919 described above, EP-A-418,743, JP-A-1-138556 and JP-A-3-102345. Further, methods for stably introducing them into a layer as described in JP-A-2-230143 and JP-A-2-235044 are preferably used.

The electron transfer agent or the precursor thereof can be selected from the reducing agents or the precursors thereof described above. It is desirable that the electron transfer agent or the precursor thereof is higher in their mobility than the diffusion-resistant reducing agent (electron donor).

The diffusion-resistant reducing agent (electron donor) for use in combination with the electron transfer agent may be any of the above-described reducing agents, as long as they do not substantially move in the layer of the light-sensitive material. Preferred examples thereof include hydroquinones, sulfonamidophenols, sulfonamidonaphthols, compounds described in JP-A-53-110827, U.S. Pat. Nos. 5,032,487, 5,026,634 and 4,839,272 as electron donors, and diffusion-resistant reductive dye providing compounds.

Further, a precursor of electron donor as described in JP-A-3-160443 is also preferably used.

Furthermore, for various purposes such as prevention of color mixing, improvement in color reproduction, improvement in white ground and prevention of silver transfer to a dye fixing material, the above-described reducing agent can be used in an intermediate layer or a protective layer. Specifically, reducing agents described in EP-A-524,649, EP-A-357,040, JP-A-4-249245, JP-A-2-64633, JP-A-2-46450 and JP-A-63-186240 are preferably used. Reductive compounds releasing development inhibitors as described in JP-B-3-63733, JP-A-1-150135, JP-A-2-110557, JP-A-2-64634, JP-A-3-43735 and EP-A-451,833 are also used.

In the present invention, the amount of the reducing agent added is preferably from 0.01 mol to 20 mol, and more preferably from 0.1 mol to 10 mol, per mol of silver.

A hydrophobic additive such as the dye providing compound or the diffusion-resistant reducing agent can be incorporated into a layer of the heat developable light-sensitive material by a known method as described, for example, in U.S. Pat. No. 2,322,027. In such a case, an organic solvent having a high boiling point as described, for example, in U.S. Pat. Nos. 4,555,470, 4,536,466, 4,536,467, 4,587,206, 4,555,476 and 4,599,296 and JP-B-3-62256 can be used optionally in combination with a low boiling organic solvent having a boiling point of 50° C. to 160° C. The dye providing compounds, diffusion-resistant reducing agents and high boiling organic solvents can be used as a combination of two or more thereof.

The amount of the high boiling organic solvent is ordinarily 10 g or less, preferably 5 g or less, and more preferably from 0.1 g to 1 g, per gram of the dye providing compound to be used. Further, it is 1 ml or less, preferably 0.5 ml or less, and more preferably 0.3 ml or less, per gram of binder.

A dispersing method using a polymer as described in JP-B-51-39853 and JP-A-51-59943, and a method of addition as a fine particle dispersion as described in JP-A-62-30242 can also be used.

If the additive is a compound which is substantially insoluble in water, it may be dispersed in the binder as fine particles, in addition to the above-described methods.

When the hydrophobic compound is dispersed in a hydrophilic colloid, various surface active agents can be used. For example, surface active agents as described in JP-A-59-157636, pages 37 and 38 and Research Disclosures described above can be used.

A compound for activating development and simultaneously stabilizing images can be used in the heat developable light-sensitive material of the present invention. Preferred examples of the compound are specifically described in U.S. Pat. No. 4,500,626, columns 51 and 52.

In the process for forming images by diffusion transfer of dyes, various compounds can be added to the layers constituting the heat developable light-sensitive material according to the present invention for the purpose of fixing or decoloring unnecessary dyes or colored products to improve white ground of the images obtained.

Specifically, compounds described in EP-A-353,741, EP-A-461,416, JP-A-63-163345 and JP-A-62-203158 can be used.

Various pigments and dyes can be used in the layers constituting the heat developable light-sensitive material according to the present invention for the purpose of improving color separation or increasing sensitivity.

Specifically, compounds described in Research Disclosures described above, and compounds and layer constitution described, for example, in EP-A-479,167, EP-A-502,508, JP-A-1-167838, JP-A-4-343355, JP-A-2-168252, JP-A-61-20943, EP-A-479,167 and EP-A-502,508 can be used.

In the process for forming images by diffusion transfer of dyes, a dye fixing material is used together with the heat developable light-sensitive material. The dye fixing material is separately provided on a support different from that for the light-sensitive material, or provided on the support for the light-sensitive material. With respect to the mutual relation between the light-sensitive material and the dye fixing material, the relation to support and the relation to a white ground reflection layer, the relations described in U.S. Pat. No. 4,500,626, column 57 can also be applied to the present invention.

The dye fixing material preferably used in the present invention has at least one layer containing a mordant and a binder. As the mordants, those known in the field of photography can be used. Examples thereof include mordants described in U.S. Pat. No. 4,500,626, columns 58 and 59, JP-A-61-88256, pages 32 to 41, JP-A-1-161236, pages 4 to 7, U.S. Pat. Nos. 4,774,162, 4,619,883 and 4,594,308. Dye receptive polymer compounds as described in U.S. Pat. No. 4,463,079 may also be used.

In the dye fixing material for use in the present invention, the above-described hydrophilic binder is preferably used. Further, a carrageenan compound as described in EP-A-443,529 and a latex having a glass transition temperature of 40 °C. or less as described in JP-B-3-74820 are preferably used in combination.

The dye fixing material can be provided with a supplemental layer such as a protective layer, a stripping layer, an undercoat layer, an intermediate layer, a back layer and an anti-curling layer, if desired. In particular, it is useful to provide the dye fixing material with a protective layer.

In the layers constituting the heat developable light-sensitive material and the dye fixing material, a high boiling organic solvent can be used as a plasticizer, a slipping agent or an agent for improving separation of the light-sensitive material from the dye fixing material. Examples thereof include solvents described, for example, in Research Disclosures described above and JP-A-62-245253.

Further, various silicone oils (all silicone oils including dimethylsilicone oils and modified silicone oils in which various organic groups are introduced into dimethylsiloxanes) can be used for the above-described purposes. Suitable examples thereof include various modified silicone oils described in *Modified Silicone Oils*, Technical Data P6-18B, published by Shin-Etsu Silicone Co., Ltd., particularly carboxy-modified silicone (trade name: X-22-3710).

Furthermore, silicone oils described in JP-A-62-215953 and JP-A-63-46449 are also effectively employed.

A fluorescent brightening agent may be used in the heat developable light-sensitive material and the dye fixing material. In particular, it is preferred that the fluorescent brightening agent is incorporated into the dye fixing material or supplied from the outside such as the heat developable light-sensitive material or a transfer solvent. Examples thereof include compounds described, for example, in *The Chemistry of Synthetic Dyes*, edited by K. Veenkataraman, vol. V, chapter 8 and JP-A-61-143752. More specifically, they include stilbene compounds, coumarin compounds, biphenyl compounds, benzoxazolyl compounds, naphthalimide compounds, pyrazoline compounds and carbostyryl compounds.

The fluorescent brightening agent can be used in combination with a color-fading preventing agent or an ultraviolet absorber.

Specific examples of the color-fading preventing agents, ultraviolet absorbers and fluorescent brightening agents are described in JP-A-62-215272, pages 125 to 137, and JP-A-1-161236, pages 17 to 43.

A hardener which can be used in layers constituting the heat developable color light-sensitive material and the dye fixing material includes hardeners described in Research Disclosures described above, U.S. Pat. No. 4,678,739, column 41 and U.S. Pat. No. 4,791,042, JP-A-59-116655, JP-A-62-245261, JP-A-61-18942 and JP-A-4-218044. More specifically, examples thereof include aldehyde hardeners (such as formaldehyde), aziridine hardeners, epoxy hardeners, vinylsulfone hardeners (such as N,N'-ethylenebis (vinylsulfonylacetamido)ethane), N-methylol hardeners (dimethylolurea) and polymer hardeners (compounds described, for example, in JP-A-62-234157).

The hardener is used in an amount of 0.001 g to 1 g, preferably 0.005 g to 0.5 g, per g of gelatin coated, and may be added to any of the layers constituting the light-sensitive material and the dye fixing material. Further, it may be dividedly added to two or more layers.

In the layers constituting the heat developable light-sensitive material and the dye fixing material, various antifoggants, photographic stabilizers and precursors thereof can be used. Specific examples thereof include azoles and azaindenes described in RD, 17643 (1978), pages 24 to 25, carboxylic acids and phosphoric acids each containing a nitrogen atom described in JP-A-59-168442, mercapto compounds and salts thereof described in JP-A-59-111636, and acetylene compounds described in JP-A-62-87957. When the precursor is employed in the present invention, it is particularly preferred to use in the light-sensitive silver halide emulsion layer. However, it is used in the dye fixing material.

These compounds are used preferably in an amount of $5\times10^{-6}$ mol to $1\times10^{-1}$ mol per mol of silver, and more preferably in an amount of $1\times10^{-5}$ mol to $1\times10^{-2}$ mol per mol of silver.

In the layers constituting the heat developable light-sensitive material and the dye fixing material, various surfactants can be used for the purpose of aiding coating, improving stripping, improving slipping, preventing electric charge or accelerating development. Examples of the surfactants are described, for example, in Research Disclosures described above, JP-A-62-173463 and JP-A-62-183457.

The layers constituting the heat developable light-sensitive material and the dye fixing material may contain an organic fluoro compound for improving slipping, preventing electric charge and improving stripping. Typical examples of the organic fluoro compounds include fluorine surfactants described, for example, in JP-B-57-9053, columns 8 to 17, JP-A-61-20944 and JP-A-62-135826, and hydrophobic fluorine compounds such as oily fluorine compounds (for example, fluorine oil) and solid fluorine compounds (for example, an ethylene tetrafluoride resin)

In the heat developable light-sensitive material and the dye fixing material, a matting agent can be used for the purpose of preventing adhesion and improving slipping. The matting agents include compounds such as benzoguanamine resin beads, polycarbonate resin beads and ABS resin beads as described in JP-A-63-274944 and JP-A-63-274952, as well as compounds such as silicon dioxide, polyolefins and polymethacrylates described in JP-A-61-88256, page 29. In addition, compounds described in Research Disclosures described above can be used. The matting agent may be added not only to the uppermost layer (protective layer) but also to under layer(s), if desired.

In addition, the layers constituting. the heat developable light-sensitive material and the dye fixing material may contain a heat solvent, a defoaming agent, a sterilizer, an antifungal agent and colloidal silica. Examples of these additives are described, for example, in JP-A-61-88256, pages 26 to 32, JP-A-3-11338 and JP-B-2-51496.

In the present invention, an image formation accelerating agent can be used in the heat developable light-sensitive material and/or the dye fixing material. The image formation accelerating, agent has functions such as acceleration of a redox reaction of the silver salt oxidizing agent with the reducing agent, acceleration of a reaction such as the formation of a dye from the dye providing compound, the degradation of dye or the release of a diffusible dye and acceleration of movement of dye from the heat developable light-sensitive material to the dye fixing material, and can be classified into a base or base precursor, a nucleophilic compound, a high boiling organic solvent (oil), a heat solvent, a surfactant, a compound having interaction with silver or silver ion, according to the physicochemical function. However, these groups of substances generally have combined functions, and therefore, they have usually a combination of some of the above-described acceleration effects. The details thereof are described in U.S. Pat. No. 4,678,739, columns 38 to 40.

The base precursor includes a salt of organic acid and base which are decarboxylated by heat, and a compound releasing an amine by the intramolecular nucleophilic substitution reaction, the Lossen rearrangement or the Beckmann rearrangement. Specific examples thereof are described, for example, in U.S. Pat. Nos. 4,514,493 and 4,657,848.

In a system in which heat development and dye transfer are concurrently performed in the presence of a small amount of water, it is preferred from the view point of the enhancement of preservability of the heat developable light-sensitive material that the base and/or the base precursor are incorporated into the dye fixing material.

In addition, a combination of a hardly soluble metal compound and a compound (referred to as a "complex-formable compound") which can form a complex with the metal ion constituting the hardly soluble metal compound as described in EP-A-210,660 and U.S. Pat. No. 4,740,445, and a compound generating a base by electrolysis as described in JP-A-61-232451 can also be used as the base precursor. In particular, the former is effective. It is advantageous that the hardly soluble metal compound and the complex-formable compound are separately added such that one is incorporated into the heat developable light-sensitive material and the other into the dye fixing material as described in the above-described patents.

In the present invention, in the heat developable light-sensitive material and/or the dye fixing material, various development stoppers can be used for stably obtaining constant images against fluctuations in processing temperature and processing time at development.

The development stopper as used herein is a compound which, after appropriate development, rapidly neutralizes or reacts with a base to reduce the concentration of the base contained in a film, to thereby stop development, or a compound which interacts with silver and a silver salt to inhibit development. Examples thereof include an acid precursor which releases an acid by heating, an electrophilic compound which conducts a replacement reaction with a coexisting base by heating, a nitrogen-containing heterocyclic compound, a mercapto compound and precursor thereof. More specifically, they are described in JP-A-62-253159, pages 31 and 32.

In the present invention, a support which can endure processing temperature is used as a support of the heat developable light-sensitive material or the dye fixing material. In general, the support includes supports for photography such as paper and synthetic polymers (films) described in *Shashin Kohgaku no Kiso* (*Gin-en Shashin*) (The Fundamentals of Photographic Engineering (Silver Salt Photograph), pages 223 to 240 (1979), Corona Publishing Co. Ltd. Specifically, the support used includes films of polyethylene terephthalate, polyethylene naphthalate, polycarbonate, polyvinyl chloride, polystyrene, polypropylene, polyimide, or cellulose derivative (for example, cellulose triacetate), films thereof containing a pigment such as titanium oxide, synthetic paper produced from polypropylene or the like by a film method, mixed paper produced from pulp of a synthetic resin such as polyethylene and natural pulp, Yankee paper, baryta paper, coated paper (particularly, cast-coated paper), a metal, cloth and glass.

They can be used alone or as a support laminated with a synthetic polymer such as polyethylene on one side or both sides. The laminate layers can contain a pigment such as titanium oxide, ultramarine and carbon black, or a dye, if desired.

In addition, supports described in JP-A-62-253159, pages 29 to 31, JP-A-1-161236, pages 14 to 17, JP-A-63-316848, JP-A-2-22651, JP-A-3-56955 and U.S. Pat. No. 5,001,033 can be used.

A back surface of the support may be coated with a hydrophilic binder and a semiconductive metal oxide such as an alumina sol and tin oxide, or with an antistatic agent such as carbon black. Specifically, supports described in JP-A-63-220246 can be used. Preferably, a surface of the support is subjected to various treatment or undercoating for the purpose of improving adhesion to the hydrophilic binder.

A method for exposing the heat developable light-sensitive material to record an image include, for example, a method of directly taking a landscape photograph or a portrait by use of a camera, a method of exposing the light-sensitive material through a reversal film or negative film by use of a printer or enlarger, a method of subjecting an original to scanning exposure through a slit y use of an exposing device of copying machine, a method of allowing a light emitting diode or various lasers (such as laser diode and gas laser) to emit light by image information through electric signals to subject the light-sensitive material to scanning exposure ( as described in JP-A-2-129625, JP-A-5-176114, JP-A-5-199372, JP-A-6-127021), and a method of supplying image information to a image display such as CRT, a liquid crystal display, an electroluminescence display and a plasma display to expose the light-sensitive material directly or through an optical system.

As described above, light sources and exposing methods described in U.S. Pat. No. 4,500,626, column 56, JP-A-2-53378 and JP-A-2-54672, such as natural light, a tungsten lamp, a light emitting diode, a laser beam source and a CRT light source, can be used to record an image on the heat developable light-sensitive material.

Further, the image exposure can also be carried out using a wavelength converting element in which a non-linear optical material is combined with a coherent light source such as a laser beam. The non-linear optical material is a material which can express non-linearity between an electrical field and polarization appearing when a strong optical electrical field such as a laser beam is applied. Examples of such material preferably used include an inorganic compound represented by lithium niobate, potassium dihydrogenphosphate (KDP), lithium iodate and $BaB_2O_4$, a urea derivative, a nitroaniline derivative, a nitropyridine-N-oxide derivative such as 3-methyl-4-nitropyridine-N-oxide (POM), and compounds described in JP-A-61-53462 and JP-A-62-210432. As the form of the wavelength converting element, a single crystal optical waveguide type element and a fiber type element are known, and both are useful.

Furthermore, image signals obtained from a video camera or electronic still camera, television signal represented by the Nippon Television Signal Code (NTSC), image signals obtained by dividing an original into plural pixels with a scanner and image signals produced by use of a computer represented by CG and CAD can be utilized as the image information.

The heat developable light-sensitive material and/or the dye fixing material may have a conductive exothermic layer as heating means for heat development or diffusion transfer of dyes. In this case, exothermic elements described, for example, in JP-A-61-145544 can be utilized.

Although the heating temperature in the heat development stage is from about 50° C. to about 250° C., it is particularly useful to conduct heat development at a heating temperature of about 60° C. to about 180° C. Diffusion transfer of dyes may be carried out either concurrently with the heat development or after the termination of the heat development. In the latter case, the transfer can be achieved at a temperature ranging from room temperature to the temperature in the heat development stage, more preferably at a temperature ranging from 50° C. to a temperature about 10° C. lower than the temperature in the heat development stage.

The movement of dyes takes place even only by heat. However, a solvent may be used for accelerating the movement of dyes. As described in U.S. Pat. Nos. 4,704,345 and 4,740,445 and JP-A-61-238056, it is also useful to carry out heating in the presence of a small amount of solvent (particularly, water) to conduct development and transfer at the same time or continuously. In this system, the heating temperature is preferably from 50° C. to the boiling point of the solvent. For example, when the solvent is water, the heating temperature is desirably from 50° C. to 100° C.

Examples of the solvent used for acceleration of development and/or diffusion transfer of dyes include water, a basic aqueous solution containing an inorganic alkali metal salt or organic base (the base described for the image formation accelerating agent is used as the base), a low boiling solvent, and a mixed solution of a low boiling solvent and water or the above-described basic aqueous solution. Furthermore, surfactants, antifoggants, complex-formable compounds with hardly soluble metal salts, antifungal agents and sterilizers may be contained in the solvent.

Water is preferably used as the solvent used in the heat development stage and the diffusion transfer stage. Any water may be used as long as it is ordinarily employed. Specifically, distilled water, tap water, well water or mineral water can be used. In heat developing equipment in which the heat developable light-sensitive material and the dye fixing material are processed, water may be used in the disposable form, or repeatedly circulated. The latter case results in use of water containing components eluted from the light-sensitive material. Further, equipment and water described in JP-A-63-144354, JP-A-63-144355, JP-A-62-38460 and JP-A-3-210555 may be used.

The solvent can be provided to either or both the heat developable light-sensitive material and the dye fixing material. The amount thereof used may be the weight of solvent corresponding to the maximum swollen volume of the whole coated layers or less.

For example, methods described in JP-A-62-253159, page 5, JP-A-63-85544 and Japanese Patent Application No. 8 -181045 (JP-A-10-26818) are preferably used for applying the water. Further, a solvent enclosed in microcapsules or a hydrate can also be previously contained in either or both the heat developable light-sensitive material and the dye fixing material.

The temperature of water to be applied may be from 30° C. to 60° C. as described in JP-A-63-85544. In particular, in order to prevent bacteria in water from propagation, it is useful to keep the temperature of water at 45° C. or more.

In order to accelerate the movement of dyes, a hydrophilic heat solvent which is solid at ordinary temperature and soluble at high temperature can also be contained in the heat developable light-sensitive material and/or the dye fixing material. The hydrophilic heat solvent may be contained in any of the light-sensitive silver halide emulsion layer, the intermediate layer, the protective layer and the dye fixing layer. However, it is preferred to be contained in the dye fixing layer and/or adjacent layer thereto.

Examples of the hydrophilic heat solvent include urea derivatives, pyridine derivatives, amides, sulfonamides, imides, alcohols, oximes and other heterocyclic compounds.

Heating method in the development and/or transfer stage includes a method of bringing the light-sensitive material and the dye fixing material into contact with a heated block, a heated plate, a hot presser, a heat roll, a heat drum, a halogen lamp heater, an infrared or far infrared lamp heater, and a method of passing them through an atmosphere of high temperature.

As the method for superposing the heat developable light-sensitive material on the dye fixing material, methods described in JP-A-62-253159 and JP-A-61-147244, page 27 can be applied.

Any of various heat development devices can be used for processing the photographic material of the present invention. For example, devices described in JP-A-59-75247, JP-A-59-177547, JP-A-59-181353, JP-A-60-18951, JP-A-U-62-25994 (the term "JP-A-U" as used herein means an "unexamined published Japanese utility model application"), and JP-A-6-130509, JP-A-6-95338 and JP-A-6-95267 are preferably used. As commercially available devices, Pictrostat 100, Pictrostat 200, Pictrography 3000 and Pictrography 2000 manufactured by Fuji Photo Film Co., Ltd. are also preferably used.

The heat developable light-sensitive material and the dye fixing material each may be supplied either in the roll form or in the sheet form. It is also possible to supply one in the roll form and the other in the sheet form.

According to the present invention, color photographs excellent in color image density and image fastness are obtained.

The present invention will be described in greater detail with reference to the following examples, but the present invention should not be construed as being limited thereto.

EXAMPLE 1

Dye Fixing Material R101 having the constitution shown in Tables 6 and 7 was prepared.

TABLE 6

Constitution of Dye Fixing Material R101

| Layer Number | Additive | Amount Coated ($mg/m^2$) |
|---|---|---|
| Sixth Layer | Water-Soluble Polymer (1) | 130 |
| | Water-Soluble Polymer (2) | 35 |
| | Water-Soluble Polymer (3) | 45 |
| | Potassium Nitrate | 20 |
| | Anionic Surfactant (1) | 6 |
| | Anionic Surfactant (2) | 6 |
| | Amphoteric Surfactant (1) | 50 |
| | Stain Inhibitor (1) | 7 |
| | Stain Inhibitor (2) | 12 |
| | Matting Agent (1) | 7 |
| Fifth Layer | Gelatin | 250 |
| | Water-Soluble Polymer (1) | 25 |
| | Anionic Surfactant (3) | 9 |
| | Hardener (1) | 185 |
| Fourth Layer | Mordant (1) | 1850 |
| | Water-Soluble Polymer (2) | 260 |
| | Water-Soluble Polymer (4) | 1400 |
| | Latex Dispersion (1) | 600 |
| | Anionic Surfactant (3) | 25 |
| | Nonionic Surfactant (1) | 18 |
| | Gurnidine Picolinate | 2550 |
| | Sodium Quinolinate | 350 |
| Third Layer | Gelatin | 370 |
| | Mordant (1) | 300 |
| | Anionic Surfactant (3) | 12 |
| Second Layer | Gelatin | 700 |
| | Mordant (1) | 290 |
| | Water-Soluble Polymer (1) | 55 |
| | Water-Soluble Polymer (2) | 330 |
| | Anionic Surfactant (3) | 30 |

TABLE 6-continued

Constitution of Dye Fixing Material R101

| Layer Number | Additive | Amount Coated ($mg/m^2$) |
|---|---|---|
| | Anionic Surfactant (4) | 7 |
| | High Boiling Solvent (1) | 700 |
| | Fluorescent Brightening Agent (1) | 30 |
| | Stain Inhibitor (3) | 32 |
| | Guanidine Picolinate | 360 |
| | Potassium Quinolinate | 45 |
| First Layer | Gelatin | 280 |
| | Water-Soluble Polymer (1) | 12 |
| | Anionic Surfactant (1) | 14 |
| | Sodium Metaborate | 35 |
| | Hardener (1) | 185 |
| Support (1): | Paper Support Laminated with Polyethylene (thickness: 215 $\mu$m) | |

The amount of latex dispersion (1) coated is the amount of solid components of the latex coated.

TABLE 7

Support (1)

| Layer Name | Composition | Layer Thickness ($\mu$m) |
|---|---|---|
| Surface Undercoat Layer | Gelatin | 0.1 |
| Surface PE Layer (glossy) | Low-Density Polyethylene (density: 0.923): 90.2 parts Surface-Treated Titanium Oxide: 9.8 parts Ultramarine: 0.001 part | 36.0 |
| Pulp Layer | Woodfree Paper (LBKP/NBSP = 6/4, density: 1.053) | 152.0 |
| Back PE Layer (matte) | High-Density Polyethylene (density: 0.955) | 27.0 |
| Back Undercoat | Styrene/Acrylate Copolymer | 0.1 |
| Layer | Colloidal Silica Polysodium Styrenesulfonate | |
| | | 215.2 |

Anionic Surfactant (1):

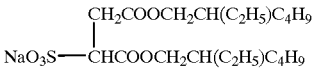

Anionic Surfactant (2):

Anionic Surfactant (3):

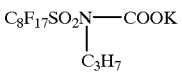

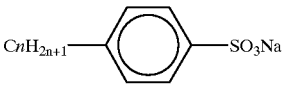

$n = 12.6$

Anionic Surfactant (4):

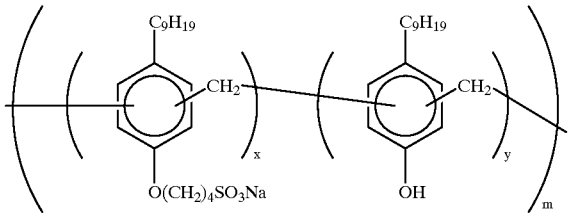

$x:y = 4:6$
$m = 6.8$

Nonionic Surfactant (1):

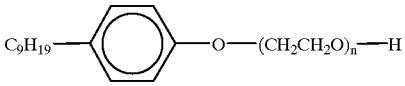

$n = 85$

Amphoteric Surfactant (1):

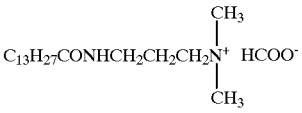

Fluorescent Brightening Agent (1):

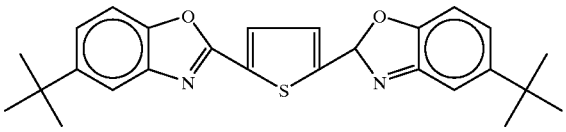

Mordant (1):

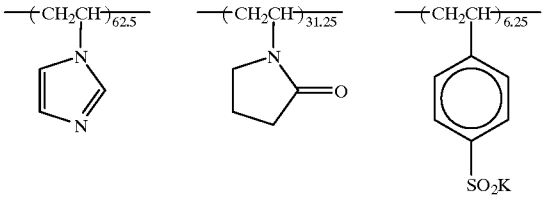

Stain Inhibitor (1)
Stain Inhibitor (2)
Stain Inhibitor (3)

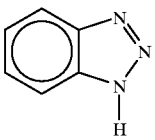

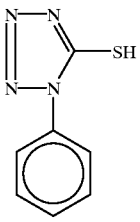

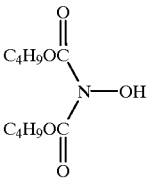

High Boiling Solvent (1):
$C_{26}H_{4.89}Cl_{7.1}$
(Empara 40, manufactured by Ajinomoto Co., Ltd.)

Water-Soluble Polymer (1):
Sumikagel L5-H
(manufactured by Sumitomo Chemical Co., Ltd.)
Water-Soluble Polymer (2):
Dextran (molecular weight: 70,000)
Water-Soluble Polymer (3):
Copper carageenan (manufactured by Taito Co., Ltd.)
Water-Soluble Polymer (4):
MP Polymer MP-102 (manufactured by Kuraray Co., Ltd.)
Latex Dispersion (1):
LX-438 (manufactured by Nippon Zeon Co., Ltd.)
Matting Agent (1):
SYLOID 79
(manufactured by Fuji Devison Kagaku Co., Ltd.)
Matting Agent (2):
PMMA grains (mean grain size: 4 μm)
Hardener (1):

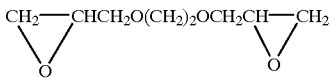

Another dye fixing material was prepared in the same manner as in Dye Fixing Material R101, except for adding each 5 mmol/$m^2$ of the compound represented by formula (II) according to the present invention shown in Table 20 below to the second layer and the third layer of Dye Fixing Material R101.

Now, a method for the preparation of a light-sensitive material is described below.

Preparation of light-sensitive silver halide emulsions is described below.

Light-Sensitive Silver Halide Emulsion (1) (for Red-Sensitive Emulsion Layer)

To a well stirred aqueous solution having the composition shown in Table 8 below, Solution (I) shown in Table 9 below was added at a constant flow rate over a period of 9 minutes and Solution (II) was added at a constant flow rate starting from 10 seconds before the addition of Solution (I) over a period of 9 minutes and 10 seconds. After 36 minutes, Solution (III) shown in Table 9 was added at a constant flow rate over a period of 24 minutes and Solution (IV) was added simultaneously with Solution (III) at a constant flow rate over a period of 25 minutes.

The mixture was washed with water and desalted (performed using Flocculant (a) shown below at a pH of 4.0) according to a conventional method, 880 g of a lime-processed ossein gelatin was added, the pH was adjusted to 6.0, 12.8 g of a decomposed product of ribonucleic acid and 32 mg of trimethylthiourea were added thereto, optimal chemical sensitization was conducted at 60° C. for 71 minutes, and after adding in sequence 2.6 g of 4-hydroxy-6-methyl-1,3,3a,7-tetraazaindene, 3.2 g of Dye (a) shown below, 5.1 g of KBr and 2.6 g of a stabilizer described below, the mixture was cooled. As a result, 28.1 kg of a monodispersed cubic silver chlorobromide emulsion having an average grain size of 0.35 μm was obtained.

TABLE 8

| Composition | |
|---|---|
| $H_2O$ | 26,300 ml |
| Lime-processed gelatin | 800 g |
| KBr | 12 g |

TABLE 8-continued

| Composition | |
|---|---|
| NaCl | 80 g |
| Compound (a) | 1.2 g |
| Temperature | 53° C. |

TABLE 9

| | Solution (I) | Solution (II) | Solution (III) | Solution (IV) |
|---|---|---|---|---|
| $AgNO_3$ | 1,200 g | none | 2,800 g | none |
| KBr | none | 546 g | none | 1,766 g |
| NaCl | none | 144 g | none | 96 g |
| $K_2IrCl_6$ | none | 3.6 mg | none | none |
| Total | Water to make 6.5 λ | Water to make 6.5 λ | Water to make 10 λ | Water to make 10 λ |

Compound (a):

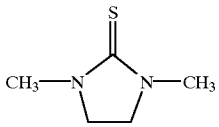

Dye (a):

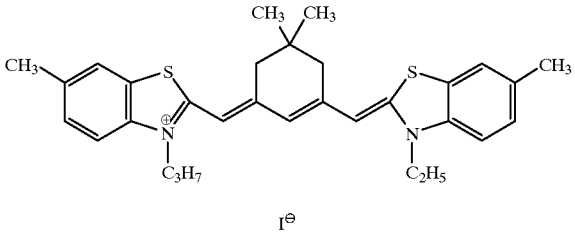

Flocculant (a):

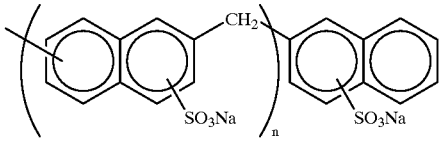

$n = 1\sim5$

Light-Sensitive Silver Halide Emulsion (2) (For Green-Sensitive Emulsion layer)

To a well stirred aqueous solution having the composition shown in Table 10 below, Solution (I) and Solution (II) shown in Table 11 below were added simultaneously at a constant flow rate over a period of 9 minutes. After 5 minutes, Solution (III) and Solution (IV) shown in Table 11 below were further added simultaneously at a constant flow rate over a period of 32 minutes. After the completion of the addition of Solution (III) and Solution (IV), 60 ml of a methanol solution of dyes (containing 360 mg of Dye (bl) shown below and 73.4 mg of Dye (b2) shown below) was added collectively.

The mixture was washed with water and desalted (performed using Flocculant (a) at a pH of 4.0) according to a conventional method, 22 g of a lime-processed ossein gelatin was added, the pH and the pAg were adjusted to 6.0 and 7.6, respectively, 1.8 mg of sodium thiosulfate and 180 mg of 4-hydroxy-6-methyl-1,3,3a,7-tetraazaindene were added thereto, optimal chemical sensitization was conducted at 60° C., and after adding 90 mg of Antifoggant (1) shown below, the mixture was cooled. As a result, 635 g of a monodispersed cubic silver chlorobromide emulsion having an average grain size of 0.30 μm was obtained.

TABLE 10

| Composition | |
|---|---|
| $H_2O$ | 600 ml |
| Lime-processed gelatin | 20 g |
| KBr | 0.3 g |
| NaCl | 2 g |
| Compound (a) | 0.03 g |
| Sulfuric acid (1N) | 16 ml |
| Temperature | 46° C. |

TABLE 11

| | Solution (I) | Solution (II) | Solution (III) | Solution (IV) |
|---|---|---|---|---|
| $AgNO_3$ | 10.0 g | none | 90.0 g | none |
| KBr | none | 3.50 g | none | 57.1 g |
| NaCl | none | 1.72 g | none | 3.13 g |
| $K_2IrCl_6$ | none | none | none | 0.03 mg |
| Total | Water to make 126 ml | Water to make 131 ml | Water to make 280 ml | Water to make 289 ml |

Dye (b1):

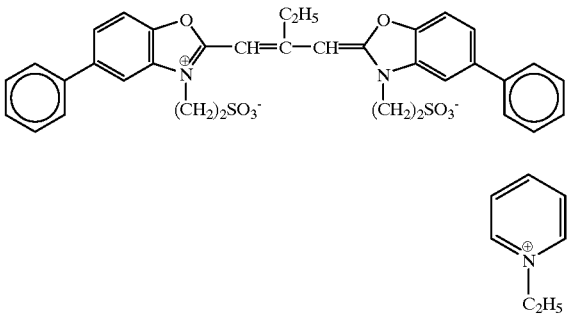

Dye (b2):

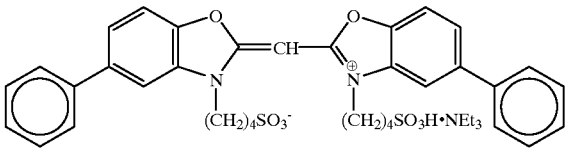

Antifoggant (1):

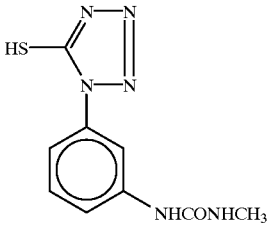

Light-Sensitive Silver Halide Emulsion (3) (for Blue-Sensitive Emulsion Layer)

To a well stirred aqueous solution having the composition shown in Table 12 below, Solution (I) and Solution (II) each having the composition shown in Table 13 below were added such that Solution (I) was added 10 seconds after the initiation of the addition of Solution (II) and each solution was added over a period of 30 minutes. Two minutes after the completion of the addition of Solution (I), Solution (V) was added, 5 minutes after the completion of the addition of Solution (II), Solution (IV) was added, and 10 seconds after then, Solution (III) was added. Solution (III) was added over a period of 27 minutes and 50 seconds and Solution (IV) was added over a period of 28 minutes.

Thereafter, the mixture was washed with water and desalted (conducted using Flocculant (b) shown below at a pH of 3.9) according to a conventional method, 1,230 g of a lime-processed ossein gelatin and 2.8 mg of Compound (b) were added thereto and the pH and the pAg were adjusted to 6.1 and 8.4, respectively. Then, 24.9 mg of sodium thiosulfate was added thereto, optimal chemical sensitization was performed at 60° C. and after adding 13.1 g of Dye (c) shown below and 118 ml of Compound (c) in sequence, the mixture was cooled. The silver halide grains of the thus-obtained emulsion were potato-shaped grains, the grain size thereof was 0.53 μm, and the yield was 30,700 g.

TABLE 12

| Composition | |
|---|---|
| $H_2O$ | 29,200 ml |
| Lime-processed gelatin | 1,582 g |
| KBr | 127 g |
| Compound (a) | 0.66 g |
| Temperature | 72° C. |

TABLE 13

| | Solution (I) | Solution (II) | Solution (III) | Solution (IV) | Solution (V) |
|---|---|---|---|---|---|
| $AgNO_3$ | 939 g | none | 3,461 g | none | none |
| KBr | none | 572 g | none | 2,464 g | none |
| KI | none | none | none | none | 22 g |
| Total | Water to make 6,690 mλ | Water to make 6,680 mλ | Water to make 9,700 mλ | Water to make 9,740 mλ | Water to make 4,400 mλ |

Flocculant (b):

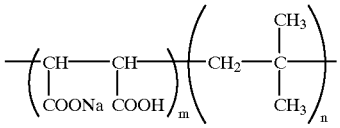

$m + n = 1$

Dye (c):

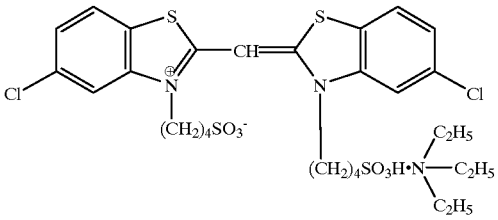

Compound (b):
Compound (c):

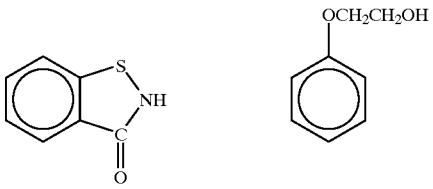

A preparation method of a gelatin dispersion of each hydrophobic additive is described below.

A gelatin dispersion of each of a yellow coupler, magenta coupler and cyan coupler and a developing agent was prepared according to the formulation shown in Table 14 below. More specifically, each of the oil phase component was dissolved under heating at about 70° C. to form a uniform solution, the aqueous phase component heated at about 60° C. was added to the solution, and the components were mixed under stirring and then dispersed in a homogenizer for 10 minutes at 10,000 rpm. Water was added thereto and the mixture was stirred to obtain a homogenous dispersion.

TABLE 14

| | Composition of Dispersion | | |
|---|---|---|---|
| | Yellow | Magenta | Cyan |
| Oil phase | | | |
| Cyan Coupler C-28 | none | none | 7.0 g |
| Magenta Coupler C-28 | none | 7.0 g | none |
| Yellow Coupler C-30 | 7.0 g | none | none |
| Developing Agent R-31 | none | none | 5.6 g |
| Developing Agent R-34 | none | 5.6 g | none |
| Developing Agent R-34 | 5.6 g | none | none |
| Antifoggant (5) | 0.25 g | none | none |
| Antifoggant (2) | none | 0.25 g | 0.25 g |
| High Boiling Solvent (4) | 7.4 g | 7.4 g | 7.4 g |
| Ethyl acetate | 15 ml | 15 ml | 15 ml |
| Aqueous phase | | | |
| Lime-processed gelatin | 10.0 g | 10.0 g | 10.0 g |
| Potassium nitrate | 0.1 g | 0.1 g | 0.1 g |

TABLE 14-continued

| | Composition of Dispersion | | |
|---|---|---|---|
| | Yellow | Magenta | Cyan |
| Surfactant (1) | 0.7 g | 0.7 g | 0.7 g |
| Water | 110 ml | 110 ml | 110 ml |
| Water added | 110 ml | 110 ml | 110 ml |
| Antiseptic (1) | 0.04 g | 0.04 g | 0.04 g |

A gelatin dispersion of Antifoggant (4) and Reducing Agent (1) was prepared according to the formulation shown in Table 14 below. More specifically, the oil phase component was dissolved under heating at about 60° C., the aqueous phase component heated at about 60° C. was added to the solution, and the components were mixed under stirring and then dispersed in a homogenizer for 10 minutes at 10,000 rpm to obtain a homogenous dispersion.

TABLE 15

| Composition of Dispersion | |
|---|---|
| Oil phase | |
| Antifoggant (4) | 0.16 g |
| Reducing Agent (1) | 1.3 g |
| High Boiling Solvent (2) | 2.3 g |
| High Boiling Solvent (5) | 0.2 g |
| Surfactant (1) | 0.5 g |
| Surfactant (4) | 0.5 g |
| Ethyl acetate | 10.0 ml |
| Aqueous phase | |
| Acid processed gelatin | 10.0 g |
| Antiseptic (1) | 0.004 g |
| Calcium nitrate | 0.1 g |
| Water | 35.0 ml |
| Water Added | 104.4 ml |

A dispersion of Polymer Latex (a) was prepared according to the formulation shown in Table 16 below. Specifically, Surfactant (6) was added to a mixed solution containing Polymer Latex (a), Surfactant (5) and water, as shown in Table 16, over a period of 10 minutes with stirring to obtain a homogeneous dispersion. The resulting dispersion was subjected to repetition of dilution with water and concentration using an ultrafiltration module (Ultrafiltration Module ACV-3050, manufactured by Asahi Chemical Industry Co., Ltd.) to decrease the concentration of the salt in the dispersion to 1/9.

TABLE 16

| Composition of Dispersion | |
|---|---|
| Aqueous Solution of Polymer Latex (a) (solid content: 13%) | 108 ml |
| Surfactant (5) | 20 g |
| Aqueous Solution (5%) of Surfactant (6) | 600 ml |
| Water | 1,232 ml |

A gelatin dispersion of zinc hydroxide was prepared according to the formulation shown in Table 17 below. More specifically, respective components were mixed, dissolved and dispersed for 30 minutes in a mill together with glass beads having an average particle size of 0.75 mm. The glass beads were separated and removed to obtain a homogenous dispersion.

TABLE 17

| Composition of Dispersion | |
|---|---|
| Zinc hydroxide | 15.9 g |
| Carboxy methyl cellulose | 0.7 g |
| Sodium polyacrylate | 0.07 g |
| Lime-processed gelatin | 4.2 g |
| Water | 100 ml |
| Antiseptic (2) | 0.4 g |

A preparation method of a gelatin dispersion of a matting agent added to the protective layer is described below. PMMA was dissolved in methylene chloride and the resulting solution was added to gelatin together with a small amount of a surfactant and dispersed while stirring at a high revolution speed. Then, methylene chloride was removed using a reduced-pressure solvent-removing device to obtain a homogenous dispersion having an average particle size of 4.3 $\mu$m.

Cyan Coupler C-28:

Magenta Coupler C-28:

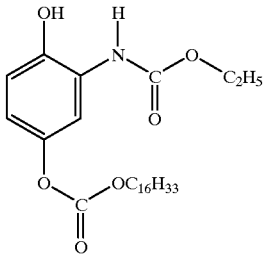

Yellow Coupler C-30:

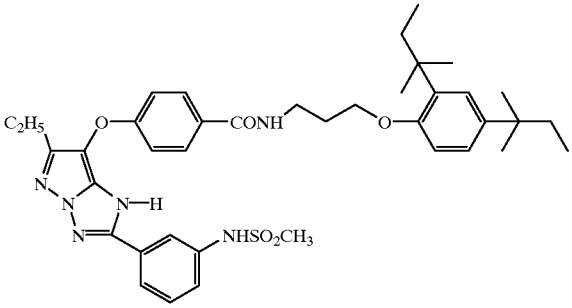

Cyan Developing Agent R-31:

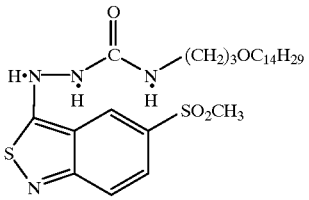

Magenta, Yellow Developing Agent R-34:

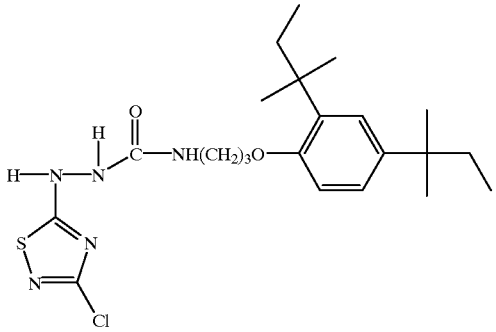

Antifoggant (5)

Antifoggant (2):

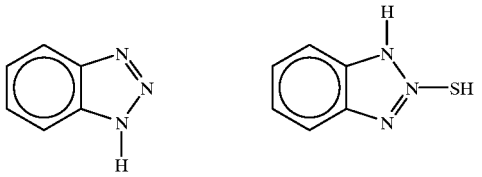

High Boiling Solvent (4):

Antiseptic (1):

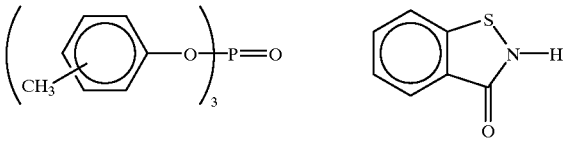

Surfactant (1):

Antifoggant (4):

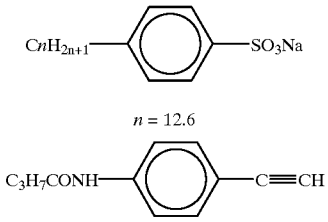

Surfactant (4):

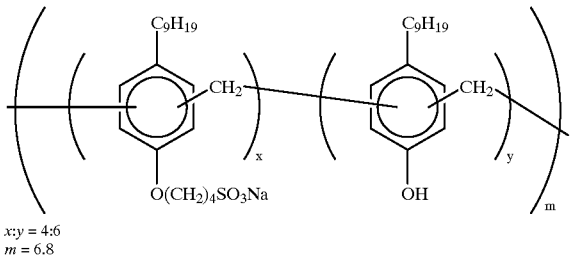

High Boiling Solvent (2):

Antiseptic (3):

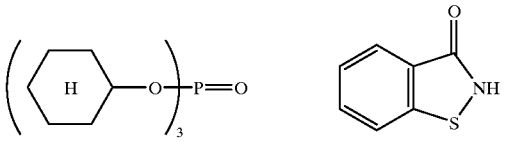

High Boiling Solvent (5):

$C_{26}H_{46.9}Cl_{7.1}$ (Empara 40, manufactured by Ajinomoto Co., Ltd.)

Reducing Agent (1):

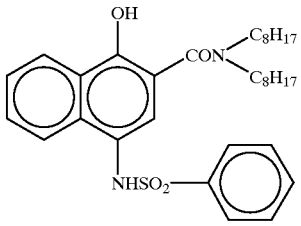

Polymer Latex (a):

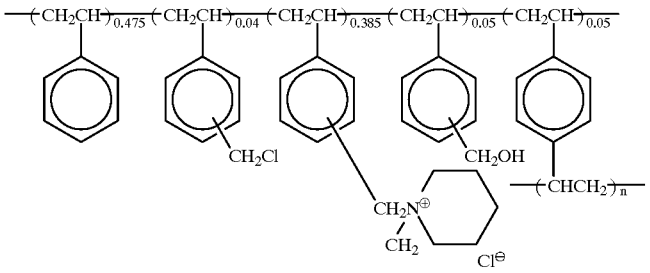

Surfactant (5):

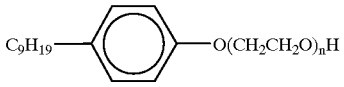

$n = 50$

Surfactant (6):

Antiseptic (2):

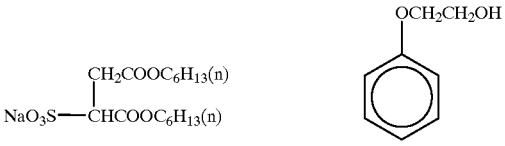

Surfactant (2):

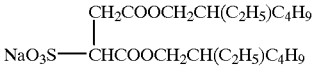

Surfactant (3):

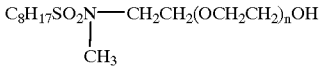

Water-Soluble Polymer (1):

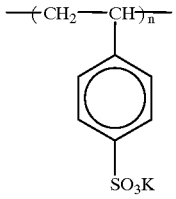

Limiting viscosity number [η]=1.6 (0.1N NaCl, 30° C.)

Molecular weight≈1,000,000

Water-Soluble Polymer (2):

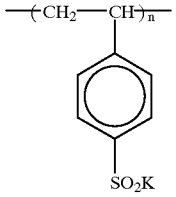

Limiting viscosity number [η]=0.8 (0.1N NaCl, 30° C.)

Molecular weight≈400,000

Hardener (1):

Developing Agent (a):

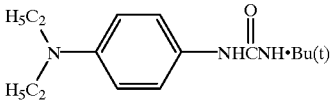

Using the above-described compounds and additives, Light-Sensitive Material 101 shown in Tables 18 to 19 below was prepared.

TABLES 18 TO 19

Main Construction of Light-Sensitive Material 101

| Layer | Name of Layer | Additives | Coating Amount (mg/m$^2$) |
|---|---|---|---|
| Seventh Layer | Protective Layer | Acid-processed gelatin | 387 |
| | | Matting Agent (2) | 17 |
| | | Surfactant (2) | 6 |
| | | Surfactant (3) | 20 |
| | | Dispersion of Polymer Latex (a) | 10 |
| Sixth Layer | Interlayer | Lime-processed gelatin | 862 |
| | | Antifoggant (4) | 7 |
| | | Reducing Agent (1) | 57 |
| | | High Boiling Solvent (2) | 101 |
| | | High Boiling Solvent (5) | 9 |
| | | Surfactant (1) | 21 |
| | | Surfactant (4) | 21 |
| | | Water-Soluble Polymer (1) | 5 |
| | | Zinc hydroxide | 558 |
| | | Calcium nitrate | 6 |
| Fifth Layer | Blue-Sensitive Layer | Lime-processed gelatin | 587 |
| | | Light-Sensitive Silver Halide Emulsion (3) | 399 |
| | | Yellow Coupler C-30 | 410 |
| | | Developing Agent R-34 | 328 |
| | | Antifoggant (5) | 15 |
| | | High Boiling Solvent (4) | 433 |
| | | Surfactant (1) | 12 |
| | | Water-Soluble Polymer (1) | 40 |
| Fourth Layer | Interlayer | Lime-processed gelatin | 862 |
| | | Antifoggant (4) | 7 |
| | | Reducing Agent (1) | 57 |
| | | High Boiling Solvent (2) | 101 |
| | | High Boiling Solvent (5) | 9 |
| | | Surfactant (1) | 21 |
| | | Surfactant (4) | 21 |
| | | Water-Soluble polymer (1) | 4 |
| | | Zinc hydroxide | 341 |
| | | Calcium nitrate | 8 |
| Third Layer | Green-Sensitive Layer | Lime-processed gelatin | 452 |
| | | Light-Sensitive Silver Halide Emulsion (2) | 234 |
| | | Magenta Coupler C-28 | 420 |
| | | Developing Agent R-34 | 336 |
| | | Antifoggant (2) | 15 |
| | | High Boiling Solvent (4) | 444 |
| | | Surfactant (1) | 12 |
| | | Water Soluble Polymer (1) | 10 |
| Second Layer | Interlayer | Lime-processed gelatin | 862 |
| | | Antifoggant (4) | 7 |
| | | Reducing Agent (1) | 57 |
| | | High Boiling Solvent (2) | 101 |
| | | High Boiling Solvent (5) | 9 |
| | | Surfactant (1) | 21 |
| | | Surfactant (4) | 21 |
| | | Water-Soluble Polymer (1) | 10 |
| | | Calcium nitrate | 6 |
| First Layer | Red-Sensitive Layer | Lime-processed gelatin | 373 |
| | | Light-Sensitive Silver Halide Emulsion (1) | 160 |
| | | Cyan Coupler C-28 | 390 |
| | | Developing Agent R-31 | 312 |

TABLES 18 TO 19-continued

Main Construction of Light-Sensitive Material 101

| Layer | Name of Layer | Additives | Coating Amount (mg/m$^2$) |
|---|---|---|---|
| | | Antifoggant (2) | 14 |
| | | High Boiling Solvent (4) | 412 |
| | | Surfactant (1) | 11 |
| | | Water-Soluble Polymer (2) | 25 |
| | | Hardener (1) | 45 |
| | | Antiseptic (3) | 45 |

Support Polyethylene Terephthalate Film (thickness: 20 $\mu$m) Deposited with Aluminum and Subbed with Gelatin Light-Sensitive Material 102 for comparison and Light-Sensitive Materials 103 to 105 according to the present invention were prepared in the same manner as in Light-Sensitive Material 101 except for changing the developing agents and couplers as to yellow, magenta and cyan to those shown in Table 20 below, respectively.

The light-sensitive materials and the dye fixing materials were combined each other as shown in Table 20 and processed under heating conditions of 80° C. for 30 seconds using Pictrostat 330 manufactured by Fuji Photo Film Co., Ltd. to form images. Clear color images were obtained. The maximum density and minimum density were measured by a reflection densitometer X-rite 304 manufactured by X-rite Co., Ltd.

The color imaging elements (dye fixing materials) having the color images were subjected to evaluation of color fading due to light. Specifically, a transparent film having an ultraviolet absorbing layer was superposed on the surface of each of the color imaging element and the color imaging element was subjected to irradiation using a fluorescent lump of 17,000 lux for 30 days. Then, the image density was measured and compared with the density measured just after the processing to determine the rate of color fading according to the following formula:

Rate of color fading=(Density after the irradiation for 30 days)/(Density just after processing)×100

The results obtained are shown in Table 20 below. As can be seen from the results shown in Table 20, the excellent photographic properties and image fastness can be obtained by using the compounds according to the present invention.

Further, an aqueous solution of Color Fading Preventing Agent a-53 was coated on the color imaging element of Comparative Example 3 in an amount of 5 mmol/m$^2$ by a bar coater and dried. The color imaging element was subjected to the evaluation of color fading due to light in the same manner as described above. As s result, the excellent image fastness similar to the above was obtained.

TABLE 20

| | Light-Sensitive Material | | | Dye Fixing Material | Photographic | | Image Fastness | |
|---|---|---|---|---|---|---|---|---|
| | | Developing | | Color Fading | Properties | | Rate of | |
| | Hue | Agent | Coupler | Preventing Agent | Dmin | Dmax | Color Fading | Remarks |
| 102 | Y | (a) | C-30 | none | 0.55 | 1.01 | 72 | Comparative Example 1 |
| | M | (a) | C-27 | | 0.48 | 0.99 | 64 | |
| | C | (a) | C-26 | | 0.78 | 0.89 | 52 | |
| 102 | Y | (a) | C-30 | a-53 | 0.56 | 1.10 | 77 | Comparative Example 2 |
| | M | (a) | C-27 | | 0.50 | 1.05 | 70 | |
| | C | (a) | C-26 | | 0.80 | 0.95 | 61 | |
| 101 | Y | R-34 | C-30 | none | 0.22 | 1.75 | 82 | Comparative Example 3 |
| | M | R-34 | C-28 | | 0.21 | 1.88 | 74 | |
| | C | R-31 | C-28 | | 0.29 | 1.56 | 66 | |
| 101 | Y | R-34 | C-30 | a-53 | 0.23 | 1.80 | 90 | Present Invention |
| | M | R-34 | C-28 | | 0.25 | 1.90 | 88 | |
| | C | R-31 | C-28 | | 0.30 | 1.60 | 80 | |
| 103 | Y | R-33 | C-30 | a-53 | 0.25 | 1.72 | 91 | Present Invention |
| | M | R-33 | C-28 | | 0.28 | 1.88 | 89 | |
| | C | R-32 | C-28 | | 0.22 | 1.58 | 82 | |
| 104 | Y | R-34 | C-30 | a-53 | 0.24 | 1.75 | 90 | Present Invention |
| | M | R-34 | C-29 | | 0.29 | 1.89 | 86 | |
| | C | R-31 | C-29 | | 0.25 | 1.59 | 81 | |
| 105 | Y | R-33 | C-30 | a-53 | 0.23 | 1.78 | 91 | Present Invention |
| | M | R-33 | C-29 | | 0.28 | 1.86 | 88 | |
| | C | R-32 | C-29 | | 0.26 | 1.60 | 85 | |

EXAMPLE 2

Dye fixing materials were prepared in the same manner as in Dye fixing Material R101 of Example 1, except for adding each 5 mmol/$m^2$ of the compound represented by formula (II) according to the present invention shown in Table 41 below to the second layer and the third layer of Dye Fixing Material R101, respectively.

Now, a method for the preparation of a light-sensitive material is described below.

Preparation of light-sensitive silver halide emulsions is described below.

Light-Sensitive Silver Halide Emulsion (1) (Emulsion for the Fifth Layer (680 nm Light-sensitive Layer))

To an aqueous solution having a composition shown in Table 21 below under well stirring, Solution (I) and Solution (II) each having a composition shown in Table 22 below were simultaneously added over a period of 13 minutes, and 10 minutes after then, Solution (III) and Solution (IV) each having a composition shown in Table 22 below were added over a period of 33 minutes.

TABLE 21

| Composition | |
|---|---|
| $H_2O$ | 620 ml |
| Lime-processed gelatin | 20 g |
| KBr | 0.3 g |
| NaCl | 2 g |
| Silver Halide Solvent (1) | 0.03 g |
| Sulfuric acid (1N) | 16 ml |
| Temperature | 45° C. |

TABLE 22

| | Solution (I) | Solution (II) | Solution (III) | Solution (IV) |
|---|---|---|---|---|
| $AgNO_3$ | 30.0 g | none | 70.0 g | none |
| KBr | none | 13.7 g | none | 44.2 g |
| NaCl | none | 3.62 g | none | 2.4 g |

TABLE 22-continued

| | Solution (I) | Solution (II) | Solution (III) | Solution (IV) |
|---|---|---|---|---|
| $K_2IrCl_6$ | none | none | none | 0.039 mg |
| Total | Water to make 126 ml | Water to make 132 ml | Water to make 254 ml | Water to make 252 ml |

Silver Halide Solvent (1):

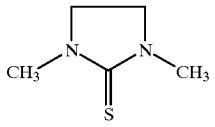

Then, 13 minutes after the initiation of the addition of Solution (III), 150 ml of an aqueous solution containing 0.350% of Sensitizing Dye (1) shown below was added over a period of 27 minutes.

Sensitizing Dye (1):

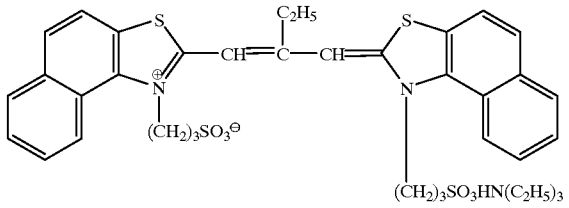

The mixture was washed with water and desalted (performed using Flocculant (a) shown below at a pH of 4.1) according to a conventional method, 22 g of a lime-processed ossein gelatin was added thereto, the pH and the pAg were adjusted to 6.0 and 7.9, respectively, and chemical sensitization was performed at 60° C. The compounds used in the chemical sensitization are shown in Table 23 below. The resulting emulsion in a yield of 630 g was a monodispersed cubic silver chlorobromide emulsion having a coefficient of variation of 10.2% and an average grain size of 0.20 μm.

TABLE 23

| Chemicals used in Chemical Sensitization | Amount added |
|---|---|
| 4-Hydroxy-6-methyl-1,3,3a,7-tetraazaindene | 0.36 g |
| Sodium thiosulfate | 6.75 mg |
| Antifoggant (1) | 0.11 g |
| Antiseptic (1) | 0.07 g |
| Antiseptic (2) | 3.31 g |

Flocculant (a):

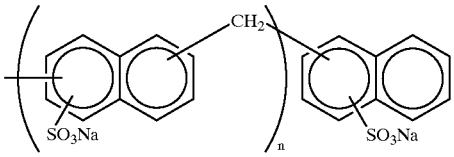

$n = 1 \sim 5$

Antifoggant (1):

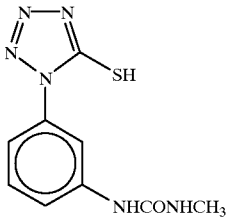

Antiseptic (1):

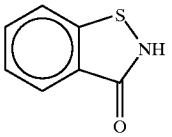

Antiseptic (2):

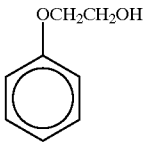

Light-Sensitive Silver Halide Emulsion (2) (Emulsion for the Third Layer (750 nm Light-sensitive Layer))

To an aqueous solution having a composition shown in Table 24 below under well stirring, Solution (I) and Solution (II) each having a composition shown in Table 25 below were simultaneously added over a period of 18 minutes, and 10 minutes after then, Solution (III) and Solution (IV) each having a composition shown in Table 25 below were added over a period of 24 minutes.

TABLE 24

| Composition | |
|---|---|
| $H_2O$ | 620 ml |
| Lime-processed gelatin | 20 g |
| KBr | 0.3 g |
| NaCl | 2 g |
| Silver Halide Solvent (1) | 0.03 g |
| Sulfuric acid (1N) | 16 ml |
| Temperature | 45° C. |

TABLE 25

| | Solution (I) | Solution (II) | Solution (III) | Solution (IV) |
|---|---|---|---|---|
| $AgNO_3$ | 30.0 g | none | 70.0 g | none |
| KBr | none | 13.7 g | none | 44.2 g |
| NaCl | none | 3.62 g | none | 2.4 g |
| $K_4[Fe(CN)_6] \cdot H_2O$ | none | none | none | 0.07 g |
| $K_2IrCl_6$ | none | none | none | 0.04 mg |
| Total | Water to make 188 ml | Water to make 188 ml | Water to make 250 ml | Water to make 250 ml |

The mixture was washed with water and desalted (performed using Flocculant (b) shown below at a pH of 3.9) according to a conventional method, 22 g of a lime-processed ossein gelatin subjected to removal of calcium (calcium content: 150 ppm or less) was added and redispersed at 40° C., 0.39 g of 4-hydroxy-6-methyl-1,3,3a,7-tetraazaindene was added thereto, and the pH and the pAg were adjusted to 5.9 and 7.8, respectively. Thereafter, chemical sensitization was performed at 70° C. using chemicals shown in Table 26 below. At the final of the chemical sensitization, Sensitizing Dye (2) as a methanol solution (solution having a composition shown in Table 27 below) were added. Further, after the chemical sensitization, the temperature was lowered to 40° C., 200 g of a gelatin dispersion of Stabilizer (1) shown below was added and well stirred, and then the mixture was stored. The resulting emulsion in a yield of 938 g was a monodispersed cubic silver chlorobromide emulsion having a coefficient of variation of 12.6% and an average grain size of 0.25 μm. The emulsion for the 750 nm light-sensitive layer had spectral sensitivity of the J-band type.

TABLE 26

| Chemicals used in Chemical Sensitization | Amount added |
|---|---|
| 4-Hydroxy-6-methyl-1,3,3a,7-tetraazaindene | 0.39 g |
| Triethylthiourea | 3.3 mg |
| Nucleic acid decomposition product | 0.39 g |
| NaCl | 0.15 g |
| KI | 0.12 g |
| Antifoggant (2) | 0.10 g |
| Antiseptic (1) | 0.07 g |

TABLE 27

| Composition of Dye Solution | Amount added |
|---|---|
| Sensitizing Dye (2) | 0.19 g |
| Methanol | 18.7 ml |

Stabilizer (1):

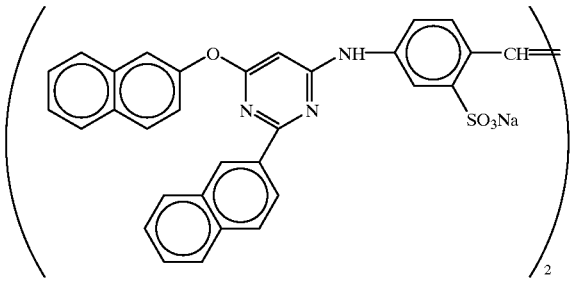

Antifoggant (2):

Sensitizing Dye (2):

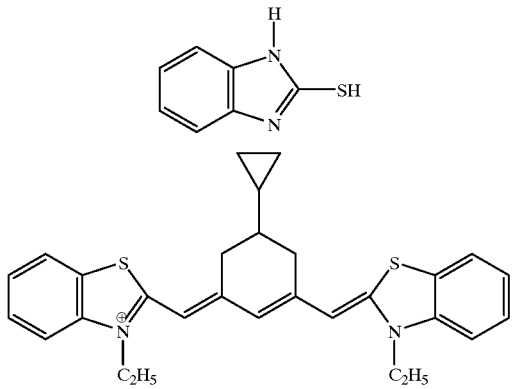

PTS = p-toluenesulfonic acid

Flocculant (b)

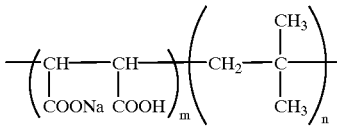

$m:n$ = 1:1

Light-Sensitive Silver Halide Emulsion (3) (Emulsion for the First Layer (810 nm Light-sensitive Layer))

To an aqueous solution having a composition shown in Table 28 below under well stirring, Solution (I) and Solution (II) each having a composition shown in Table 29 below were simultaneously added over a period of 18 minutes, and 10 minutes after then, Solution (III) and Solution (IV) each having a composition shown in Table 29 below were added over a period of 24 minutes.

TABLE 28

| Composition | |
|---|---|
| $H_2O$ | 620 ml |
| Lime-processed gelatin | 20 g |
| KBr | 0.3 g |
| NaCl | 2 g |
| Silver Halide Solvent (1) | 0.03 g |
| Sulfuric acid (1N) | 16 ml |

TABLE 28-continued

| Composition | |
|---|---|
| Temperature | 50° C. |

TABLE 29

| | Solution (I) | Solution (II) | Solution (III) | Solution (IV) |
|---|---|---|---|---|
| $AgNO_3$ | 30.0 g | none | 70.0 g | none |
| KBr | none | 13.7 g | none | 44.1 g |
| NaCl | none | 3.62 g | none | 2.4 g |
| $K_2IrCl_6$ | none | none | none | 0.02 mg |
| Total | Water to make 180 ml | Water to make 181 ml | Water to make 242 ml | Water to make 250 ml |

The mixture was washed with water and desalted (performed using Flocculant (a) at a pH of 3.8) according to a conventional method, 22 g of a lime-processed ossein gelatin was added, the pH and the pAg were adjusted to 7.4 and 7.8, respectively, and chemical sensitization was performed at 60° C. The chemicals used in the chemical sensitization are shown in Table 30 below. The resulting emulsion in a yield of 680 g was a monodispersed cubic silver chlorobromide emulsion having a coefficient of variation of 9.7% and an average grain size of 0.32 $\mu$m.

TABLE 30

| Chemicals used in Chemical Sensitization | Amount added |
|---|---|
| 4-Hydroxy-6-methyl-1,3,3a,7-tetraazaindene | 0.38 g |
| Triethylthiourea | 3.1 mg |
| Antifoggant (2) | 0.19 g |
| Antiseptic (1) | 0.07 g |
| Antiseptic (2) | 3.13 g |

A preparation method of a gelatin dispersion of colloidal silver is described below.

To a well stirred aqueous solution having a composition shown in Table 31 below, a solution having a composition shown in Table 32 below was added over a period of 24 minutes. Thereafter, the mixture was washed with water using Flocculant (a), then 43 g of a lime-processed ossein gelatin was added, and the pH was adjusted to 6.3. The average grain size thereof was 0.02 $\mu$m and the yield was 512 g (dispersion containing 2% of silver and 6.8% of gelatin).

TABLE 31

| Composition | |
|---|---|
| $H_2O$ | 620 ml |
| Dextrin | 16 g |
| NaOH (5N) | 41 ml |
| Temperature | 30° C. |

TABLE 32

| Composition | |
|---|---|
| $H_2O$ | 135 ml |
| $AgNO_3$ | 17 g |

A preparation method of a gelatin dispersion of each hydrophobic additive is described below.

A gelatin dispersion of each of yellow coupler, magenta coupler and cyan coupler and a developing agent was prepared according to the formulation shown in Table 33 below. More specifically, each of the oil phase component was dissolved under heating at about 70° C. to form a uniform solution, the aqueous phase component heated at about 60° C. was added to the solution, and the components were mixed under stirring and then dispersed in a homogenizer for 10 minutes at 10,000 rpm. Water was added thereto and the mixture was stirred to obtain a homogenous dispersion.

TABLE 33

| | Composition of Dispersion | | |
|---|---|---|---|
| | Yellow | Magenta | Cyan |
| Oil phase | | | |
| Cyan Coupler C-28 | none | none | 7.0 g |
| Magenta Coupler C-28 | none | 7.0 g | none |
| Yellow Coupler C-30 | 7.0 g | none | none |
| Developing Agent R-31 | none | none | 5.6 g |
| Developing Agent R-34 | none | 5.6 g | none |
| Developing Agent R-34 | 5.6 g | none | none |
| Antifoggant (5) | 0.25 g | none | none |
| Antifoggant (2) | none | 0.25 g | 0.25 g |
| High Boiling Solvent (4) | 7.4 g | 7.4 g | 7.4 g |
| Ethyl acetate | 15 ml | 15 ml | 15 ml |
| Aqueous phase | | | |
| Lime-processed gelatin | 10.0 g | 10.0 g | 10.0 g |
| Potassium nitrate | 0.1 g | 0.1 g | 0.1 g |
| Surfactant (1) | 0.2 g | 0.2 g | 0.2 g |
| Water | 110 ml | 110 ml | 110 ml |
| Water added | 110 ml | 110 ml | 110 ml |
| Antiseptic (1) | 0.04 g | 0.04 g | 0.04 g |

A gelatin dispersion of Antifoggant (4) and Reducing Agent (1) was prepared according to the formulation shown in Table 34 below. More specifically, the oil phase component was dissolved under heating at about 60° C., the aqueous phase component heated at about 60° C. was added to the solution, and the components were mixed under stirring and then dispersed in a homogenizer for 10 minutes at 10,000 rpm to obtain a homogenous dispersion.

TABLE 34

| Composition of Dispersion | |
|---|---|
| Oil phase | |
| Antifoggant (4) | 0.16 g |
| Reducing Agent (1) | 1.3 g |
| High Boiling Solvent (2) | 2.3 g |
| High Boiling Solvent (5) | 0.2 g |
| Surfactant (1) | 0.5 g |
| Surfactant (4) | 0.5 g |
| Ethyl acetate | 10.0 ml |
| Aqueous phase | |
| Acid-processed gelatin | 10.0 g |
| Antiseptic (1) | 0.004 g |
| Calcium nitrate | 0.1 g |
| Water | 35.0 ml |
| Water added | 104.4 ml |

A gelatin dispersion of Reducing Agent (2) was prepared according to the formulation shown in Table 35 below. More specifically, the oil phase component was dissolved under heating at about 60° C., the aqueous phase component heated at about 60° C. was added to the solution, and the components were mixed under stirring and then dispersed in a homogenizer for 10 minutes at 10,000 rpm to obtain a homogenous dispersion. From the resulting dispersion, ethyl acetate was removed using a reduced-pressure organic solvent-removing device.

TABLE 35

| Composition of Dispersion | |
|---|---|
| Oil phase | |
| Reducing Agent (2) | 7.5 g |
| High Boiling Solvent (1) | 4.7 g |
| Surfactant (1) | 1.9 g |
| Ethyl acetate | 14.4 ml |
| Aqueous phase | |
| Acid-processed gelatin | 10.0 g |
| Antiseptic (1) | 0.02 g |
| Gentamicin | 0.04 g |
| Sodium hydrogensulfite | 0.1 g |
| Water | 136.7 ml |

A dispersion of Polymer Latex (a) was prepared according to the formulation shown in Table 36 below. Specifically, Surfactant (6) was added to a mixed solution containing Polymer Latex (a), Surfactant (5) and water, as shown in Table 36, over a period of 10 minutes with stirring to obtain a homogeneous dispersion. The resulting dispersion was subjected to repetition of dilution with water and concentration using an ultrafiltration module (Ultrafiltration Module ACV-3050, manufactured by Asahi Chemical Industry Co., Ltd.) to decrease the concentration of the salt in the dispersion to 1/9.

TABLE 36

| Composition of Dispersion | |
|---|---|
| Aqueous Solution of Polymer Latex (a) (solid content: 13%) | 108 ml |
| Surfactant (5) | 20 g |
| Surfactant (6) | 600 ml |
| Water | 1,232 ml |

A gelatin dispersion of Stabilizer (1) was prepared according to the formulation shown in Table 37 below. More specifically, the oil phase component was dissolved at room temperature, the aqueous phase component heated at about 40° C. was added to the solution, and the components were mixed while stirring and dispersed in a homogenizer for 10 minutes at 10,000 rpm. Water was added thereto and stirred to obtain a homogenous dispersion.

TABLE 37

| Composition of Dispersion | |
|---|---|
| Oil phase | |
| Stabilizer (1) | 4.0 g |
| Sodium hydroxide | 0.3 g |
| Methanol | 62.8 g |
| Antiseptic (2) | 0.8 g |
| Aqueous phase | |
| Gelatin subjected to removal of calcium (Ca content: 100 ppm or less) | 10.0 g |
| Antiseptic (1) | 0.04 g |
| Water | 320 ml |

A gelatin dispersion of zinc hydroxide was prepared according to the formulation shown in Table 38 below. More specifically, respective components were mixed, dissolved and dispersed for 30 minutes in a mill together with glass beads having an average particle size of 0.75 mm. The glass beads were separated and removed to obtain a homogenous dispersion.

TABLE 38

| Composition of Dispersion | |
|---|---|
| Zinc hydroxide | 15.9 g |
| Carboxy methyl cellulose | 0.7 g |
| Sodium polyacrylate | 0.07 g |
| Lime-processed gelatin | 4.2 g |
| Water | 100 ml |
| Antiseptic (2) | 0.4 g |

A preparation method of a gelatin dispersion of a matting agent added to the protective layer is described below. PMMA was dissolved in methylene chloride and the resulting solution was added to gelatin together with a small amount of a surfactant and dispersed while stirring at a high revolution speed. Then, methylene chloride was removed using a reduced-pressure solvent-removing device to obtain a homogenous dispersion having an average particle size of 4.3 $\mu$m.

Dye (a):

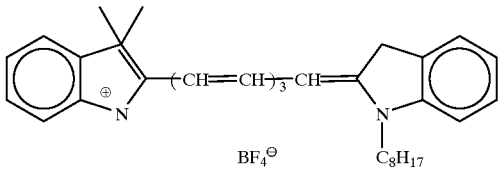

Stabilizer (1):

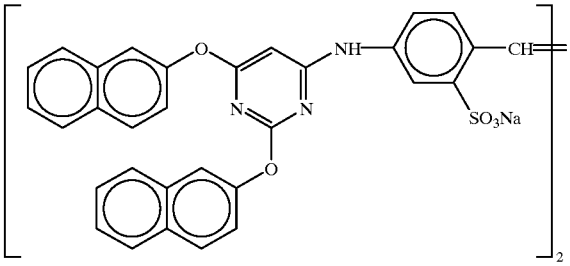

Antiseptic (1):

Antiseptic (2):

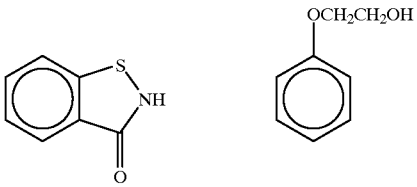

Cyan Coupler C-28:

Magenta Coupler C-28:

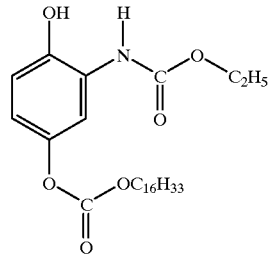

Yellow Coupler C-30:

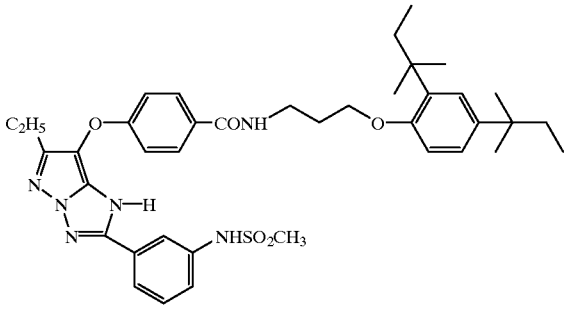

Cyan Developing Agent R-31:

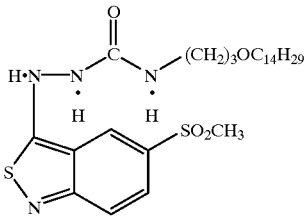

Magenta, Yellow Developing Agent R-34:

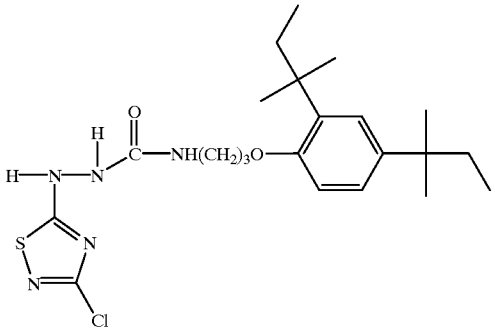

Antifoggant (5):

Antifoggant (2):

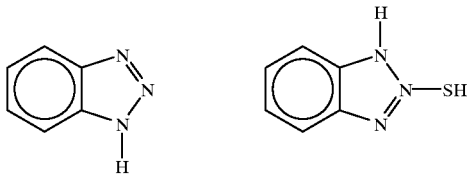

High Boiling Solvent (4):
Antiseptic (1):

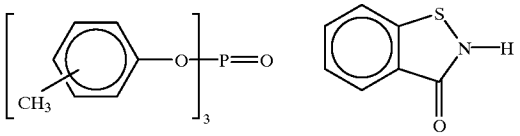

Reducing Agent (1):

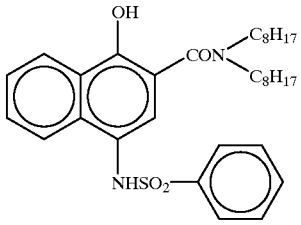

Antifoggant (3):
Antifoggant (4):

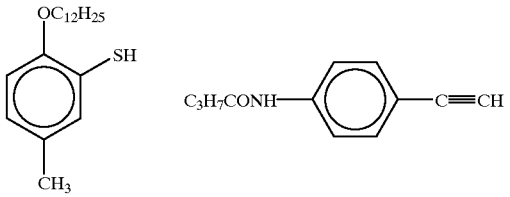

Surfactant (1):

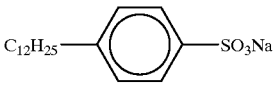

High Boiling Solvent (1):

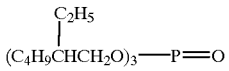

High Boiling Solvent (2):

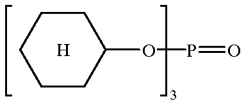

Antiseptic (3):

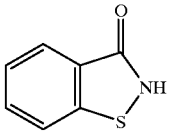

Reducing Agent (2):

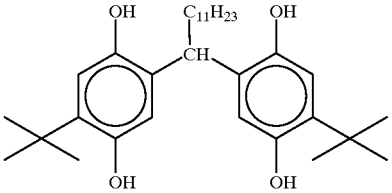

Surfactant (2):

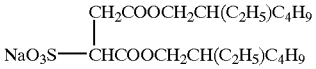

Surfactant (3):

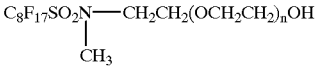

n = 3~8

Water-Soluble Polymer (1):

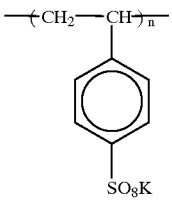

Limiting viscosity number [η]=1.6 (0.1N Nacl, 30° C.)
Molecular weight≈1,000,000

Water-Soluble Polymer (2):

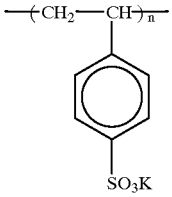

Limiting viscosity number [η]=0.8 (0.1N Nacl, 30° C.)
Molecular weight≈400,000

Sensitizing Dye (3):

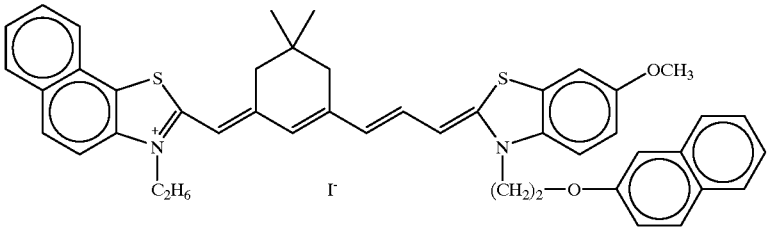

Hardener (1):

$CH_2{=}CHSO_2CH_2SO_2CH_2$

Surfactant (4):

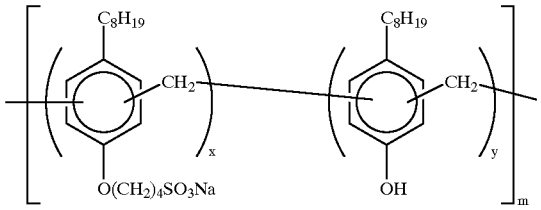

x/y = 4:6
m = 6.8

High Boiling Solvent (5):
$C_{26}H_{46.9}Cl_{7.1}$
(Empara 40, manufactured by Ajinomoto Co., Ltd.)

Polymer Latex (a):

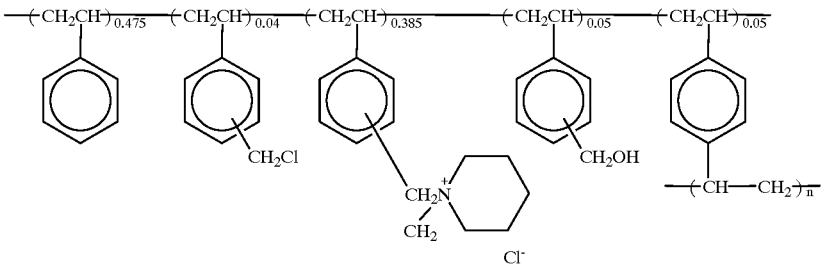

Surfactant (5):

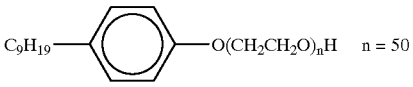

Surfactant (6):

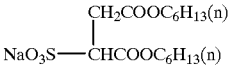

Developing Agent (a):

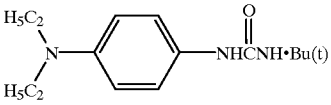

(Compound described in JP-A-59-111148)

Using the above-described compounds and additives, Light-Sensitive Material 201 shown in Tables 39 to 40 below was prepared.

TABLES 39 to 40

Main Construction of Light-Sensitive Material 201

| Layer | Name of Layer | Additives | Coating Amount ($mg/m^2$) |
|---|---|---|---|
| Seventh Layer | Protective Layer | Acid-processed gelatin | 442 |
| | | Reducing Agent (2) | 47 |
| | | High Boiling Solvent (1) | 30 |
| | | Colloidal silver grain | 2 |
| | | Matting agent (PMMA resin) | 17 |
| | | Surfactant (1) | 16 |
| | | Surfactant (2) | 9 |
| | | Surfactant (3) | 2 |
| Sixth Layer | Interlayer | Lime-processed gelatin | 862 |
| | | Antifoggant (4) | 7 |
| | | Reducing Agent (1) | 57 |
| | | High Boiling Solvent (2) | 101 |
| | | High Boiling Solvent (5) | 9 |

TABLES 39 to 40-continued

Main Construction of Light-Sensitive Material 201

| Layer | Name of Layer | Additives | Coating Amount (mg/m²) |
|---|---|---|---|
| | | Surfactant (1) | 21 |
| | | Surfactant (4) | 21 |
| | | Dispersion of Polymer Latex (a) | 5 |
| | | Water-soluble Polymer (1) | 4 |
| | | Calcium nitrate | 6 |
| Fifth Layer | Red-Sensitive Layer | Lime-processed gelatin | 452 |
| | | Light-Sensitive Silver Halide Emulsion (1) | 301 |
| | | Magenta Coupler C-28 | 420 |
| | | Developing Agent R-34 | 336 |
| | | Antifoggant (2) | 15 |
| | | High Boiling Solvent (4) | 444 |
| | | Surfactant (1) | 12 |
| | | Water-Soluble Polymer (1) | 10 |
| Fourth Layer | Interlayer | Lime-processed gelatin | 862 |
| | | Antifoggant (4) | 7 |
| | | Reducing Agent (1) | 57 |
| | | High Boiling Solvent (2) | 101 |
| | | High Boiling Solvent (5) | 9 |
| | | Surfactant (1) | 21 |
| | | Surfactant (4) | 21 |
| | | Dispersion of Polymer Latex (a) | 5 |
| | | Water-Soluble Polymer (1) | 4 |
| | | Calcium nitrate | 6 |
| Third Layer | Second Infrared-Sensitive Layer | Lime-processed gelatin | 373 |
| | | Light-Sensitive Silver Halide Emulsion (2) | 106 |
| | | Cyan Coupler C-28 | 390 |
| | | Developing Agent R-31 | 312 |
| | | Antifoggant (2) | 14 |
| | | High Boiling Solvent (4) | 412 |
| | | Surfactant (1) | 11 |
| | | Water-Soluble Polymer (1) | 11 |
| Second Layer | Interlayer | Lime-processed gelatin | 862 |
| | | Antifoggant (4) | 7 |
| | | Reducing Agent (1) | 57 |
| | | High Boiling Solvent (2) | 101 |
| | | High Boiling Solvent (5) | 9 |
| | | Surfactant (1) | 21 |
| | | Surfactant (4) | 21 |
| | | Water-Soluble Polymer (2) | 25 |
| | | Zinc hydroxide | 750 |
| | | Calcium nitrate | 6 |
| First Layer | First Infrared-Sensitive Layer | Lime-processed gelatin | 587 |
| | | Light-Sensitive Silver Halide Emulsion (3) | 311 |
| | | Yellow Coupler C-30 | 410 |
| | | Developing Agent R-34 | 328 |

TABLES 39 to 40-continued

Main Construction of Light-Sensitive Material 201

| Layer | Name of Layer | Additives | Coating Amount (mg/m²) |
|---|---|---|---|
| | | Antifoggant (5) | 15 |
| | | High-Boiling Solvent (4) | 433 |
| | | Surfactant (1) | 12 |
| | | Water-Soluble Polymer (1) | 40 |
| | | Hardener (1) | 45 |

Support Polyethylene Terephthalate Film (thickness: 20 μm) Deposited with Aluminum and Subbed with Gelatin Light-Sensitive Material 202 for comparison was prepared in the same manner as in Light-Sensitive Material 201 except for changing the developing agents and couplers as to yellow, magenta and cyan to those shown in Table 41 below, respectively.

The light-sensitive materials and the dye fixing materials were combined each other as shown in Table 41 and processed under heating conditions of 83° C. for 35 seconds using a digital color printer (Fujix Pictrography 3000 manufactured by Fuji Photo Film Co., Ltd.) to form images. Clear color images were obtained. The maximum density and minimum density were measured by a reflection densitometer X-rite 304 manufactured by X-rite Co., Ltd.

The color imaging elements (dye fixing materials) having the color images were subjected to evaluation of color fading due to light. Specifically, a transparent film having an ultraviolet absorbing layer was superposed on the surface of each of the color imaging element and the color imaging element was subjected to irradiation of xenon light of 100,000 lux for 10 days using a device (Atlas CI65 Weather-Ometer). Then, the image density was measured and compared with the density measured just after the processing to determine the rate of color fading according to the following formula:

$$\text{Rate of color fading} = (\text{Density after the irradiation for 10 days})/(\text{Density just after processing}) \times 100$$

The results obtained are shown in Table 41 below. As can be seen from the results shown in Table 41, the excellent photographic properties and image fastness can be obtained by using the compounds according to the present invention.

TABLE 41

| | Light-Sensitive Material | | | Dye Fixing Material | Image Fastness | |
|---|---|---|---|---|---|---|
| | Hue | Developing Agent | Coupler | Color Fading Preventing Agent | Rate of Color Fading | Remarks |
| 202 | Y | (a) | C-30 | none | 72 | Comparative Example |
| | M | (a) | C-27 | | 64 | |
| | C | (a) | C-26 | | 52 | |
| 202 | Y | (a) | C-30 | a-53 | 77 | Comparative Example |
| | M | (a) | C-27 | | 70 | |
| | C | (a) | C-26 | | 61 | |
| 201 | Y | R-34 | C-30 | none | 82 | Comparative Example |
| | M | R-34 | C-28 | | 74 | |
| | C | R-31 | C-28 | | 66 | |
| 201 | Y | R-34 | C-30 | a-43 | 90 | Present Invention |
| | M | R-34 | C-28 | | 88 | |
| | C | R-31 | C-28 | | 80 | |
| 201 | Y | R-34 | C-30 | a-2 | 89 | Present Invention |
| | M | R-34 | C-28 | | 86 | |

TABLE 41-continued

| | Light-Sensitive Material | | | Dye Fixing Material | Image Fastness | |
|---|---|---|---|---|---|---|
| | Hue | Developing Agent | Coupler | Color Fading Preventing Agent | Rate of Color Fading | Remarks |
| | C | R-31 | C-28 | | 79 | |
| 201 | Y | R-34 | C-30 | a-4 | 88 | Present Invention |
| | M | R-34 | C-28 | | 87 | |
| | C | R-31 | C-28 | | 78 | |
| 201 | Y | R-34 | C-30 | a-5 | 90 | Present Invention |
| | M | R-34 | C-28 | | 89 | |
| | C | R-31 | C-28 | | 81 | |
| 201 | Y | R-34 | C-30 | a-10 | 88 | Present Invention |
| | M | R-34 | C-28 | | 88 | |
| | C | R-31 | C-28 | | 79 | |
| 201 | Y | R-34 | C-30 | a-15 | 89 | Present Invention |
| | M | R-34 | C-28 | | 89 | |
| | C | R-31 | C-28 | | 80 | |
| 201 | Y | R-34 | C-30 | a-18 | 90 | Present Invention |
| | M | R-34 | C-28 | | 87 | |
| | C | R-31 | C-28 | | 79 | |
| 201 | Y | R-34 | C-30 | a-26 | 88 | Present Invention |
| | M | R-34 | C-28 | | 86 | |
| | C | R-31 | C-28 | | 76 | |
| 201 | Y | R-34 | C-30 | a-34 | 89 | Present Invention |
| | M | R-34 | C-28 | | 87 | |
| | C | R-31 | C-28 | | 77 | |
| 201 | Y | R-34 | C-30 | a-35 | 90 | Present Invention |
| | M | R-34 | C-28 | | 88 | |
| | C | R-31 | C-28 | | 80 | |
| 201 | Y | R-34 | C-30 | a-39 | 89 | Present Invention |
| | M | R-34 | C-28 | | 87 | |
| | C | R-31 | C-28 | | 77 | |
| 201 | Y | R-34 | C-30 | a-51 | 88 | Present Invention |
| | M | R-34 | C-28 | | 86 | |
| | C | R-31 | C-28 | | 77 | |
| 201 | Y | R-34 | C-30 | a-68 | 89 | Present Invention |
| | M | R-34 | C-28 | | 87 | |
| | C | R-31 | C-28 | | 78 | |
| 201 | Y | R-34 | C-30 | a-72 | 89 | Present Invention |
| | M | R-34 | C-28 | | 88 | |
| | C | R-31 | C-28 | | 79 | |

While the invention has been described in detail and with reference to specific embodiments thereof, it will be apparent to one skilled in the art that various changes and modifications can be made therein without departing from the spirit and scope thereof.

What is claimed is:

1. A color imaging element comprising: (a) a diffusible dye formed upon a reaction of an oxidation product of a compound represented by formula (I) shown below together with a coupler represented by formula (1), (2), (3), (4), (5), (7), (8), (9), (10), (11), or (12) shown below, and (b) at least one water-soluble compound represented by formula (II) shown below on a support, the water-soluble compound being soluble in an aqueous 50 wt % methanol solution in an amount of at least 20 wt %:

(I)

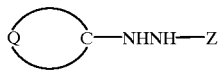

wherein Z represents a carbamoyl group, an acyl group, an alkoxycarbonyl group, an aryloxycarbonyl group, a sulfonyl group or a sulfamoyl group; and Q represents an atomic group necessary for forming an unsaturated ring together with the carbon atom;

(II)

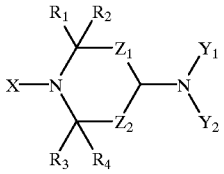

wherein X represents a hydrogen atom, a hydroxy group, an aliphatic group, an acyl group, an aliphatic oxy group, an aliphatic oxycarbonyl group or an aryloxycarbonyl group; $Y_1$ and $Y_2$, which may be the same or different, each represents a hydrogen atom or a substituent, or $Y_1$ and $Y_2$ may be combined with each other to form a 5-membered or 6-membered ring; $Z_1$ represents a simple bond, a methylene group which may be substituted or an ethylene group which may be substituted; $Z_2$ represents a methylene group which may be substituted; and $R_1$, $R_2$, $R_3$ and $R_4$, which may be the same or different, each represents an aliphatic group, or $R_1$ and $R_2$ and $R_3$ and $R_4$ each may be combined with each other to form a 5-membered or 6 membered ring (1)

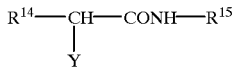

(2)

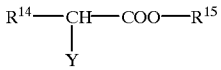

(3)

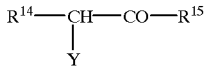

(4)

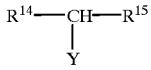

(5)

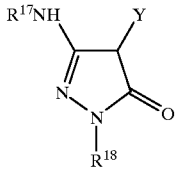

(7)

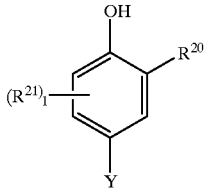

(8)

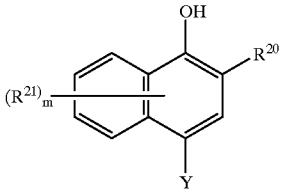

(9)

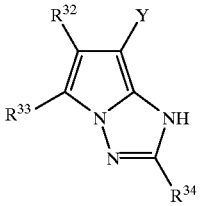

(10)

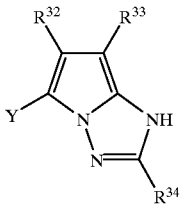

-continued (11)

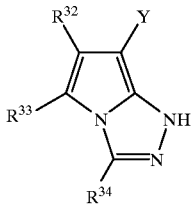

(12)

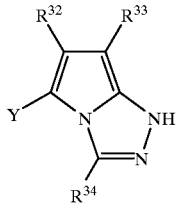

wherein in formulae (1) to (4), $R^{14}$ represents an acyl group, an aryl group, a heterocyclic group, an alkoxycarbonyl group, an aryloxycarbonyl group, a carbamoyl group, a sulfamoyl group, an alkylsufonyl group or an arylsulfonyl group, each of which may have a substituent, or a cyano group or a nitro group;

in formulae (1) to (3), $R^{15}$ represents an alkyl group, an aryl group or a heterocyclic group, each of which may have a substituent;

in formula (4), $R^{16}$ represents an aryl group or a heterocyclic group, each of which may have a substituent;

in formulae (1) to (4), $R^{14}$ and $R^{15}$ or $R^{14}$ and $R^{16}$ may be combined with each other to form a ring;

in formula (5), $R^{17}$ represents an alkyl group, an aryl group, an acyl group or a carbamoyl group and $R^{18}$ represents a phenyl group or a phenyl group substituted with one or more halogen atoms, alkyl groups, cyano groups, alkoxy groups, alkoxycarbonyl groups or acylamino groups;

in formulae (7) and (8), $R^{20}$ represents a hydrogen atom or a group selected from $—CONR^{22}R^{23}$, $—SO^2NR^{22}R^{23}$, $—NHCOR^{22}$, $—NHCONR^{22}R^{23}$ and $—NHSO_2NR^{22}R^{23}$ (wherein $R^{22}$ and $R^{23}$ each represents a hydrogen atom or a substituent);

in formulae (7) and (8), $R^{21}$ represents a substituent, l represents an integer of from 0 to 2, and m represents an integer of from 0 to 4, and when l or m is 2 or greater, the $R^{21}$ groups may be the same or different;

in formulae (9), (10), (11) and (12), $R^{32}$, $R^{33}$ and $R^{34}$ each represent a hydrogen atom or a substituent; and in formulae (1) to (5) and (7) to (12), Y represents a group imparting diffusion resistant property to the coupler and capable of being released upon a coupling reaction with an oxidation product of the developing agent.

2. The color imaging element as claimed in claim 1, wherein Z in formula (I) is a carbamoyl group.

3. The color imaging element as claimed in claim 1, wherein the coupler is a two-equivalent coupler.

4. The color imaging element as claimed in claim 1, wherein the water-soluble compounds represented by formula (II) is a compound represented by the following formula (II-1) or (II-2):

(II-1)

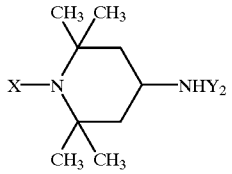

(II-2)

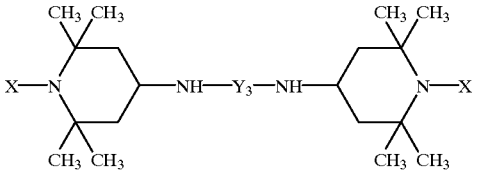

wherein X represents a hydrogen atom, a hydroxy group, an aliphatic group, an acyl group, an aliphatic oxy group, an aliphatic oxycarbonyl group or an aryloxycarbonyl group; $Y_2$ represents a hydrogen atom or a substituent; and $Y_3$ represents a simple bond or a divalent group.

5. The color imaging element as claimed in claim 4, wherein the divalent group represented by $Y_3$ is a sulfonyl group, a carbonyl group, a phosphoryl group, a phosphonyl group, a divalent acyl group or a divalent sulfonyl group.

6. A method of forming a color diffusion transfer image which comprises developing an imagewise exposed light-sensitive material comprising a support having thereon light-sensitive silver halide, a binder, a compound represented by formula (I) shown below and a coupler compound which forms or releases a diffusible dye upon a reaction with an oxidation product of the compound represented by formula (I), said coupler compound being represented by formula (1), (2), (3), (4), (5), (7), (8), (9), (10), (11) or (12) shown below, and transferring and fixing the diffusible dye formed or released by development of the light-sensitive material to a dye fixing layer of a dye fixing material comprising a support having thereon at least one dye fixing layer, wherein the dye fixing layer and/or an adjacent layer thereto contains at lease one water-soluble compound represented by formula (II) shown below which is soluble in an aqueous 50 wt % methanol solution in an amount of at least 20 wt %:

(I)

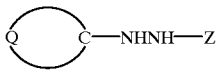

wherein Z represents a carbamoyl group, an acyl group, an alkoxycarbonyl group, an aryloxycarbonyl group, a sulfonyl group or a sulfamoyl group; and Q represents an atomic group necessary for forming an unsaturated ring together with the carbon atom;

(II)

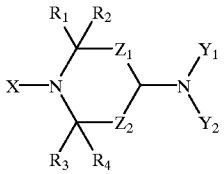

wherein X represents a hydrogen atom, a hydroxy group, an aliphatic group, an acyl group, an aliphatic oxy group, an aliphatic oxycarbonyl group or an aryloxycarbonyl group; $Y_1$ and $Y_2$, which may be the same or different, each represents a hydrogen atom or a substituent, or $Y_1$ and $Y_2$ may be combined with each other to form a 5-membered or 6-membered ring; $Z_1$ represents a simple bond, a methylene group which may be substituted or an ethylene group which may be substituted; $Z_2$ represents a methylene group which may be substituted; and $R_1$, $R_2$, $R_3$ and $R_4$, which may be the same or different, each represents an aliphatic group, or $R_1$ and $R_2$ and $R_3$ and $R_4$ each may be combined with each other to form a 5-membered or 6 membered ring (1)

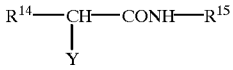

(2)

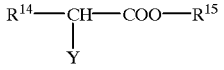

(3)

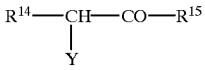

(4)

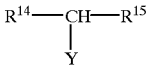

(5)

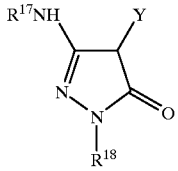

(7)

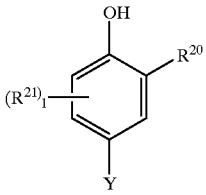

(8)

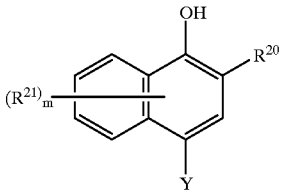

-continued (9)

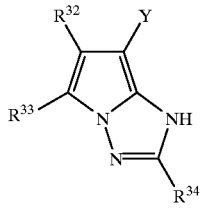

(10)

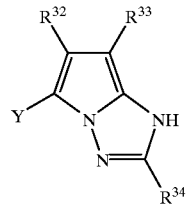

(11)

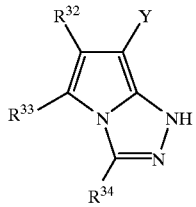

(12)

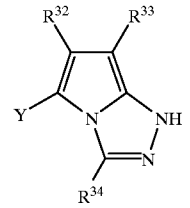

wherein in formulae (1) to (4), $R^{14}$ represents an acyl group, an aryl group, a heterocyclic group, an alkoxycarbonyl group, an aryloxycarbonyl group, a carbamoyl group, a sulfamoyl group, an alkylsufonyl group or an arylsulfonyl group, each of which may have a substituent, or a cyano group or a nitro group;

in formulae (1) to (3), $R^{15}$ represents an alkyl group, an aryl group or a heterocyclic group, each of which may have a substituent;

in formula (4), $R^{16}$ represents an aryl group or a heterocyclic group, each of which may have a substituent;

in formulae (1) to (4), $R^{14}$ and $R^{15}$ or $R^{14}$ and $R^{16}$ may be combined with each other to form a ring;

in formula (5), $R^{17}$ represents an alkyl group, an aryl group, an acyl group or a carbamoyl group and $R^{18}$ represents a phenyl group or a phenyl group substituted with one or more halogen atoms, alkyl groups, cyano groups, alkoxy groups, alkoxycarbonyl groups or acylamino groups;

in formulae (7) and (8), $R^{20}$ represents a hydrogen atom or a group selected from $—CONR^{22}R^{23}$, $—SO^2NR^{22}R^{23}$, $—NHCOR^{22}$, $—NHCONR^{22}R^{23}$ and $—NHSO_2NR^{22}R^{23}$ (wherein $R^{22}$ and $R^{23}$ each represents a hydrogen atom or a substituent);

in formulae (7) and (8), $R^{21}$ represents a substituent, l represents an integer of from 0 to 2, and m represents an integer of from 0 to 4, and when l or m is 2 or greater, the $R^{21}$ groups may be the same or different;

in formulae (9), (10), (11) and (12), $R^{32}$, $R^{33}$ and $R^{34}$ each represent a hydrogen atom or a substituent; and in formulae (1) to (5) and (7) to (12), Y represents a group imparting diffusion resistant property to the coupler and capable of being released upon a coupling reaction with an oxidation product of the developing agent.

7. The method of forming a color diffusion transfer image as claimed in claim 6, wherein the coupler is a two-equivalent coupler.

8. A method of forming a color diffusion transfer image which comprises developing an imagewise exposed light-sensitive material comprising a support having thereon light-sensitive silver halide, a binder, a compound represented by formula (I) shown below and a coupler compound which forms or releases a diffusible dye upon a reaction with an oxidation product of the compound represented by formula (I), said coupler compound being represented by formula (1), (2), (3), (4), (5), (7), (8), (9), (10), (11) or (12) shown below, and transferring and fixing the diffusible dye formed or released by development of the light-sensitive material after imagewise exposure to a dye fixing layer of a dye fixing material comprising a support having thereon at least one dye fixing layer, wherein a water-soluble compound represented by formula (II) shown below is supplied before, during or after the formation or release of the diffusible dye, the water-soluble compound being soluble in an aqueous 50 wt % methanol solution in an amount of at least 20 wt %:

(I)

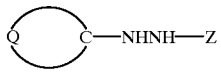

wherein Z represents a carbamoyl group, an acyl group, an alkoxycarbonyl group, an aryloxycarbonyl group, a sulfonyl group or a sulfamoyl group; and Q represents an atomic group necessary for forming an unsaturated ring together with the carbon atom;

(II)

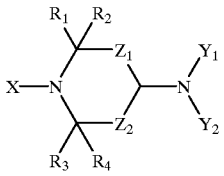

wherein X represents a hydrogen atom, a hydroxy group, an aliphatic group, an acyl group, an aliphatic oxy group, an aliphatic oxycarbonyl group or an aryloxycarbonyl group; $Y_1$ and $Y_2$, which may be the same or different, each represents a hydrogen atom or a substituent, or $Y_1$ and $Y_2$ may be combined with each other to form a 5-membered or 6-membered ring; $Z_1$ represents a simple bond, a methylene group which may be substituted or an ethylene group which may be substituted; $Z_2$ represents a methylene group which may be substituted; and $R_1$, $R_2$, $R_3$ and $R_4$, which may be the same or different, each represents an aliphatic group, or $R_1$ and $R_2$ and $R_3$ and $R_4$ each may be combined with each other to form a 5-membered or 6 membered ring (1)

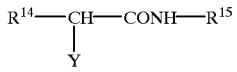

(2)

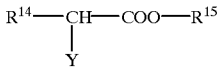

(3)

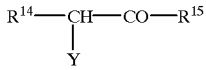

(4)

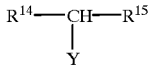

(5)

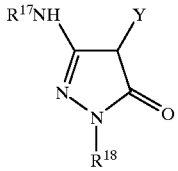

(7)

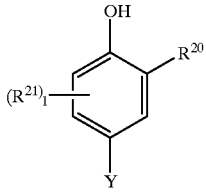

(8)

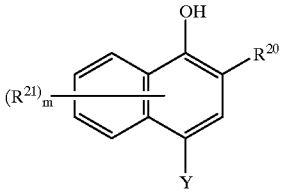

(9)

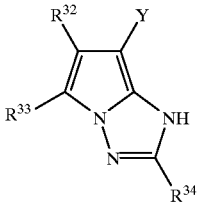

(10)

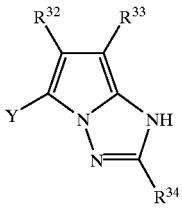

-continued (11)

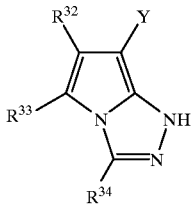

(12)

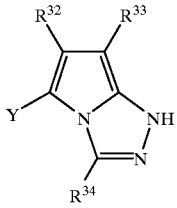

wherein in formulae (1) to (4), $R^{14}$ represents an acyl group, an aryl group, a heterocyclic group, an alkoxycarbonyl group, an aryloxycarbonyl group, a carbamoyl group, a sulfamoyl group, an alkylsufonyl group or an arylsulfonyl group, each of which may have a substituent, or a cyano group or a nitro group;

in formulae (1) to (3), $R^{15}$ represents an alkyl group, an aryl group or a heterocyclic group, each of which may have a substituent;

in formula (4), $R^{16}$ represents an aryl group or a heterocyclic group, each of which may have a substituent;

in formulae (1) to (4), $R^{14}$ and $R^{15}$ or $R^{14}$ and $R^{16}$may be combined with each other to form a ring;

in formula (5), $R^{17}$ represents an alkyl group, an aryl group, an acyl group or a carbamoyl group and $R^{18}$ represents a phenyl group or a phenyl group substituted with one or more halogen atoms, alkyl groups, cyano groups, alkoxy groups, alkoxycarbonyl groups or acylamino groups;

in formulae (7) and (8), $R^{20}$ represents a hydrogen atom or a group selected from $—CONR^{22}R^{23}$, $—SO^2NR^{22}R^{23}$, $—NHCOR^{22}$, $—NHCONR^{22}R^{23}$ and $—NHSO_2NR^{22}R^{23}$ (wherein $R^{22}$ and $R^{23}$ each represents a hydrogen atom or a substituent);

in formulae (7) and (8), $R^{21}$ represents a substituent, l represents an integer of from 0 to 2, and m represents an integer of from 0 to 4, and when l or m is 2 or greater, the $R^{21}$ groups may be the same or different;

in formulae (9), (10), (11) and (12), $R^{32}$, $R^{33}$ and $R^{34}$ each represent a hydrogen atom or a substituent; and in formulae (1) to (5) and (7) to (12), Y represents a group imparting diffusion resistant property to the coupler and capable of being released upon a coupling reaction with an oxidation product of the developing agent.

9. The method of forming a color diffusion transfer image as claimed in claim 8, wherein the coupler is a two-equivalent coupler.

10. A method of forming a color diffusion transfer image as claimed in claim 6, wherein Z in formula (I) is carbamoyl.

11. A method of forming a color diffusion transfer image as claimed in claim 8, wherein Z in formula (I) is carbamoyl.

* * * * *